US007075427B1

(12) United States Patent
Pace et al.

(10) Patent No.: US 7,075,427 B1
(45) Date of Patent: Jul. 11, 2006

(54) TRAFFIC WARNING SYSTEM

(75) Inventors: Joseph R. Pace, Omaha, NE (US); Joseph A. Pace, Omaha, NE (US)

(73) Assignee: EVA Signal Corporation, Omaha, NE (US)

( * ) Notice: Subject to any disclaimer, the term of this patent is extended or adjusted under 35 U.S.C. 154(b) by 154 days.

(21) Appl. No.: 10/685,347

(22) Filed: Oct. 14, 2003

Related U.S. Application Data

(60) Continuation-in-part of application No. 10/099,143, filed on Mar. 15, 2002, now abandoned, which is a continuation-in-part of application No. 10/027,920, filed on Dec. 20, 2001, now abandoned, which is a continuation-in-part of application No. 09/578,940, filed on May 25, 2000, now abandoned, which is a continuation-in-part of application No. 09/448,953, filed on Nov. 24, 1999, now abandoned, which is a continuation of application No. 09/344,477, filed on Jun. 25, 1999, now abandoned, which is a continuation-in-part of application No. 09/056,201, filed on Apr. 6, 1998, now Pat. No. 5,954,299, which is a division of application No. 08/710,147, filed on Sep. 16, 1996, now Pat. No. 5,735,492, which is a continuation-in-part of application No. 08/601,902, filed on Feb. 15, 1996, now abandoned, said application No. 10/027,920 is a continuation-in-part of application No. 09/614,501, filed on Jul. 11, 2000, now Pat. No. 6,471,162, which is a continuation-in-part of application No. 09/084,863, filed on May 26, 1998, now Pat. No. 6,113,037, which is a continuation-in-part of application No. 08/601,902.

(60) Provisional application No. 60/009,857, filed on Jan. 12, 1996.

(51) Int. Cl.
*G08B 1/08* (2006.01)

(52) U.S. Cl. ..... 340/539.22; 340/539.1; 340/901; 340/903; 340/933; 340/988; 246/125; 246/126

(58) Field of Classification Search ..... 340/539.22, 340/901, 903, 907, 931, 933, 436, 438, 815.4, 340/815.45, 539.1, 815.41, 988; 246/125, 246/126, 292, 294, 114, 405
See application file for complete search history.

(56) References Cited

U.S. PATENT DOCUMENTS 3,758,775 A 9/1973 Hopkins ..... 246/125
3,781,541 A * 12/1973 Darrow et al. ..... 246/128

(Continued)

FOREIGN PATENT DOCUMENTS

JP 4-39159 7/1992

(Continued)

*Primary Examiner*—Hung Nguyen
(74) *Attorney, Agent, or Firm*—Suiter West Swantz pc llo

(57) ABSTRACT

The present invention is directed to a train detection system for detecting the velocity, presence, and direction of a railroad car which may be utilized in existing railroad crossing installations. The train detection system is suitable for self-testing of its components and if an anomaly has been detected, the train detection system is capable of placing the system in a fail-safe state. The train detection system of the present invention is also capable of constant communication between the sensor of said system and the implementing device of the train detection system via a wireless link.

25 Claims, 35 Drawing Sheets

U.S. PATENT DOCUMENTS

| | | | | |
|---|---|---|---|---|
| 3,838,271 | A | 9/1974 | Ackard et al. | 246/125 |
| 4,120,471 | A | 10/1978 | Auer, Jr. | 246/128 |
| 4,365,777 | A | 12/1982 | Geiger | 246/130 |
| 4,954,216 | A | 9/1990 | Hunter et al. | 156/634 |
| 5,092,544 | A | 3/1992 | Petit et al. | 246/126 |
| 5,420,883 | A | 5/1995 | Swensen et al. | 375/200 |
| 5,554,982 | A * | 9/1996 | Shirkey et al. | 340/903 |
| 5,678,789 | A | 10/1997 | Pipich | 246/3 |
| 5,682,150 | A | 10/1997 | Votava | 340/908 |
| 6,157,322 | A * | 12/2000 | Anderson | 340/903 |

FOREIGN PATENT DOCUMENTS

| | | |
|---|---|---|
| JP | 5-319266 | 12/1993 |
| JP | 1-257668 | 10/1999 |

* cited by examiner

TRAFFIC WARNING SYSTEM

CROSS-REFERENCE TO RELATED APPLICATIONS

The present application is a continuation-in-part of U.S. application Ser. No. 10/099,143 filed Mar. 15, 2002 now abandoned which is a continuation-in-part of U.S. application Ser. No. 10/027,920 filed Dec. 20, 2001 now abandoned which is a continuation-in-part of U.S. application Ser. No. 09/578,940 filed May 25, 2000 now abandoned, which is a continuation-in-part of U.S. application Ser. No. 09/448,953 filed Nov. 24, 1999 now abandoned, which is a continuation of U.S. application Ser. No. 09/344,477 filed Jun. 25, 1999 (now abandoned), which is a continuation-in-part of U.S. application Ser. No. 09/056,201 filed Apr. 6, 1998, now U.S. Pat. No. 5,954,299 issued Sep. 21, 1999; which is a divisional of U.S. application Ser. No. 08/710,147 filed Sep. 16, 1996, now U.S. Pat. No. 5,735,492, issued Apr. 7, 1998, which is a continuation-in-part of U.S. application Ser. No. 08/601,902 filed Feb. 15, 1996 now abandoned. Said application Ser. No. 08/601,902 claimed the benefit under 35 U.S.C. § 119 of U.S. Provisional Application Ser. No. 60/009,857 filed Jan. 12, 1996.

U.S. application Ser. No. 10/027,920 is also a continuation-in-part of U.S. application Ser. No. 09/614,501 filed Jul. 11, 2000 U.S. Pat. No. 6,471,162 which is a continuation-in-part of U.S. application Ser. No. 09/084,863 filed May 26, 1998, now U.S. Pat. No. 6,113,037 issued Sep. 5, 2000, which is a continuation-in-part of U.S. application Ser. No. 08/601,902 filed Feb. 15, 1996 (now abandoned). Said U.S. application Ser. No. 08/601,902 claims the benefit under 35 U.S.C. § 119 of U.S. Provisional Application No.

The following related commonly owned U.S. Patents and Applications are incorporated herein by reference in their entirety:

| Applicant(s) | Ser. No. | Filing Date | U.S. Pat. No. | Issue Date |
|---|---|---|---|---|
| Pace, J. | 10/099,143 | Mar. 15, 2002 | | |
| Pace, J. | 10/027,920 | Dec. 20, 2001 | | |
| Pace, J. | 09/578,940 | May 25, 2000 | | |
| Pace, J. | 09/614,501 | Jul. 11, 2000 | | |
| Pace, J. | 09/448,953 | Nov. 24, 1999 | | |
| Pace, J. | 09/344,477 | Jun. 25, 1999 | | |
| Pace, J. | 09/084,863 | May 26, 1998 | 6,113,037 | Sep. 5, 2000 |
| Pace, J. | 08/601,902 | Feb. 15, 1996 | | |
| Pace, J. | 08/710,147 | Sep. 16, 1996 | 5,735,492 | Apr. 7, 1998 |
| Pace, J. | 09/056,201 | Apr. 6, 1998 | 5,954,299 | Sep. 21, 1999 |
| Pace, J. | 60/009,857 | Jan. 12, 1996 | | |
| Pace, J., et al. | 09/061,506 | Apr. 17, 1998 | | |
| Pace, J. | 09/385,168 | Aug. 30, 1999 | | |
| Pace, J. | 09/399,454 | Sep. 20, 1999 | | |
| Pace, J. | 60/276,252 | Mar. 15, 2001 | | |
| Pace, J. | 60/281,493 | Apr. 4, 2001 | | |
| Pace, J. | 60/424,637 | Nov. 7, 2002 | | |

Each of the before referenced incorporated by reference applications have the following relationships pursuant to 35 U.S.C. § 120.

Application Ser. No. 09/084,863 filed May 26, 1998 which is a continuation-in-part of U.S. application Ser. No. 08/601,902 filed Feb. 15, 1996 (now abandoned) which is a continuation-in-part of U.S. application Ser. No. 07/650,303 filed Feb. 4, 1991 (abandoned). Said U.S. U.S. Provisional Application Ser. No. 60/009,857 filed Jan. 12, 1996. U.S. application Ser. No. 09/084,863, U.S. application Ser. No. 08/601,902 and U.S. Provisional Application Ser. No. 60/009,857 are herein incorporated by reference in their entirety.

Application Ser. No. 09/061,506 filed Apr. 17, 1998, which is a continuation-in-part of U.S. application Ser. No. 09/056,201 filed Apr. 6, 1998, which is a divisional of U.S. application Ser. No. 08/710,147 filed Sep. 16, 1996, now U.S. Pat. No. 5,735,492 issued Apr. 7, 1998, which is a continuation-in-part of U.S. application Ser. No. 08/601,902 filed Feb. 15, 1996 Said application Ser. No. 08/601,902 claims the benefit under 35 U.S.C. § 119 of U.S. Provisional Application Ser. No. 60/009,857 filed Jan. 12, 1996.

Application Ser. No. 09/084,863 filed May 26, 1998, which is a continuation in part of U.S. application Ser. No. 08/601,902 filed Feb. 15, 1996, which is a continuation in part of U.S. application Ser. No. 07/650,303 filed Feb. 4, 1991. Said U.S. Provisional application Ser. No. 08/601,902 claims the benefit under 35 U.S.C. § 119 of U.S. Provisional Application No. 60/009,857.

Application Ser. No. 10/099,143 claims the benefit under 35 U.S.C. § 119 of U.S. Provisional Application No. 60/276,252 filed Mar. 15, 2001 and U.S. Provisional Application No. 60/281,493 filed Apr. 4, 2001.

The present application hereby claims the benefit under 35 U.S.C. § 119 of U.S. Provisional Application No. 60/424,637 filed Nov. 7, 2002.

FIELD OF THE INVENTION

The present invention relates generally to warning systems and more particularly to an improved train detection system for warning traffic. The present invention also relates generally to traffic control devices and more specifically to an active system for alerting motorists to information provided by a sign such as a traffic sign, or the like.

BACKGROUND OF THE INVENTION

Known to the art are active railroad crossing warning systems utilizing the railroad tracks themselves to detect an approaching train and activate a warning signal apparatus such as warning lights and bells. These systems known to the art warn motorists when a train is detected at a predetermined distance from the crossing. However, present active warning systems do not take into account the velocity, size, or location of the train and thus make no allowance for the time it will take the train to reach the crossing. For example, a fast moving train may reach the crossing in only a few seconds after it is detected, while a slow moving train may fail to reach the crossing until several minutes have passed. Motorists may become impatient waiting for slow moving trains to reach the crossing. Consequently, some motorists may begin to ignore the warnings and attempt to cross the tracks possibly causing an accident should a fast moving train be encountered.

Further, installation of current active detection systems may require the installation and resetting of great lengths of track. Further, current detection systems may be susceptible to rail corrosion and degradation over time causing the detection system to malfunction. Additionally, these systems may require the installation of expensive high voltage transformers, relays, and batteries for backup systems. Unfortunately, many rural crossings are not conducive to the installation of active warning systems that require AC electrical power and extensive grade preparation. Consequently, these crossings usually remain inadequately protected. Another disadvantage of railroad warning systems known to the art is that they do not provide fail-safe conditions. For example, some crossings may not provide adequate protection if there is a loss of electrical power or if a component of the detection system has failed. Under such conditions, a railroad warning system may be non-functional without being noticed by railroad personnel and motorists. In order to provide adequate protection to motorists when they encounter a railroad crossing, an improved train detection system is necessary. The impact of high speed rail corridors being proposed across the United States will only exacerbate this need.

Additionally, railroad crews working on or in the vicinity of active railroad tracks are susceptible to accidents as a result of not being sufficiently warned of an oncoming train entering the work area. The rail work is typically performed in isolated regions away from crossing areas, and therefore the work crews do not have the benefit of standard crossing signals to warn them of approaching trains. Thus, there lies a need for a reliable warning system for warning maintenance-of-way crews which allows the crew to concentrate on the work at hand while providing adequate warning of oncoming train hazards in order to clear the tracks of tools, equipment and workers to avoid an accident. The railroad crew warning system is further required to be portable and easily set up by the crew in a relatively short period of time. Consequently, the warning system should be of sufficient operational efficiency to activate the warning system only upon the detection of a train to thereby mitigate the natural human tendency to ignore the warning system after false activations.

Likewise, when maintenance is required to be performed in areas where train traffic occurs, a human is used as a "flagman" to monitor for a possible approaching train. Upon detecting a train the flagman then signals to the various parties of a trains approach and the maintenance workers are alerted to move out of the way. Normally at this time the human flagman would let out a blast from his air horn to warn the workers that a train is inbound. Utilizing a human flagman results in high labor cost and errors in human judgement. Consequently, it would be advantageous if a system and method existed for reliably warning maintenance personnel reliably and in a cost-effective manner.

Furthermore, difficulty exists in positively determining a train's position and data relevant to dispatching trains in rail yards. Consequently, it would be advantageous if an apparatus and method existed for reliable, easily installed, cost-effective, detection of critical information concerning railroad transportation vehicles.

The railroad industry has conventionally employed multiple railroad tracks across a desired route. This is advantageous as it allows more trains to travel at the same time, regardless of whether they are traveling in the same or opposite directions. In order to better arrange traffic, locations along a railroad route may include a track switch. In the past, mechanical switches were utilized. Switching of the railroad tracks was executed by an individual manually switching the mechanical switch. In order to remove the requirement of labor for switching railroad tracks, electromechanical switches with remote actuation were introduced. A remote control may be employed such that a conductor of a train, may switch the track by actuating the remote control. A problem associated with the use of remote-controlled switches is caused when switching of the tracks is initiated with a railroad car in vicinity of the switch. When this occurs, railroad cars may come disengaged or it may result in a derailment.

Finally, traffic accidents result in thousands of injuries and deaths in the United States each year. Many of these accidents occur because a motorist failed to see and obey a traffic sign due to a distraction or because his or her view of the traffic sign was obstructed by environmental conditions or darkness. Most often, such accidents occur at an intersection between two or more roadways where two vehicles may collide because one vehicle failed to stop at a stop sign. To reduce the possibility of such accidents and to improve traffic flow, busy intersections are often equipped with traffic light systems which control the flow of traffic through the intersection by allowing each lane of traffic to alternately proceed through the intersection for a predetermined length of time. However, installation of traffic light systems may not be feasible for less busy intersections in rural or residential areas. For these intersections, passive signs such as stop signs or yield signs provide the only means of traffic control. Motorists are required by law to obey these signs regardless of traffic conditions and are expected to use caution in watching for other automobile traffic, pedestrians, or the like. Similarly, traffic signs, such as warning signs, regulatory signs, no-passing signs, school and school crossing signs are used along the roadway to convey important traffic information. A motorist may fail to see such signs due to poor visibility conditions, distraction, or simple inattentiveness.

SUMMARY OF THE INVENTION

In accordance with this need, the present invention provides a railroad detection system for alerting a motorist approaching a railroad crossing to the presence of an oncoming train. As used herein, "motorist" is intended to refer not only to operators and passengers of motor vehicles, but also to pedestrians, cyclists, bystanders, and the like. Sensors adjacent to the railroad track may be placed at predetermined distances from the railroad crossing to sense the presence, direction, and velocity of an approaching train. At a predetermined time before the train reaches the crossing, the implementation subsystem may activate a warning system to alert motorists to the presence of the oncoming train. The motorists may then take cautionary or evasive action.

The sensors of the present invention also permit self-testing thus providing a fail-safe condition. The implementation subsystem is in constant communication with the sensors via a hardware or alternatively a wireless connection. Thus, if the sensors or the implementation subsystem should notice an anomaly or are not working properly, the railroad detection system may be placed in a fail-safe condition. Upon entering the fail-safe condition, the warning system located at the railroad crossing may be initiated by the implementation system alerting motorists and railroad personnel that the railroad detection system is non-functional.

Furthermore, the present invention provides a system for warning railroad crews working on or in the vicinity of railroad tracks of oncoming trains. A train detector probe is placed near the train rails at a predetermined distance from the works crew in either direction along the tracks. Electronic detection, processing and control circuitry receive and process the detector probe signal which is transmitted via a radio frequency communications link to a receiver in the located vicinity of the crew. The receiver processes the received train detection signal and thereupon activates a warning system which provides visual and audio warning to the crew of the presence of an incoming train.

It should also be noted, the present invention is directed to a system and method for determining the presence, type, time, date, length and speed of a train. Additionally, the present invention is a system and method suitable for remotely detecting the presence, speed, type, time, date and length of a train located on an adjacent railroad track. Finally, the present invention is capable of communicating with other like devices on a system via wired or wireless communication; including via and through encrypted control systems operated by at least one host; including wherein said system includes information about traffic (railway and other); and including wherein said system is smart using predictive algorithms, for example in combination with said data logger and failsafe features to predict component or system failures and to communicate both faults and predictions, for example to said host.

It will also be noted said present invention provides a novel system for actively alerting motorists, cyclists, or pedestrians to information provided by a sign such as a traffic sign or the like. One or more sensors are positioned near a road surface such as, for example, a roadway, a parking lot, or a parking garage. These sensors detect the presence of a vehicle on the road surface whereupon a controller may illuminate a plurality of light emitting devices arrayed on the surface of the sign to enhance the visibility of the sign to the motorist.

According to various aspects of the present invention, the system may be used to enhance visibility of signs along a roadway or at an intersection between two or more roadways, to regulate traffic through a construction zone, to provide traffic information to motorists traveling on a highway, or to provide vacancy information to motorists entering a parking lot or parking garage, for example.

Those skilled in the art will understand that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which:

FIGS. 24A through 24M depict typical roadway signs which may be used with the present invention, wherein FIG. 24A is a multipurpose regulatory sign having a plurality of light emitting devices for providing multiple messages as required by a particular application, FIG. 24B is a regulatory sign providing a speed limit, FIG. 24C is a regulatory sign indicating that a center lane of a roadway is a turn lane, FIG. 24D is a regulatory sign providing an exit ramp speed limit, FIG. 24E is a regulatory sign indicating that a left turn is prohibited, FIG. 24F is a reserved parking regulatory sign, FIG. 24G is a stop sign, FIG. 24H is a one-way traffic sign, FIG. 24I is a yield sign, FIG. 22J is a no passing zone sign, FIG. 22K is a warning sign indicating that the right lane of a road way will be ending, FIG. 24L is a warning sign indicating that a stop sign is ahead, and FIG. 24M is a school crossing sign;

FIG. 25 illustrates an embodiment of the warning system for use in construction zones or the like;

DETAILED DESCRIPTION OF THE EXEMPLARY EMBODIMENT

Reference will now be made to a presently preferred embodiment of the present invention, examples of which are illustrated in the accompanying drawings.

Description of FIGS. 1–8

Figure 1:
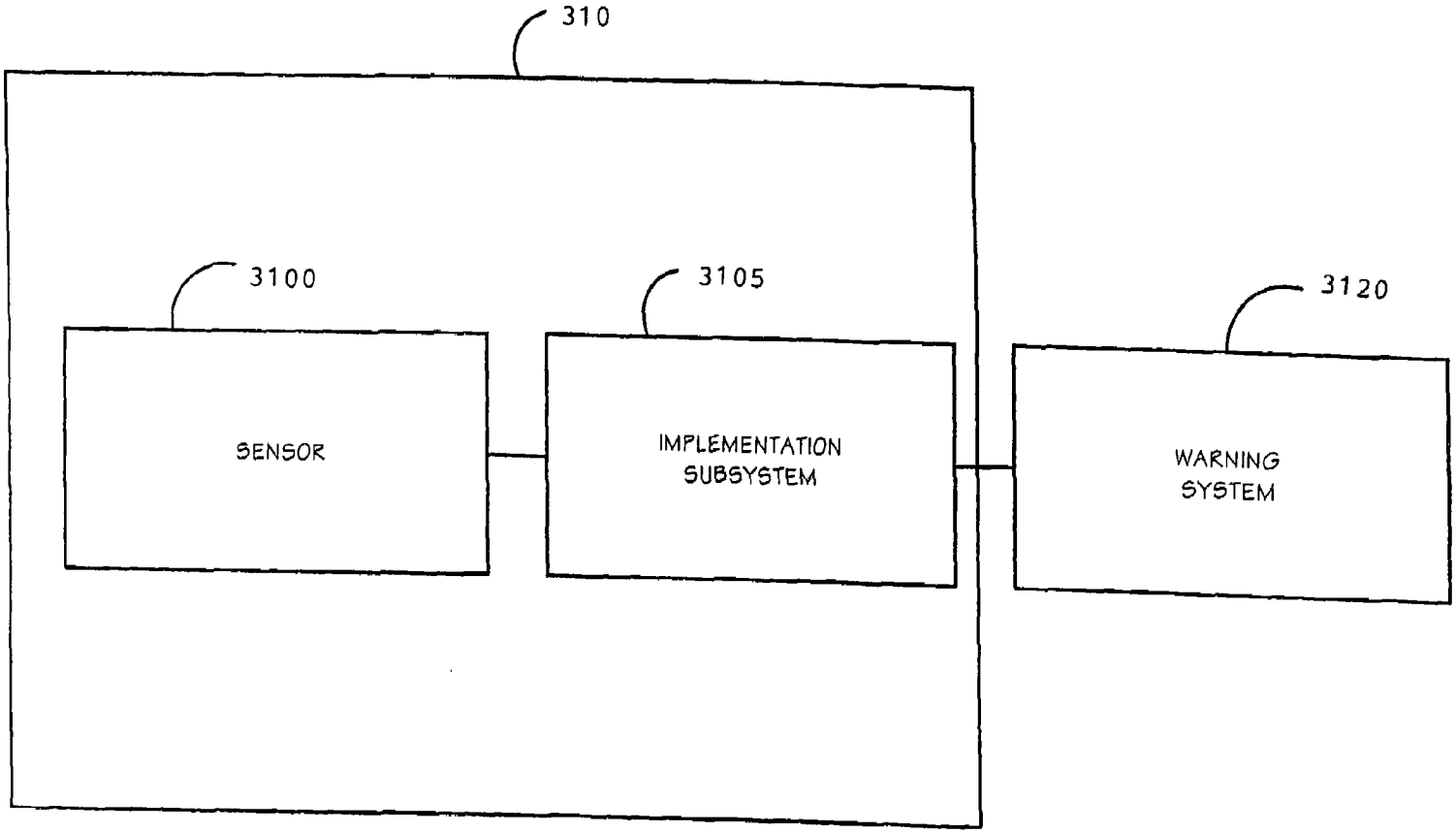
FIG. 1 is a block diagram of the adaptable and universal nature of the subsystems of the train detection system of the present invention.

FIG. 1 depicts the universal and distinct subsystems of an exemplary train detection system 310 of the present invention. In an exemplary embodiment of the present invention, the train detection system 310 comprises a sensor 3100 and an implementation subsystem 3105. The train detection system 310 may be connected with a warning system 3120 in order to adequately alert motorists approaching a railroad crossing to the presence of an oncoming train. Since not all railroad crossings require complete detection and warning systems, the train detection system 310 of the present invention may also be installed with current installations in such a way that the sensor 3100 or the implementation subsystem 3105 may be installed independently to upgrade current installations. The train detection system 310 of the present invention preferably comprises of subsystems and components that operate separately of the railroad's track, equipment, or systems yet still provide means for detecting an oncoming railroad train.

Figure 2:
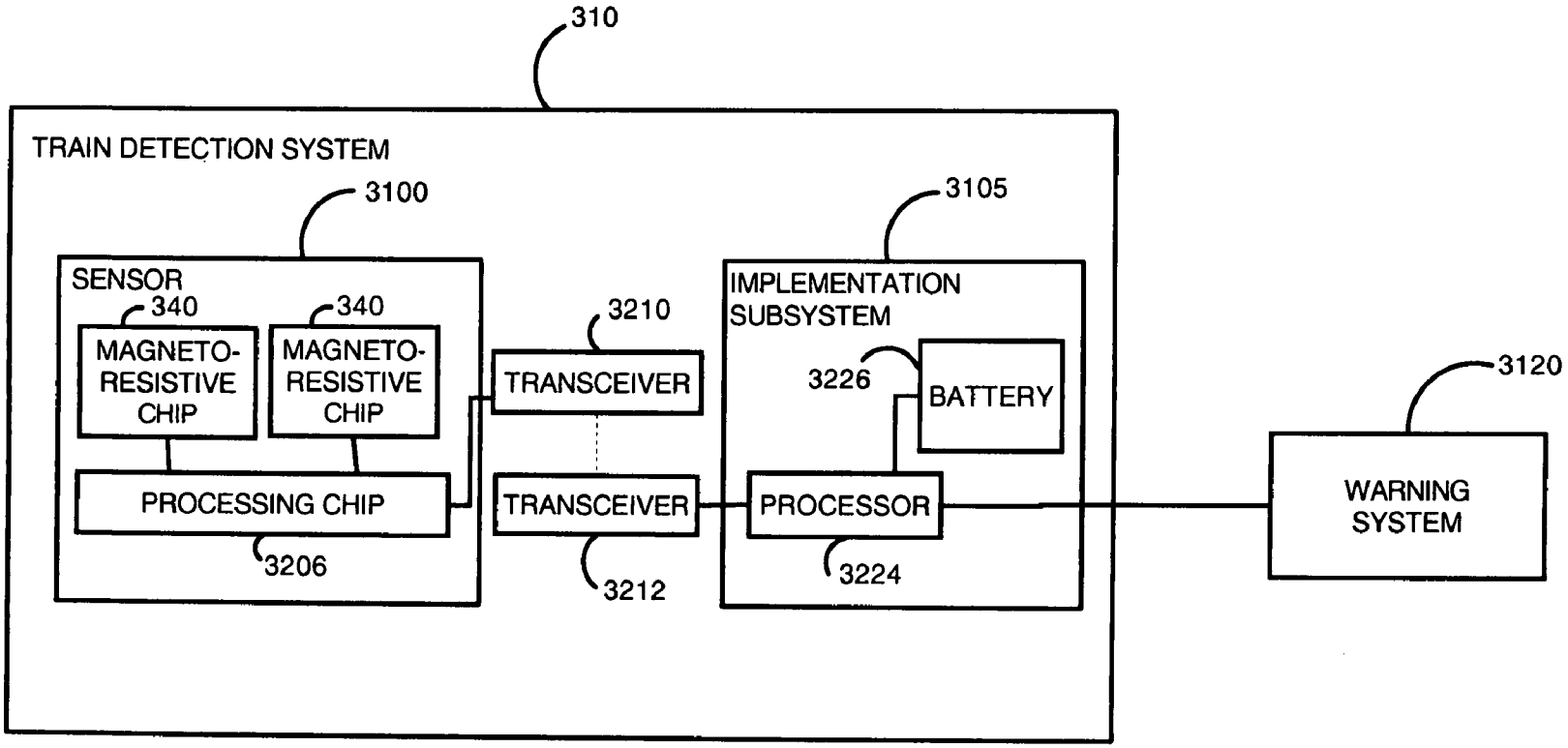
FIG. 2 is a highly diagrammatic representation of the primary components of a presently preferred exemplary embodiment of the present invention wherein components of the sensor and implementation subsystem are illustrated.

Referring to FIG. 2, a detailed view of an exemplary embodiment of the train detection system 310 of the present invention displaying the components that comprise the detection system 310 is shown. In a preferred embodiment, the sensors may be capable of operation in different temperature extremes ensuring reliability of the detection system of the present invention. The sensor 3100 includes at least two solid state magneto-resistive chips 340 and a processing chip 3206. The magneto-resistive chips 340 may be suitable for detecting a ferromagnetic material object such as a train. In a preferred embodiment, the magneto-resistive chips may be manufactured by the HONEYWELL® Corporation, one example of the magneto-resistive chip 340 being part number 1021 S-2. The implementation subsystem 3105 may comprise a programmable processor 3224 and a rechargeable battery 3226. The sensor 3100 and the implementation subsystem 3105 may be interconnected through a serial line or alternatively through a wireless connection. Utilizing a wireless connection, a first transceiver 3210 and a second transceiver 3212 may be connected to the processing chip 3206 and the programmable processor 3206 respectively.

Figure 3:
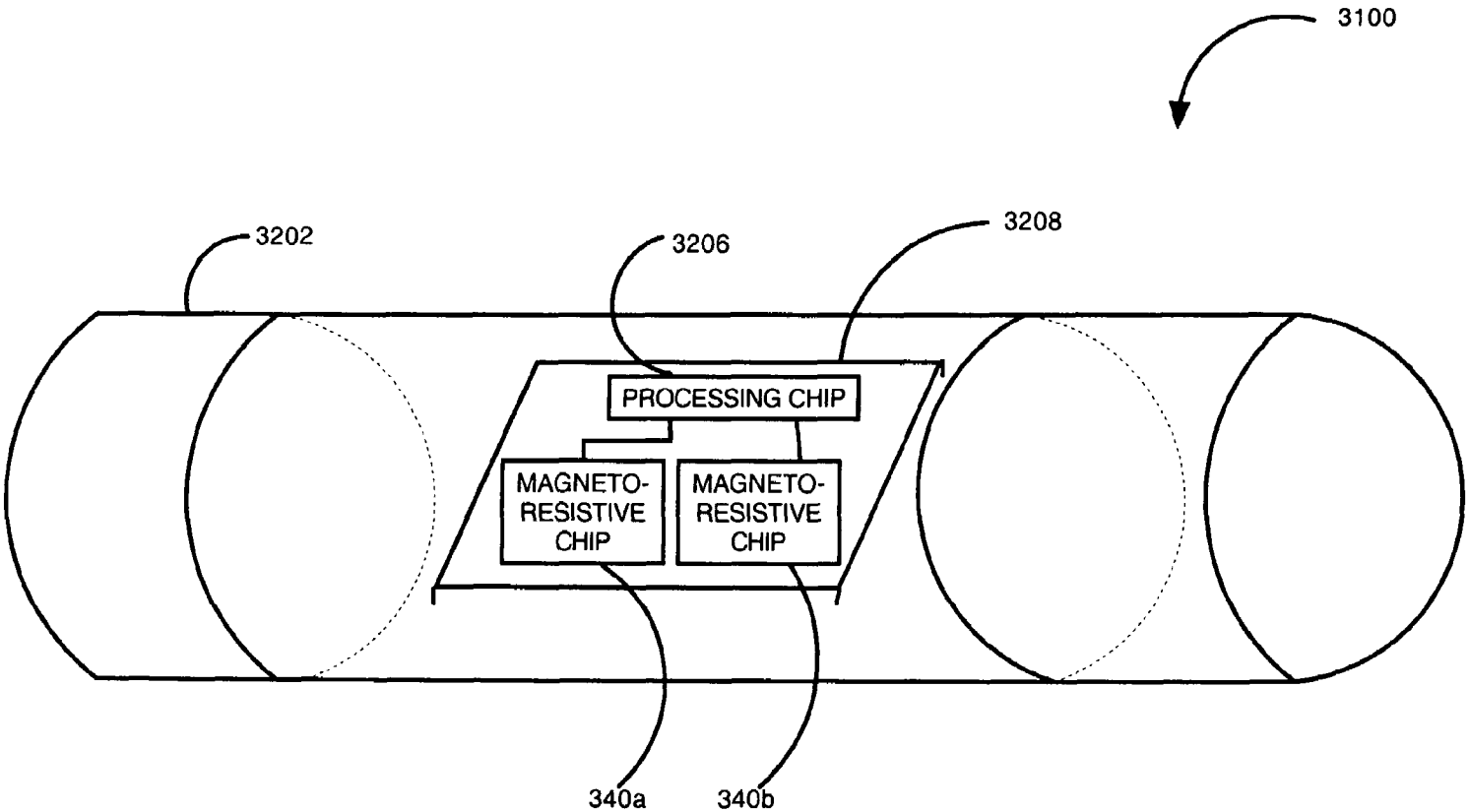
FIG. 3 depicts an exemplary embodiment of a sensor of the present invention.

Another advantage of an exemplary embodiment of a detection system 310 of the present invention is that the components of the sensor 3100 may be placed within a single enclosure. Referring now to FIG. 3, an exemplary embodiment of a sensor 3100 of the present invention is shown. The magneto-resistive chips 340 and the processing chip 3206 may be placed on a circuit board 3208 or other similar object for mounting chips. The magneto-resistive chips 340, processing chip 3206, and the circuit board 3208 may be placed within an enclosure 3202 suitable for protecting the components of the sensor 3100 from elements and temperature changes when placed underground. In a preferred embodiment, polyvinyl chloride pipe or other suitable material and the like may serve as the enclosure 3202.

Turning now to the way in which the sensor 3100 of the present invention works, an exemplary embodiment of the sensor 3100 as depicted in FIG. 3 may be placed just below ground up to seven feet away from the railroad track. This may be beneficial as maintenance performed on the railroad track may not damage the detection system of the present invention while working on or near the railroad track. When a ferromagnetic material object passes over the sensor 3100, it will pass over, adjacent, near, or proximate to the first magneto-resistive chip 340*a* and then will pass over, adjacent, near, or proximate to the second magneto-resistive chip 340*b*. When the ferromagnetic material object passes over the magneto-resistive chips 340, each magneto-resistive chip 340 may produce a signal which is received by the processing chip 3206.

Figure 4A:
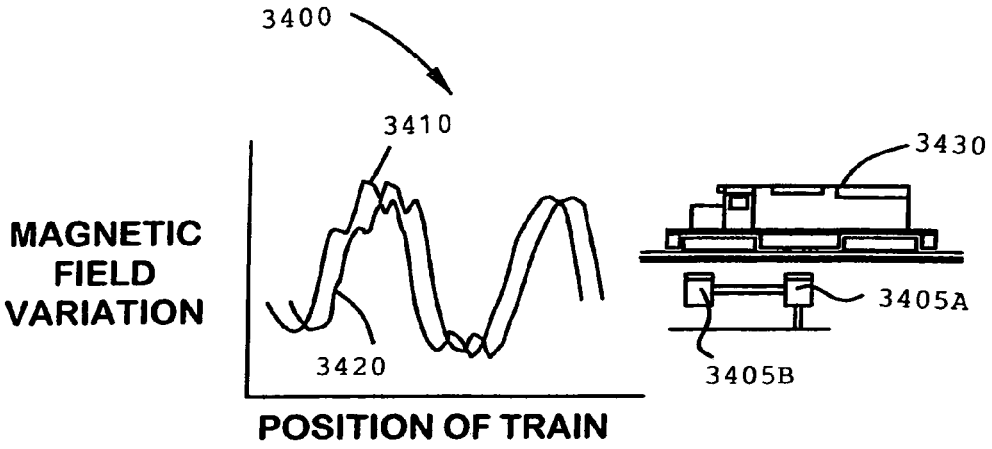
FIGS. 4A and 4B depicts an exemplary embodiment of the magnetic field variation produced by a magneto-resistive chip of the present invention when a train passes near a chip and a digital signal that may be produced utilizing threshold values.
Figure 4B:
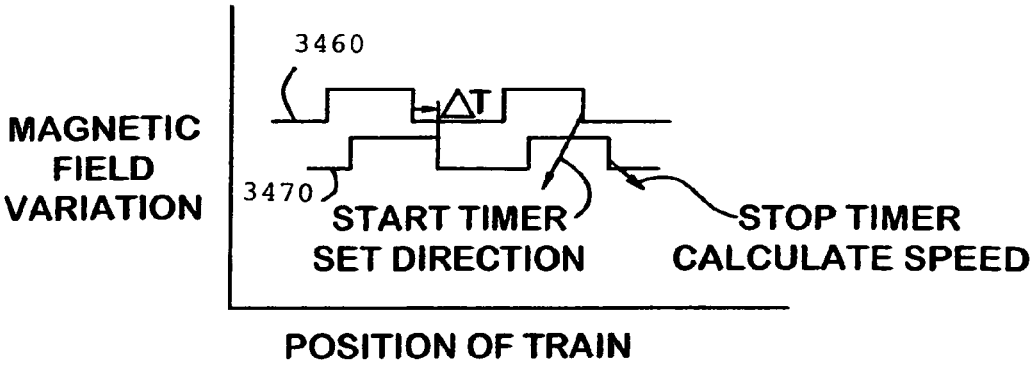

Referring now to FIG. 4A, an exemplary embodiment 3400 representing the magnetic field variation of a train measured by the magneto-resistive chips 3405*a* and 3405*b* of the present invention. Signals 3410, 3420 may be produced by the magneto-resistive chips 3405*a*, 3405*b* respectively when a ferromagnetic material object, a train 3430 for example, passes the magneto-resistive chips 3405*a*, 3405*b*. Referring to FIG. 4B, in an exemplary embodiment 3450 digital signals 3460, 3470 may be created from the signals 3410, 3420 produced when a ferromagnetic material object passes a magneto-resistive chip 3405*a*, 3405*b* by utilizing threshold levels to pick out peaks and valleys.

When viewing the digital signal 3460 created from the magneto-resistive chip 3405*a*, a timer is started and a direction is determined upon the falling edge of the magneto-resistive chip 3405*a* output. The rising edge of the magneto-resistive chip 3405*b* stops the timer which calculates a change in time whereby the velocity of the train may be calculated by dividing the distance between the magneto-resistive chips divided by the change in time. The magneto-resistive chips may be placed about two to four feet apart within the enclosure protecting the chips, preferably the magneto-resistive chips may be placed about thirty-three inches apart. This may provide enough space in order for a processing chip of the sensor to process the signals produced by each magneto-resistive chip 3405*a*, 3405*b*. Another advantage of the sensor of the present invention is that it will be a rare occurrence that an object would come to a stop between the magneto-resistive chips of the sensor. If the distance between chips is large, then its possible an object could pass the first magneto-resistive chip and stop before reaching the second magneto-resistive chip. This may result in an anomaly and may cause the detection system to enter a fail-safe state. By decreasing the distance between the magneto-resistive chips, the chance that an object may stop between that area is less likely.

Figure 5:
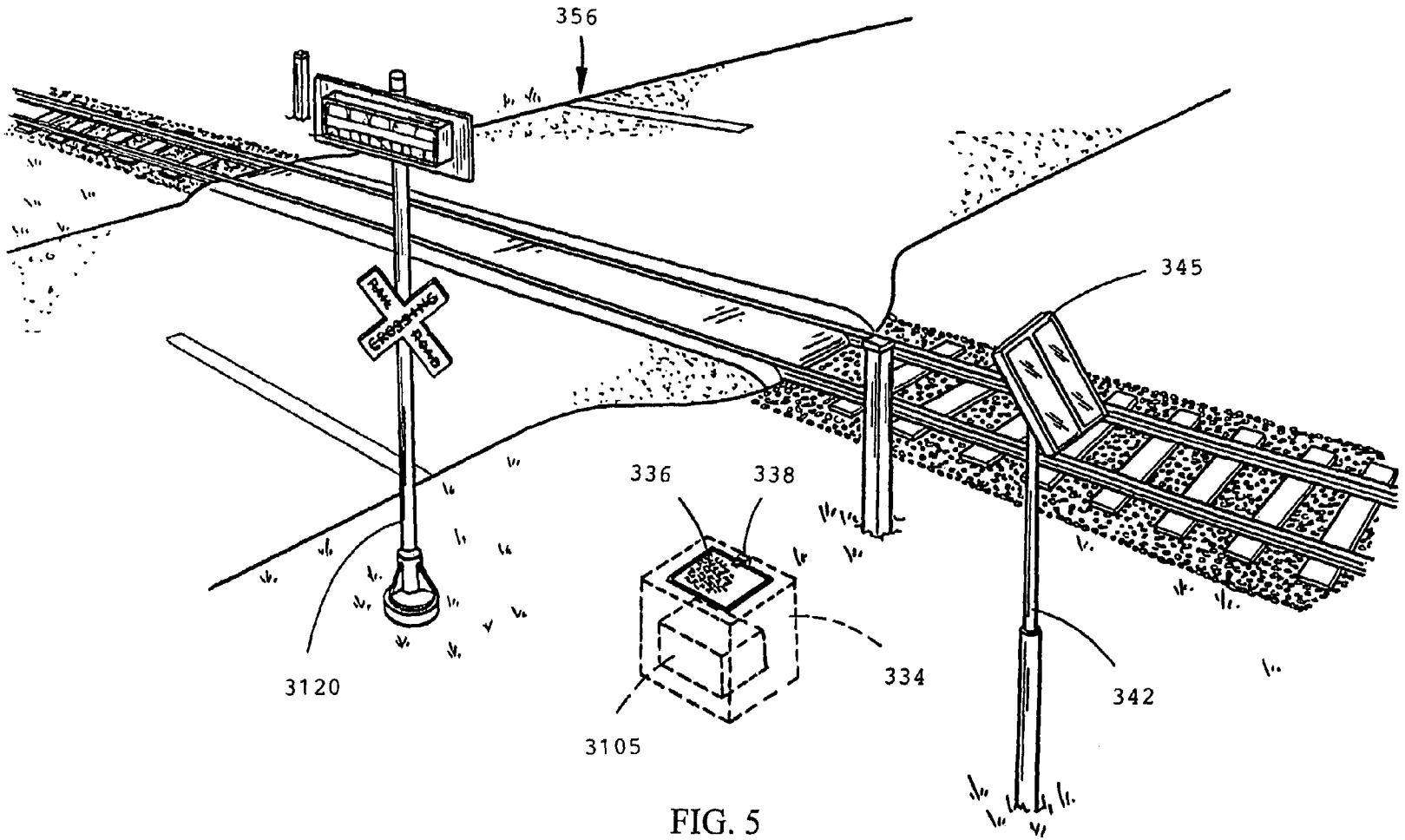
FIG. 5 is a pictorial view of a typical single track grade crossing displaying the location and cross-sectional view of a vault of the present invention.

FIG. 5 depicts a typical railroad crossing 356. In a preferred embodiment, the implementation subsystem 3105 may be placed within a waterproof underground vault 334 for security and physical protection. The vault 334 may include a steel access door 336 secured by a locking device 338 such as a hasp to receive a padlock or the like. The buried vault 334 may provide physical security for the implementation subsystem 3105 and protect the implementation subsystem's components from the extreme temperature changes that could be experienced. Preferably, the vault 334 may be grounded to provide electrostatic shielding to the electronic components contained therein.

The detection system 310 of the present invention is preferably powered by one or more rechargeable batteries 3226 as shown in FIG. 2. Referring once again to FIG. 5, the one or more batteries 3226 may be placed in the vault 334 with the programmable processor 3224. Recharging of the batteries may be accomplished by means of a solar panel array 345 mounted on a pole, or post 342 near the railroad crossing 356. Use of solar panels 345 may be desirable when the system 310 is to be deployed at crossings located in rural areas where a source of electrical power is not readily available. The solar panel 345 may have a transparent covering comprising ½ inch thick LEXAN® bullet resistant translucent material or the like to prevent damage due to the environment or vandalism.

Figure 6:
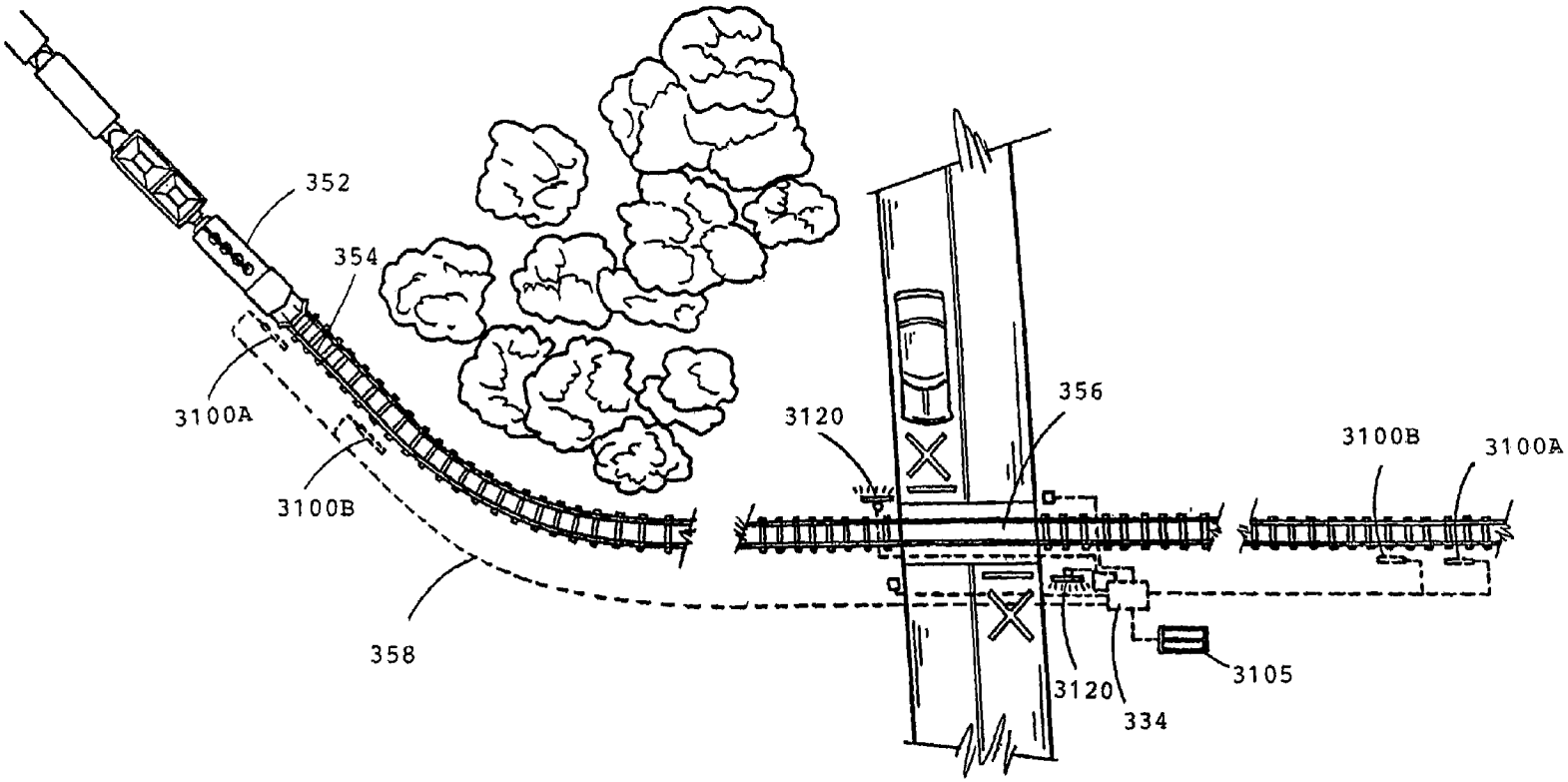
FIG. 6 is a top plan view of an area surrounding a typical grade crossing depicting the placement of the train detection system's components along the track.

FIG. 6 illustrates operation of the detection system 310 to detect an approaching train 352 moving along a railroad track 354. As the train travels towards a railroad crossing 356, it will pass over the sensors 3100 as shown in an exemplary embodiment in FIG. 3. The sensors 3100 may be buried in the right-of-way along the railroad track 354 to protect the sensors 3100 from elements and vandalism. The sensors 3100 may be connected to the implementation subsystem 105 through a shielded, rodent proof cable 358, or alternatively via a wireless connection. In a hardwire embodiment, the cable 358 may be a foam/skin insulated filled cable meeting REA Specification PE-89.

Alternatively, in another exemplary embodiment the sensor and the implementation subsystem of the present invention may be connected via a wireless connection. Information may be transported from the sensors 3100 to the implementation subsystem 3105 through signal transmission means. For example, the sensor 3100 may be connected with a transceiver suitable for delivering and receiving information to and from the programmable processor of the implementation subsystem. Further, the programmable processor of the implementation subsystem may also be connected with a transceiver suitable for delivering and receiving information. Antennas may be connected with each transceiver in order to aid reception and transmission and increase signal gain of the radio communications link between the sensor and the implementation subsystem. As such, the sensor and the implementation subsystem may be in constant communication with each other, and if the connection malfunctions, the system may be preferably placed into a fail-safe state.

The wireless connection preferably utilizes several bands of spread spectrum channels that does not require a Federal Communications Commission license to operate. Preferably, constant analysis of the bands may be performed in order to ensure best reception. The wireless connection preferably is a dual-tone multiple frequency encoded, spread spectrum modulated transmission to avoid unintended jamming or interference from other frequency resources operating in the vicinity thereby preventing loss of communication or false alarms. Further, in another embodiment the wireless connection may utilize encryption to provide secure transfer of information between the sensor and the implementation subsystem. Also, in yet another embodiment a mobile receiver capable of receiving wireless communication may be utilized, for example, within the train to alert an engineer that the train has been detected by the train detection system.

Figure 7A:
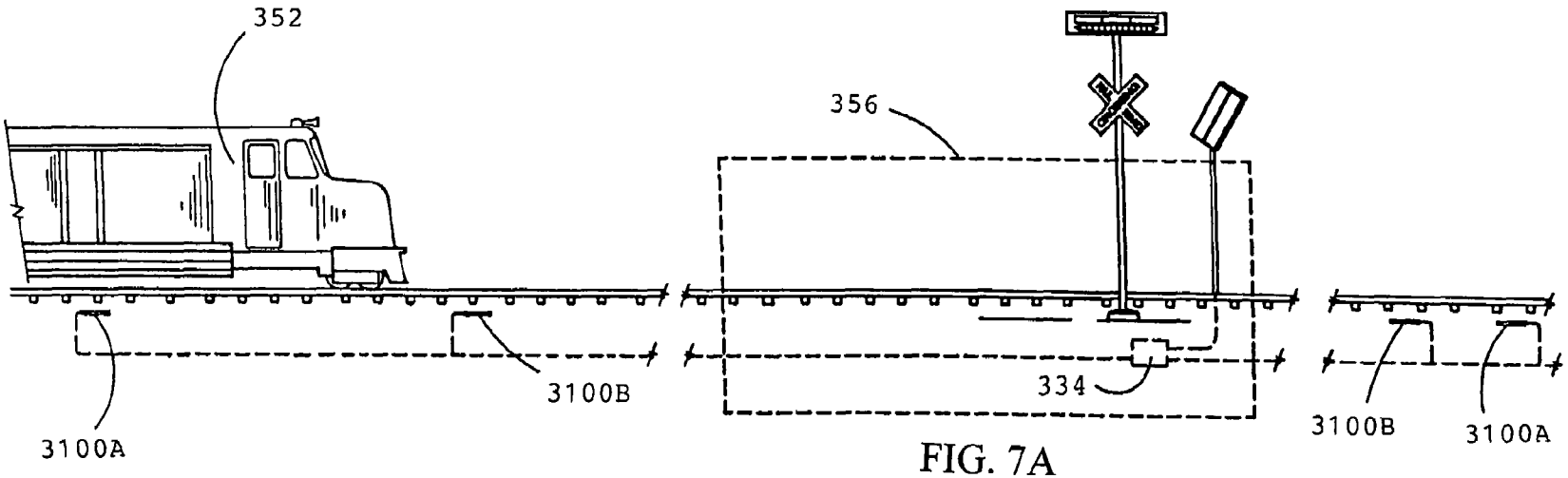
FIG. 7A is an elevational view of the embodiment of the invention shown in FIG. 6 illustrating the operation thereof before an oncoming railroad train reaches the crossing.
Figure 7B:
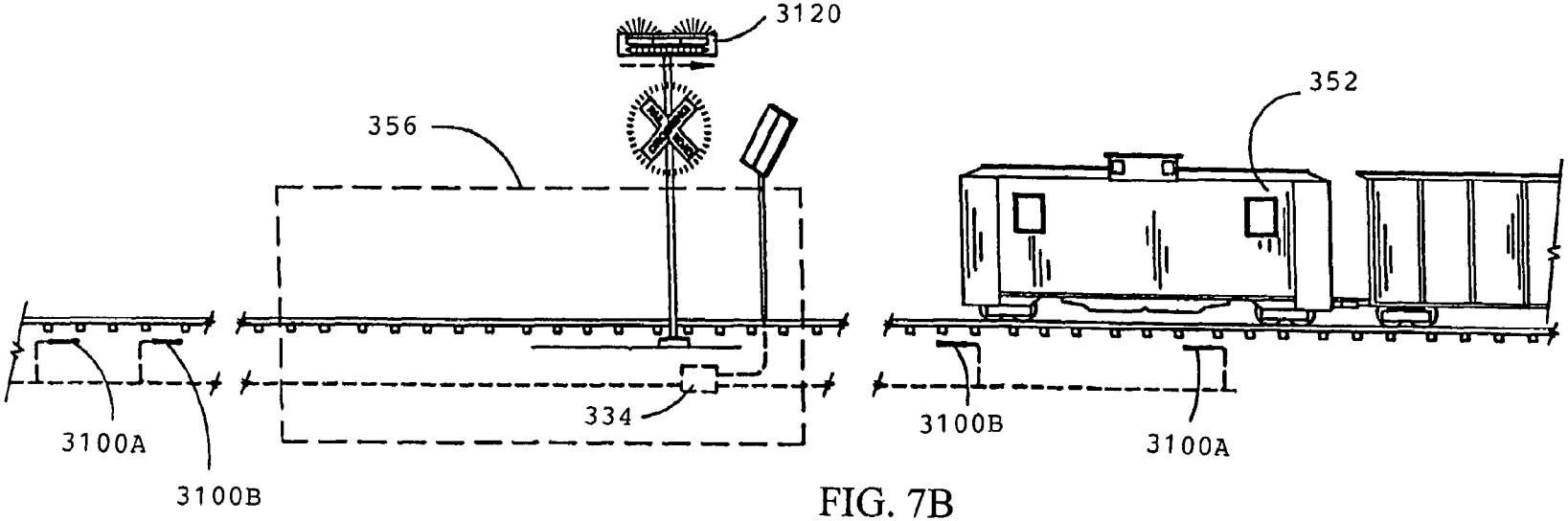
FIG. 7B is an elevational view of the embodiment of the invention shown in FIG. 6 illustrating the operation thereof after passage of the train.
Figure 8:
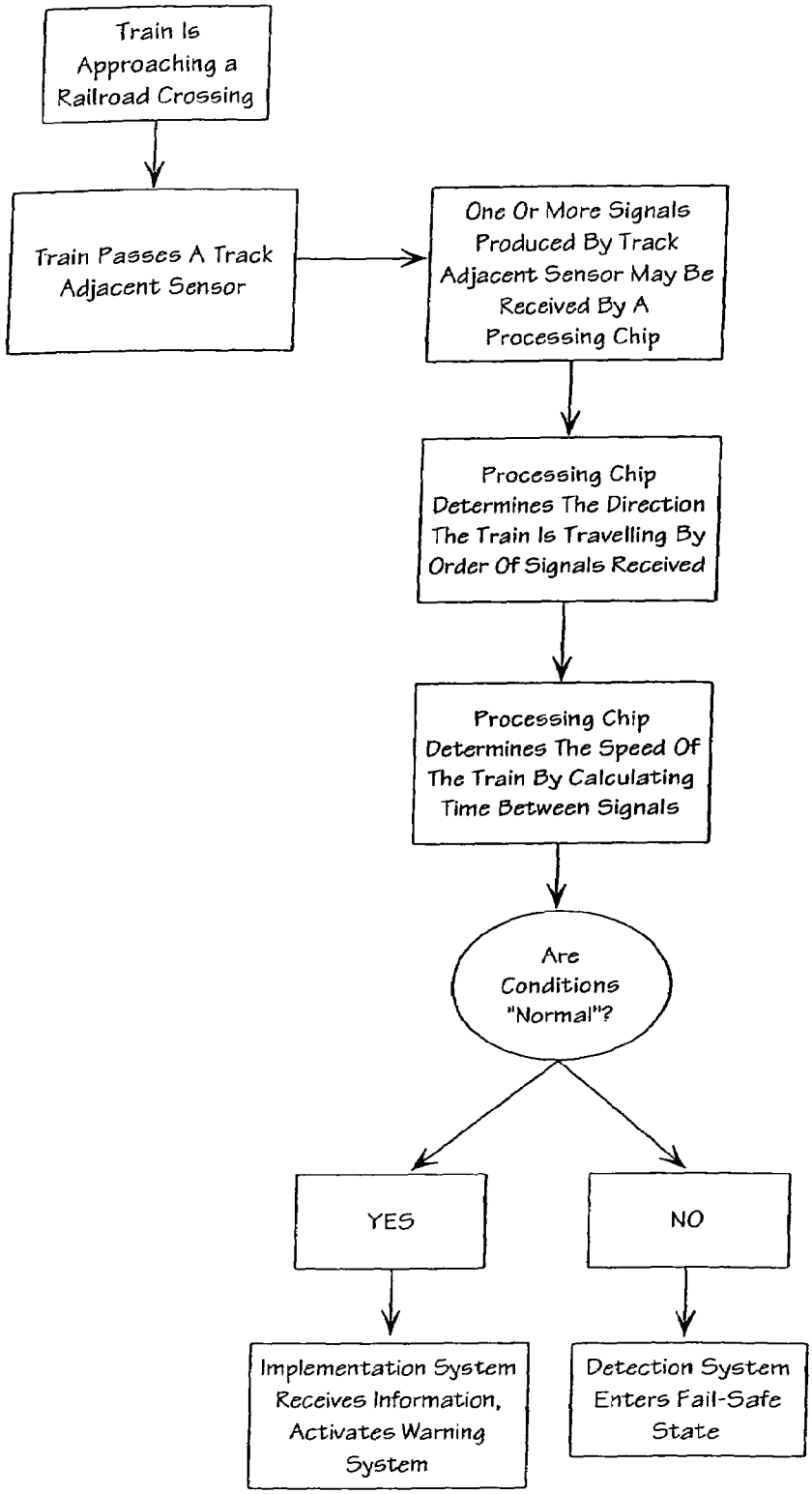
FIG. 8 is a flow diagram illustrating an exemplary process of the train detection system of the present invention.

FIGS. 7A and 7B illustrate operation of the system 310 to sense an approaching train 352 and activate the warning system 3120. The train detection system 310 preferably comprises a primary sensor 3100*a* and a secondary or backup sensor 3100*b*. In an exemplary embodiment, the primary sensor 3100*a* comprises at least two solid state magneto-resistive chips positioned on either side of the grade crossing 356 along the track 354 at a predetermined distance from each other. The sensor 3100*a* is preferably located at a sufficient distance from the grade crossing 356 to permit the system 310 to activate the warning signal devices 3120 at a predetermined interval of time before the arrival of the train 352 regardless of the train's speed.

A secondary or backup sensor 3100*b* may also be provided should the primary sensor 3100*a* fail to properly sense an approaching train. Like the primary sensor 3100*a*, the backup sensor 3100*b* may include at least two solid-state magneto-resistive chips with a processing chips placed on a circuit board and sealed within an enclosure. This enclosure may be buried in the earth in the right-of-way on either side of the grade crossing 356. Each backup sensor 3100*b* is preferably positioned at a predetermined distance from the crossing 356 along the track 354. During normal operation, the primary sensor, upon proper sensing of a train 352 by at least two of the magneto-resistive chips of the primary sensor 3100*a*, may disable, for example, operation of the backup sensor 3100*b*. If, however, the primary sensor 3100*a* malfunctions or the train 352 is not detected by at least two of the magneto-resistive chips of the primary sensor 3100*a*, the backup sensor 3100*b* provides means of activating the warning signal devices 3120 before the train 352 reaches the crossing 356. For example, the approaching train 352 is detected by the first magneto-resistive chip of the primary sensor 3100*a*. However, due to malfunction, the second magneto-resistive chip of the primary sensor 3100*a* fails to sense the train 352. The primary sensor 3100*a* cannot determine the speed of the approaching train 352 in order to determine the appropriate time in which to activate the warning signal devices 3120. Preferably the implementation subsystem 3105 does not disable the backup subsystem. As the train 352 continues toward the crossing 356, it reaches the first of the magneto-resistive chips of the backup sensor 3100*b* and is sensed. The backup sensor 3100*b* provides a signal to the implementation subsystem 3105 which may immediately activate the warning signal devices 3120.

Alternately, in an exemplary embodiment the backup sensor may comprise an analog magnetometer. In this embodiment, the backup sensor may be disabled during normal operation in which the primary sensor 3100*a* senses a train. If the primary sensor 3100*a* malfunctions, then the backup sensor may provide means for activating the warning signal devices 3120 before the train 352 reaches the crossing 356.

The sensors of the present invention provide a number of advantages than those well known to the art. First, they may be installed independently of the railroad track and without requiring the resetting of the track. Also, since the sensor may be placed within a single enclosure, this allows for easier installation and maintenance. Further, since the sensors may be buried underground, they resist possible vandalism. The sensors of the present invention are suitable for self-testing. If the sensor senses a condition which may not be normal, the detection system may be placed in a fail-safe state. For example, first magneto-resistive chip senses the presence of a train, however, a second signal is not received from the second magneto-resistive chip by the processing chip, then the detection system may be placed in a fail-safe state. In another example, if a train is sensed and is determined to be traveling at a speed in excess of 200 miles per hour, then the detection system may be placed in a fail-safe state. The process as just described is represented in a flow chart in FIG. 8.

The implementation subsystem of the present invention provides a number of advantages. If the implementation subsystem notices any anomaly in the information provided to it by the sensors, then it would cause the system to enter a fail-safe state. Also, the sensors will be in constant communication with the implementation subsystem and thus will notice any anomaly instantly. For example, if the cable connecting the implementation subsystem and the sensors was damaged, then the implementation system may be able to notice the problem right away and place the detection system in a fail-safe state. Alternatively, if the wireless connection between the sensor and the implementation subsystem has malfunctioned, then the detection system may be placed in a fail-safe state. The implementation system also may eliminate the possibility of having the warning system active when a train is heading away from a railroad crossing.

Since the implementation subsystem comprises a programmable processor, the parameters at which the train detection system will check may be altered and adjusted in order for the detection system to be suitable for different applications. For example, in an urban area, parameters may be very narrow so that the system may be placed in a fail-safe state if only the slightest deviation in the information occurs. However, in a rural area where there is little traffic, the parameters may be broad so that the detection system is placed in a fail-safe state only if a major anomaly occurs.

Upon the placement of the detection system into a fail-safe state, the implementation subsystem sends a signal to the warning system to engage. Therefore, motorists and railroad personnel may be aware that a train is approaching or that there is reason for caution. Without the installation of the detection system of the present invention, when a problem occurs a railroad crossing may not be adequately protected.

Description of FIGS. 9–13

Reference will now be made in detail to the presently preferred embodiment of a crew warning aspect of the present invention, an example of which is illustrated in the accompanying drawings.

Figure 9:
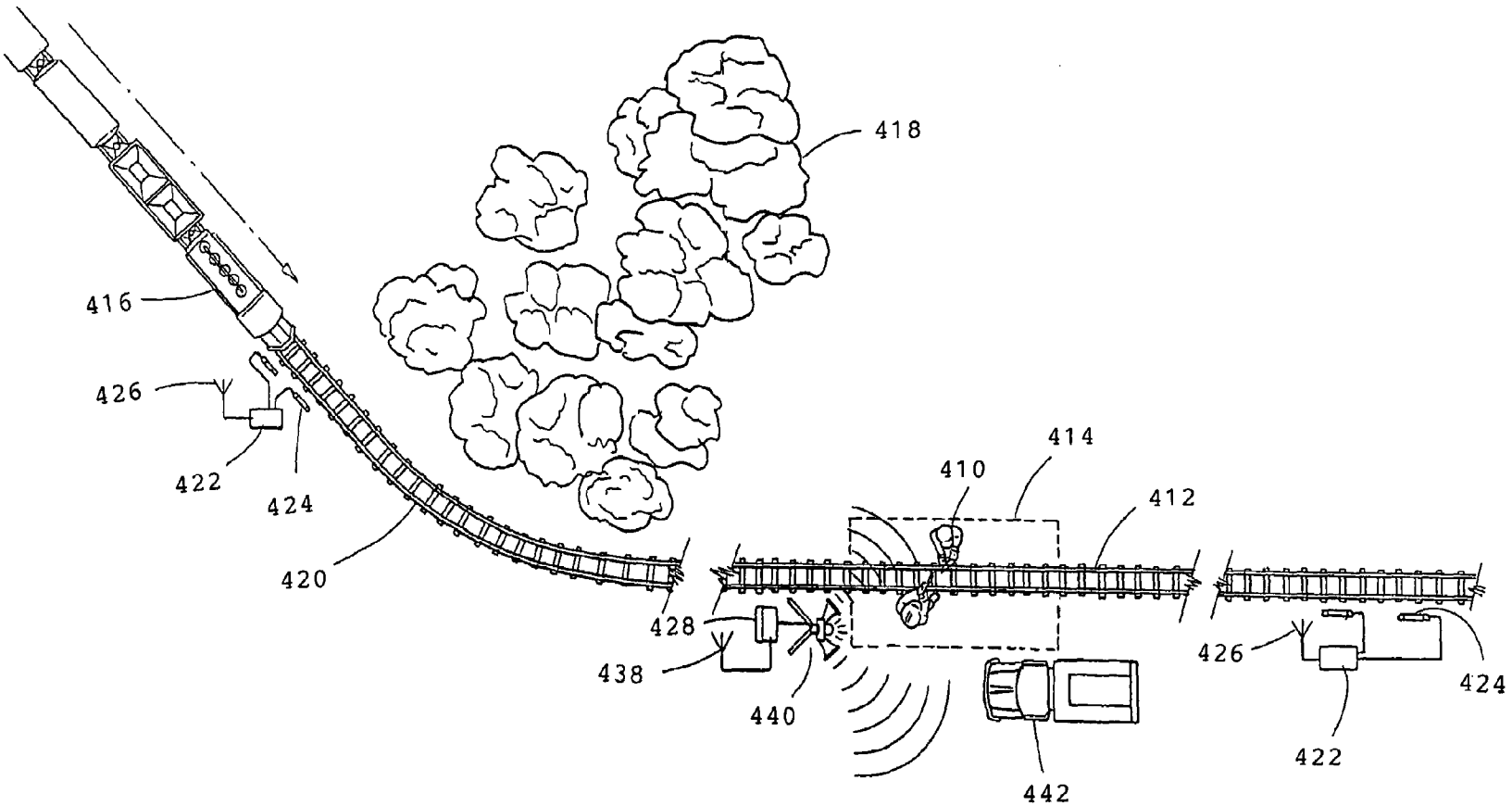
FIG. 9 is a top plan view of a typical crew warning application of the present invention.

FIG. 9 illustrates a typical application of the present invention. A maintenance-of-way crew 410 is required to work on a length of active railroad track 412 in an area defining a construction zone 414. The maintenance-way-crew 410 provides necessary upkeep and maintenance of the railroad tracks 412 which may be active, meaning that the tracks 412 are in use by trains while construction is being performed. The possibility of an oncoming train 416 poses a serious safety hazard to the crew 410 working on the track 412 who must concentrate on the construction work to be performed while constantly being alert to the possible oncoming train 416. Often the topography of the land and nearby flora and fauna prevent the workers 410 from becoming aware of the oncoming train hazard 416 to sufficiently move themselves and their equipment to a position of safety before the arrival of the train 416. Thus, the combination of the terrain, flora and fauna, such as a clustering of trees 418, and the layout of the track 412, such as bend 420, may combine to block the view and sounds of an oncoming thereby increasing the safety hazard to the maintenance-of-way crew 410. The present invention provides a system to detect an oncoming train 416 to provide adequate warning of the railroad construction crew 410 to maneuver to a position of safety in time to avoid an accident.

As can be seen from FIG. 9, a remote sensor unit 422 is placed at a predetermined distance (e.g., one or two miles) in either or both directions along tracks 412. Each sensor unit 422 includes two sensor probes 424 which are capable of detecting the presence of a train 416. The sensor probes 424 are preferably responsive to local disturbances of an electromagnetic field, such as the disturbance of the magnetic field of the earth caused by the passing of the train 416, a large metallic object.

In response to the passing train 416, the sensor probes 424 send a detection signal to the sensor unit 422 which contains the necessary processing electronics to process the detection signal of the sensor probes 424. The sensor unit 422 includes signal transmission means (e.g., a radio frequency (RF) transceiver or transmitter with an antenna 426) to transmit the train detection signal to a base receiver unit 428. The receiver unit 428 is located in the vicinity of the construction zone 414 and the workers 410, and includes signal receiving means which preferably includes an antenna 438 and a radio frequency transceiver or receiver. The receiver unit 428 includes processing electronics necessary to receive and process train detection signals received from the sensor unit 422. A crew warning device 440 is coupled to the receiver unit 428 to visually and audibly alert and warn the crew 410 that an oncoming train 416 has been detected. Upon being alerted by the crew warning device 440, the construction crew 410 may move to a safe position until the train 416 has passed, whereupon the crew 410 may resume working. The sensitivity of the sensor probes 424 may be optimally adjusted such that only the mass of a train 416 will trigger the warning system and that other vehicles such as a truck 442 will not cause false alarms which degrade the confidence of the workers 10 in the integrity of the warning system.

Figure 10:
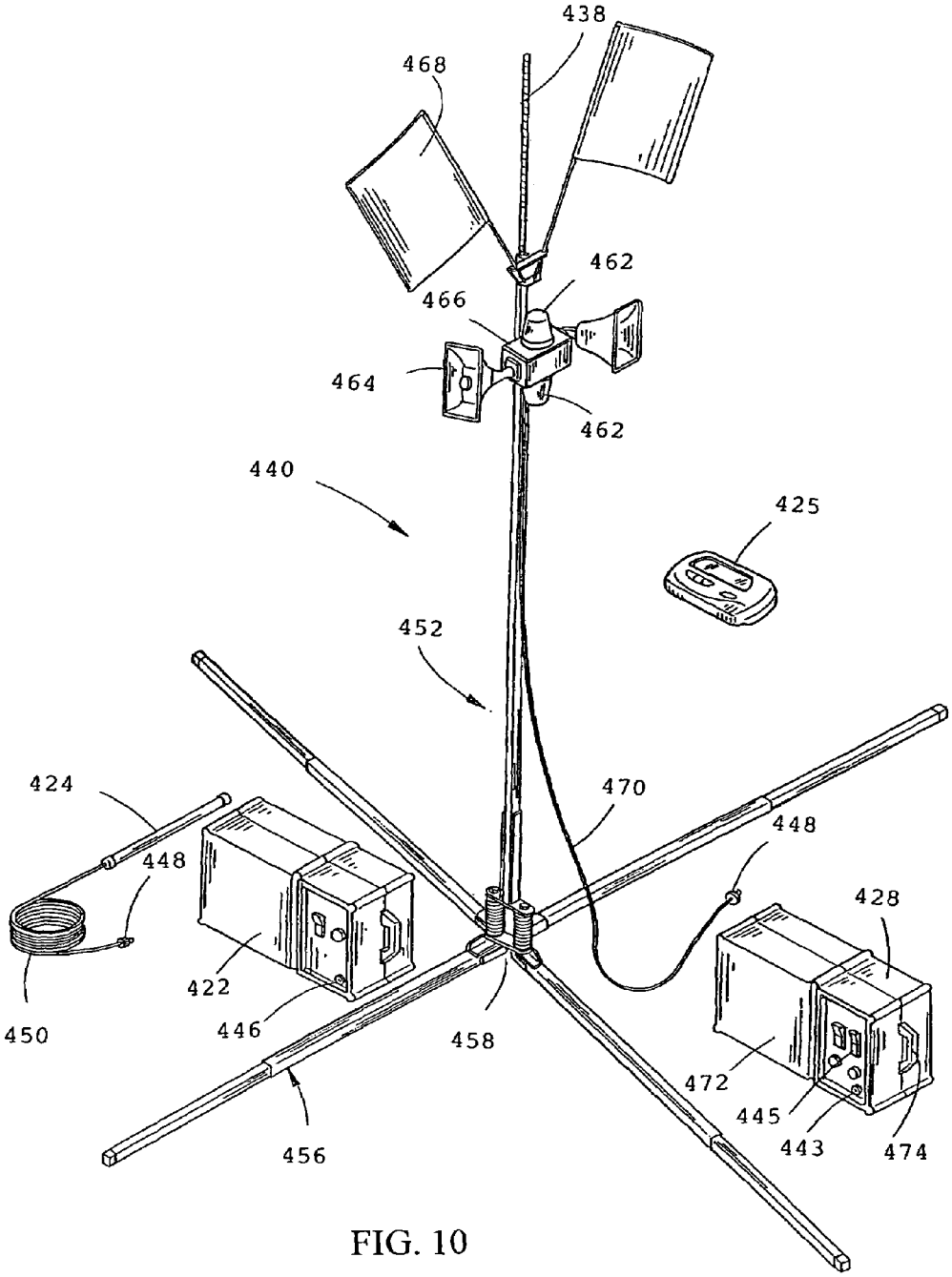
FIG. 10 is a perspective view of the basic components of a preferred embodiment of FIG. 9.

FIG. 10 illustrates the main components of the present invention. Sensor unit 422 preferably comprises a light weight and durable plastic, fiberglass or steel weatherproof housing which contains sensing, processing and control electronics. The sensor unit 422 preferably includes a power supply which provides power to the electronic sensing circuitry contained within the sensor unit 422. The power supply may be, for example, a rechargeable battery contained within the housing of the sensor unit 422. A solar panel array (not shown) may be provided to maintain a charge on the power supply. The sensor unit 422 includes receiving jacks 446 for receiving a plug 448 at the end of sensor probe 424. The sensor probe plug 448 connects to a receiving jack 446 of the sensor unit 422 via a length of probe cabling 450. The length of the probe cabling 450 is sufficiently long to allow the positioning of the sensor probe 424 near the railroad track 412 while allowing for the positioning the sensor unit 422 in an optimal position to communicate (e.g., transmit and receive signals) with the receiver unit 428. As shown in FIGS. 4 and 5, portable standards 453 having safety flags 468 (preferably of bright safety orange color) may be erected near each remote sensor unit 422A and 422B to warn the operator of the oncoming train that his train is approaching a construction zone. These standards 453 may support the antennas 426 which are coupled to the remote sensor units 422A and 422B.

Returning now to FIG. 10, the crew warning device 440 includes a portable light standard 52 which may be erected near the construction zone 14 (see FIG. 9). The light standard 452 preferably includes telescopic legs 456 which extend from and are hinged at a spring resistance hinge 458 making the light standard 452 readily collapsible and capable of being placed upon uneven terrain while remaining sturdily in place. The light standard 452 preferably includes four legs but may alternatively use three legs as well. Erected vertically from spring hinge 458 is a mounting shaft 460 upon which are mounted visual warning means 462 and audio warning means 464. The visual warning means is preferably two L.O.S. beacons mounted on the mounting shaft such that the light emitted therefrom sweeps horizontally in order to cover a maximum area which includes the construction zone 414. The beacons may be Commander Strobe Beacons, Model 5200 manufactured by Whelen Engineering Co. of Chester, Conn., the beacons using a xenon flash bulb. The audio warning means 464 preferably includes two warning siren horns capable of emitting a high decibel warning sound that can be heard over the noise of construction activity. The beacons 462 and horns 464 are mounted to a mounting unit 466 which is in turn mounted to the mounting shaft 460. Two safety flags 468 of bright safety orange color are mounted at the top end of the mounting shaft 460 to generally alert others that construction activity is occurring in the vicinity. An omindirectional antenna 438 is mounted on the shaft 452 and connected to the receiver unit 428.

The warning system may also include one or more portable warning devices 425 which may be carried by individual crew members 410 or mounted to equipment or construction vehicles such as truck 442. The portable warning device 425 allows crew members who are operating or working near machinery which produces excessive noise to be warned when on oncoming train is detected. Operation (i.e., activation and deactivation) of the portable warning device 425 is controlled by the receiver unit 428 via radio frequency (RF) communication so that the device 425 may be remotely activated to warn the crew member of the oncoming train (e.g., the portable warning device 425 may be activated when the crew warning device 440 is activated). The portable warning device 425 may include visual and audible warning means such as an Light Emitting Diode (LED) display and a small horn or speaker for alerting the crew member that a train has been detected. Alternatively, the system may automatically shut down or turn off equipment being operated by crew members when a train is detected so that the crew warning device 440 may be seen or heard.

The antenna 438, beacons 462 and horns 464 are connected to the receiver unit 428 via a receiver cable 470 which connects to a jack 443 with a plug 448 at the end of the cable 470. The receiver unit 428 is generally of the same or similar construction as the sensor unit 422 in that it is constructed of a light weight plastic, fiberglass or steel material and is weatherproof. The receiver unit 428 may be constructed having a cover assembly 472 which may be opened to replace the battery or repair the unit's internal electronics. A solar panel array may be mounted to the cover 472 of the receiver unit 428 or may be separately mounted. The receiver unit 428 also includes a control panel having basic operational controls (e.g., on-off switch, reset switch, etc.). The receiver unit may also include a handle 474 for ease of portability.

Figure 11:
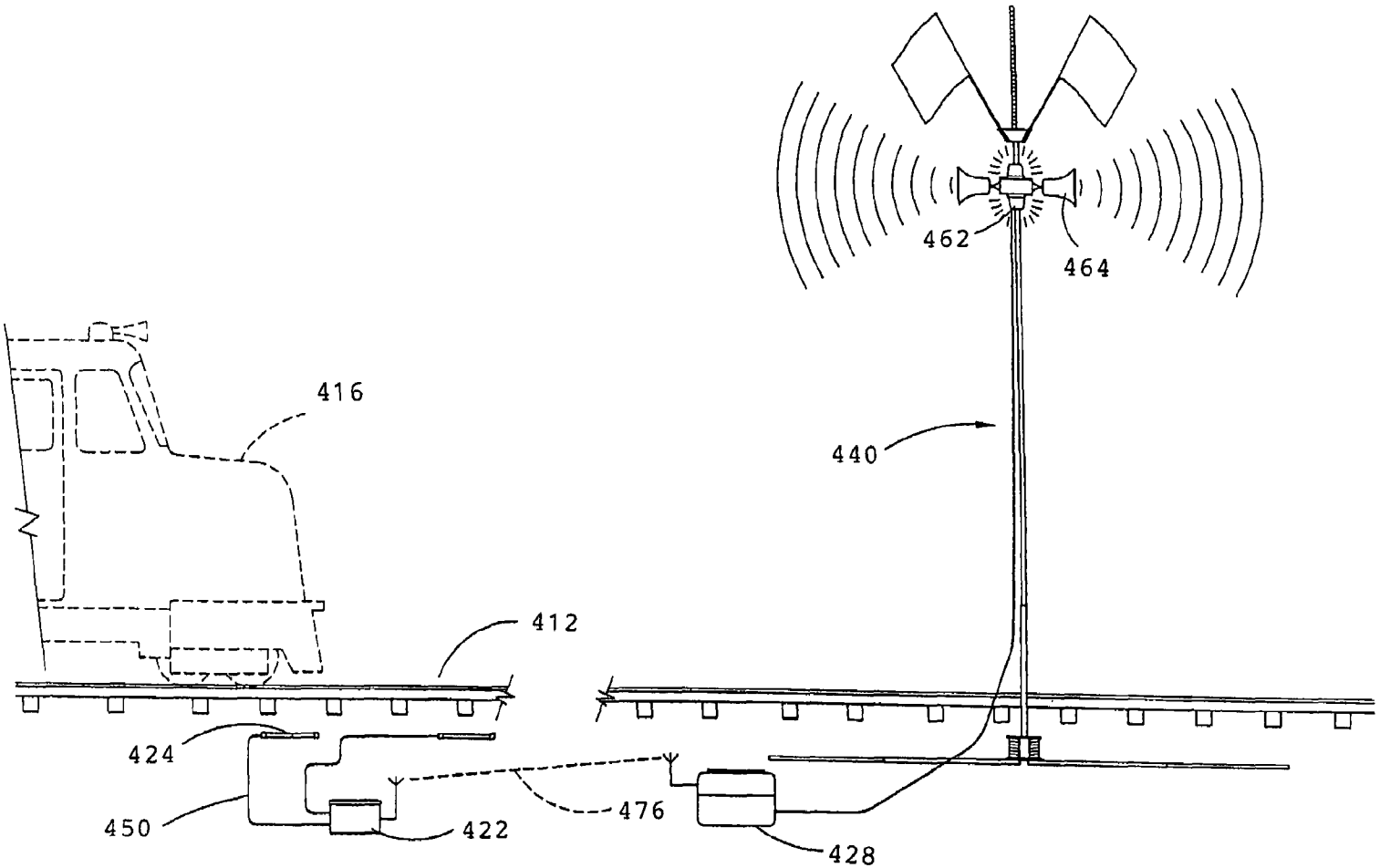
FIG. 11 is an elevation view of a preferred embodiment of the crew warning application of the present invention showing typical operation thereof.

FIG. 11 depicts the operation of the present invention in detecting the presence of an oncoming train. The receiver unit 422 is placed up the tracks 412 from the construction zone 414 at a predetermined distance therefrom. In a preferred embodiment of the present invention the receiver unit 422 is placed approximately one mile from the construction zone 414 which provides approximately one minute warning time to the crew 410 for average train speeds of sixty miles per hour.

The sensor probes 424 are placed alongside the train tracks 412 parallel thereto. Only one probe 424 is required to sense a train 416, but preferably two probes 424 are utilized for redundancy in case of failure of one of the probes. Further, the utilization of two probes provides both information as to the direction and speed of the oncoming train. In an alternative embodiment of the present invention, two sensor probes 424 may be utilized to detect the direction and speed of an oncoming train 416. Further, it has been found that the sensor probes 424 are directionally sensitive in that the probes 424 exhibit greater sensitivity at the end of the probe 424 connected to the probe cable 450. Preferably, the probes 424 are laid alongside the tracks 412 with the end of the probe 424 connected to the cabling 424 pointing toward the direction from which the oncoming train 416 will approach and the free end of the probe 424 pointing toward the construction zone 414.

A moving oncoming train 416 induces current in the sensor probe 424 upon the train passing by the probe 424. The induced signal from the train 416 is detected by the electronic circuitry of the receiver unit 422 and transmitted to the receiver unit 428 which is located at the construction zone 414. The sensor unit 422 and the receiver unit 428 are couple via a radio frequency communications link 476. The receiver unit 428 receives the transmitted detection signal from the sensor unit 422 and thereupon activates the crew warning device 440 which is placed in the vicinity of the construction zone 412. The beacon and the horns are thereby activated, visually and audibly alerting the crew 410 to the presence of the oncoming train 416.

Figure 12:
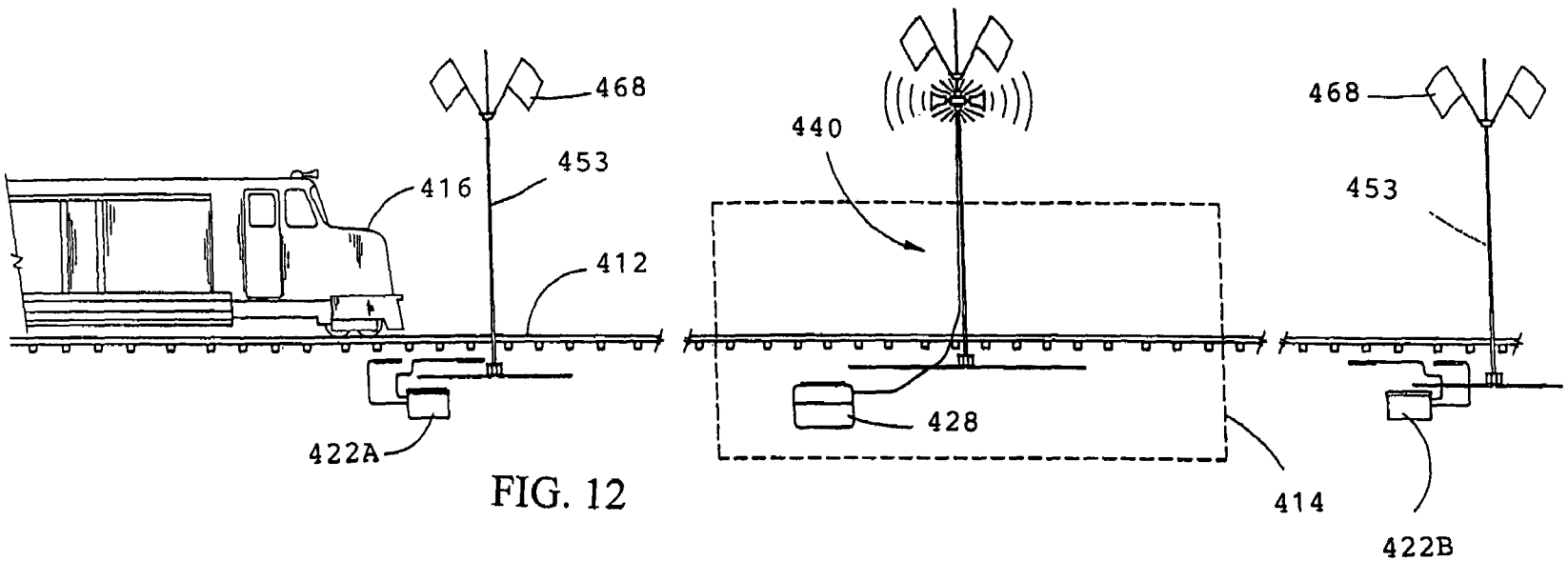
FIG. 12 is an elevation view of a preferred embodiment of the crew warning application of the present invention further showing typical activation thereof.
Figure 13:
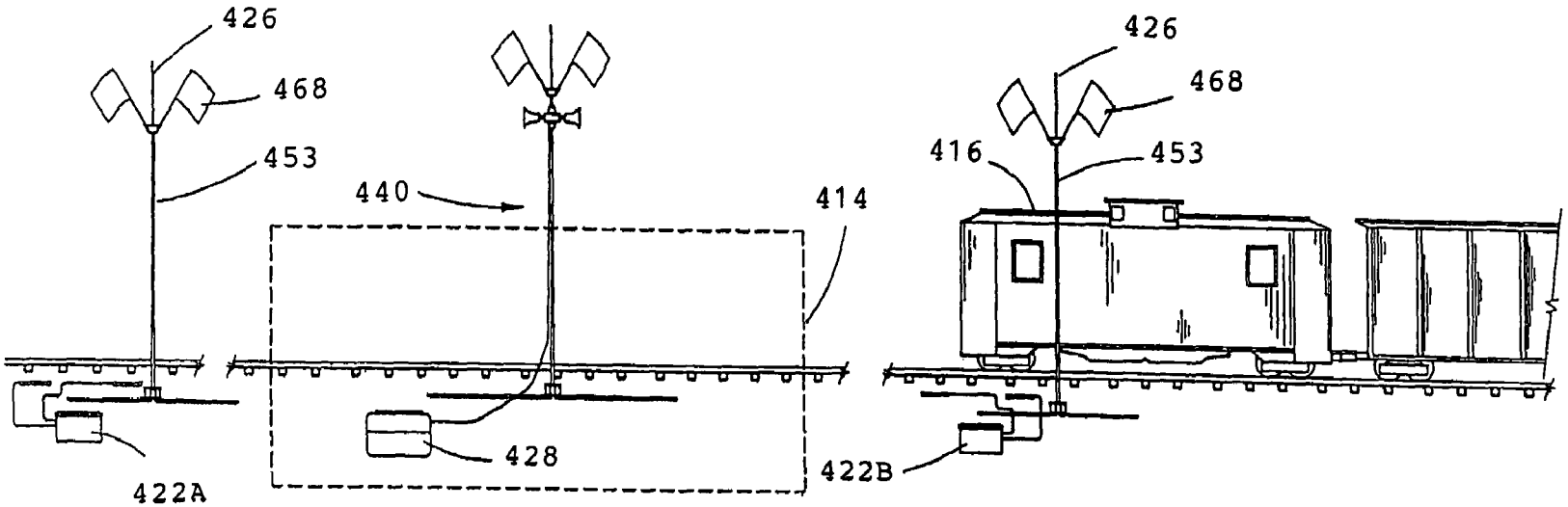
FIG. 13 is an elevation view of a preferred embodiment of the crew warning application of the present invention further showing typical deactivation thereof.

FIGS. 12 and 13 illustrate the operation of an embodiment of the present invention in which two sensor units are utilized. A first sensor unit 422A and a second sensor unit 422B each placed in either direction down the tracks 412 form the construction zone 414. As shown in FIG. 12, an incoming train 416 passing by sensor unit 422A activates the crew warning device 440 whereupon the crew 410 may take precautionary action.

As shown in FIG. 13, sensor unit 422B will be activated as the train 416 exits the construction zone 414 and passes sensor unit 422B further long down the tracks 412. When the train 416 has completely passed by sensor unit 422A, sensor unit 422A stops transmitting the train detection signal to the receiver unit. The sensor unit 422B will send a detection signal to the receiver unit 428 upon the passing of the train 416. The receiving of a detection signal from down track receiver unit 422B indicates and verifies the passing of the train whereupon the receiver unit may initiate automatic deactivation of the crew warning device 440.

The warning system is thereby automatically reset and ready to detect the next incoming train. Logic processors included with the electronic circuitry of the receiver unit are capable of processing the presence, absence, sequence and timing of the detection signals from sensor unites 422A and 422B, activating the crew warning device 440 when a train 416 is incoming and deactivating the crew warning device 440 when the train 416 has passed and then resetting the system. A manual reset switch 445 is also provided (see FIG. 9).

Figure 14:
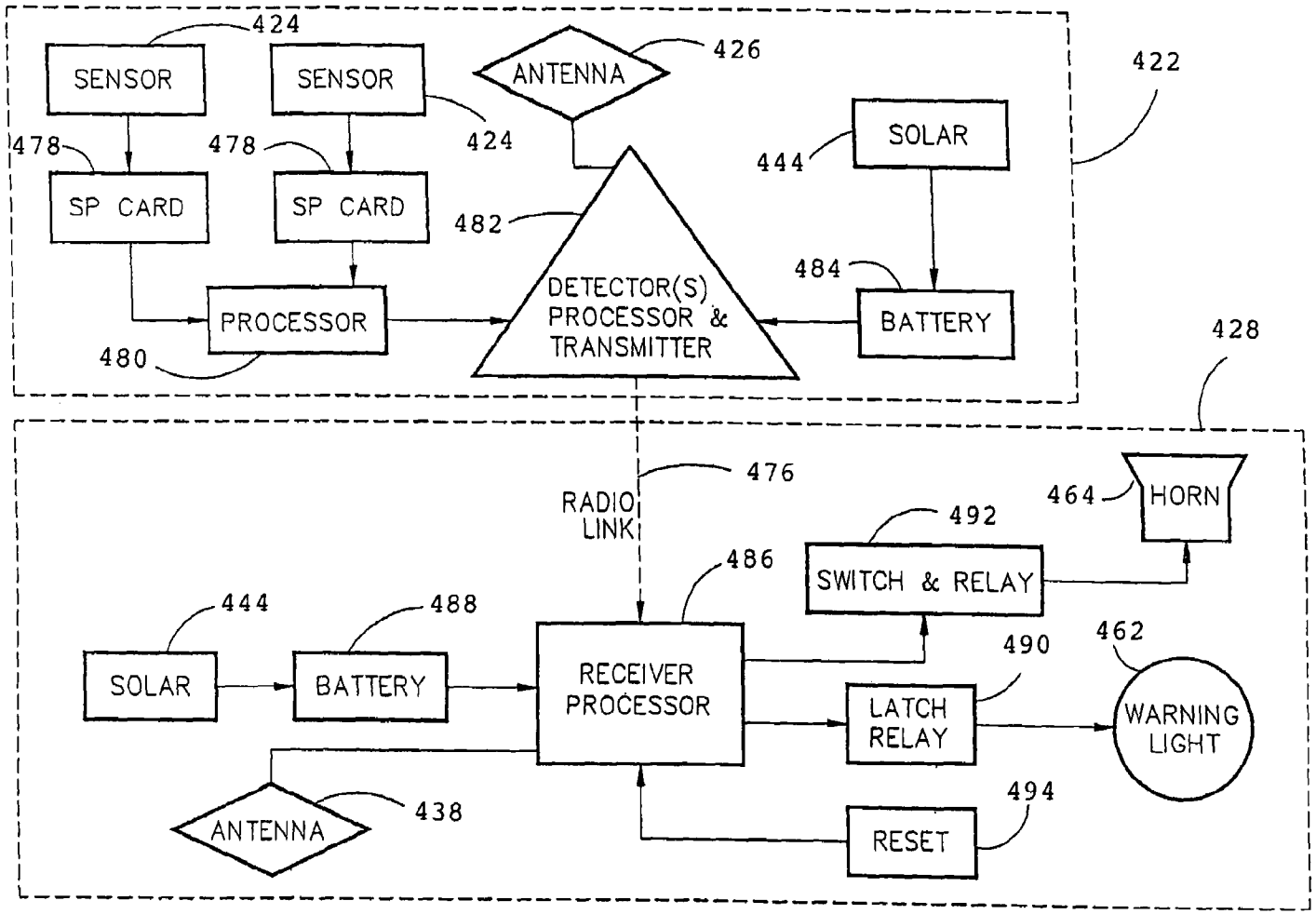
FIG. 14 is a schematic diagram of a preferred embodiment of the crew warning application of the present invention showing the operational features thereof.

FIG. 14 illustrates schematically the electronic components of the present invention. The sensor probes ("SENSOR") 424 connect to sensor unit 422 and are coupled to sensor processor cards ("SP CARD") 478. The sensor processor cards 478 interface with electronic processing means ("PROCESSOR") 480 and include electronic circuitry to act as a buffer between the sensor probes 424 and the processing means 480.

In a preferred embodiment of the present invention, the sensor probes 424 comprise an inductor coil winding having a powdered iron core or other similar paramagnetic material. The sensors probes detect variations in the magnetic field of the earth when a train passes nearby by detecting the resulting change of permeability of the space surrounding the inductor coil. A moving train passing by the sensor probe 424 alters the magnetic flux lines of the earth's magnetic field through the inductor coil of the probes 424 thereby inducing a current in the inductor coil of the sensors 424 which is detected, received and amplified by the sensor processor cards 478. Thus, sensor probes 424 provide an electrical output signal in response to local variance in the magnetic field of the earth caused by a passing train. The sensors function similarly to musical instrument pickups with the magnetic field of the earth acting as the permanent magnet and the train acting as the vibrating strings.

The sensor probes 424 are preferably Cartel CT-6 magnetometer probes available from Preferred Technology Group of Lancaster, Pa. or similar thereto. The sensor processor cards 478 include magnetometer control circuits also manufactured by Preferred Technology Group available as CT-2B circuit board subassemblies. The sensor processor cards 478 preferably include a voltage spike protector clamp across the probe input terminals 446 to protect the circuitry from environmental voltage spikes caused by lightning, for example. The sensitivity of sensor probes 424 may be adjusted with the sensor processor cards 478. The sensitivity of the sensor probes 424 is preferably optimally adjusted to detect trains without being triggered by other types of vehicles (e.g., cars, trucks, etc.).

The processor means 480 connects with a detector processor and transmitter ("DETECTOR(S) PROCESSOR & TRANSMITTER") 482 which includes communications means (e.g., a transceiver or transmitter) for communicating with the receiving unit 428 via an antenna ("ANTENNA") 426. As shown in FIGS. 4 and 5, the antenna 426 may be externally mounted to portable standard 453 so that it is elevated above the ground (and other obstructions) to improve transmission and reception of signals. The sensor unit 422 preferably receives operational power from a battery ("BATTERY") 484 (and optionally solar panel array ("SOLAR") 444). The battery 484 is preferably a rechargeable lead acid type battery designed to operate in extreme environmental conditions. Alternatively, the rechargeable battery 484 may comprise other various types of rechargeable electrochemical cells such as alkaline, nickel-cadmium, nickel-metal hydride, sealed lead-acid, zinc-air or lithium ion cells or the like, for example.

The solar panel array 444 may be utilized to provide electrical energy converted from solar energy to charge the battery 484 and to provide a trickle charge thereto to keep the battery 484 topped off. Additionally, the solar panel array 444 may be utilized to provide supplemental operational power to the sensor unit 422 in case of depletion of the battery charge or battery failure, for example. A similar battery ("BATTERY") 488 (and solar panel array ("SOLAR") 444) may provide operational power to the receiver unit 428. The battery 488 is preferably a sealed, rechargeable lead-acid type battery manufactured by GNB Industrial Battery Company of Saint Louis, Mo. as the "ABSOLYTE" product which is designed for solar service and railroad equipment applications. The battery 484 preferably includes a battery charging regulator model ASC 12/2 available from Siemens Solar Inc. of Camarillo, Calif. The solar panel 44 is a model M75 available also available from Siemens.

Upon the detection of an oncoming train 416, the transmitter 482 transmits a signal via a radio frequency communications link ("RADIO LINK") 476 to a receiver ("RECEIVER PROCESSOR") 486 contained within the receiver unit 428. Antennas ("ANTENNA") 426 and 482 are provided for the transmitter processor 482 and the receiver processor 486 respectively to increase the signal gain of the radio communications link 476. The radio communications link 76 preferably utilizes a band of 8 spread spectrum channels at a frequency licensed by the Federal Communications Commission for such type of radio frequency communications. The radio frequency communications between the sensor unit 422 and the receiver unit 428 is preferably dual-tone multiple frequency (DTMF) encoded, spread spectrum modulated transmission to avoid unintended jamming or interference from other radio frequency sources operating in the vicinity thereby preventing loss of communication or false alarms. The processors (480, 482, 486) of the present invention are preferably implemented in RTC31/52 computer board assemblies as manufactured by Micromint Inc. of Vernon, Conn.

In the event that a train encroaches the vicinity of the sensor unit 422, the sensor probes 424 detect the presence of the train and send a detection signal received by the sensor probe cards 478 of the receiver unit 422. The sensor probe cards 478 send a signal to the processor 480 in response to the detection signal received from the sensor probes 424. The processor 480 activates the detector transmitter 482 to commence transmission of a coded warning signal to the receiver 486 of the receiver unit 428. The receiver 486 receives and decodes the transmitted warning signal whereupon a latch relay ("LATCH RELAY") 490 is triggered to activate visual warning means ("WARNING LIGHT") 462. Further, a switch and relay ("SWITCH & RELAY") 492 is triggered thereby activating audible warning means ("HORN") 464. The visual and audible warning means (462, 464) alert the workers of the approaching train so that they may take the necessary evasive actions to stop work and to move themselves and any equipment to safety.

After the train 416 has passed, a manual reset switch ("RESET") 494 may be engaged by the workers to reset the latch relay 490 and the switch and relay 492, thereby turning off the visual and audible warning means (462, 464) warning and resetting the warning system for the next train detection event. Alternatively, the warning system may be programmed to automatically rest upon passing of the train as it is sensed passing a second sensor unit 422.

An important feature of the present invention is a handshaking communications protocol between the sensor unit 422 and the receiver unit 428. The base or receiver unit 428 preferably transmits a test signal at periodic intervals (e.g., every 5 seconds, every 60 seconds, every 150 seconds, etc.) to the remote sensor unit 422. The remote sensor unit 422 receives this signal and responds by transmitting a return signal (e.g., and "All Clear" or "I'm OK" signal) indicating that the remote sensor unit 422 is functioning properly. The successful transmission and reception of these signals by the receiver unit 428 and sensor unit 422 verifies the proper functioning of the crew warning system. If the all clear call signal is not received after a predetermined number of attempts (e.g., the receiver unit 428 transmits a number of, for example three, test signals and receives no response from the sensor unit 422), the receiver unit 428 immediately enters into an alarm mode. In the alarm mode, a system fail warning light located on the control panel of the receiver unit 428 or other alarm may be activated to alert the workers that protection is no longer provided by the warning system. According to a preferred embodiment, the siren horn 464 may be capable of emitting two or more warning signals (i.e., a constant tone indicating failure of the system and a cyclical or "whelping" tone when a train is detected). This allows the crew members to readily distinguish between a failure of the system and the approach of a train. Failure of the sensor unit 422 to transmit the all clear signal may be caused by battery failure, component failure, unforeseen damage to the sensor unit 422, movement of a sensor unit 422 out of transmission range, or loss of integrity of the radio frequency communication link 476, for example.

In an alternative embodiment of the present invention, multiple sensor units 422 may be utilized in areas having multiple railroad tracks. Each sensor unit 422 is preferably capable of operating in conjunction with up to four sensor probes 422 simultaneously. Further, the receiver unit 428 is preferably designed to receive and process up to eight different transmission codes from eight individual sensor units 422 simultaneously. Utilization of multiple probes 424 and sensor units 422 is of particular utility in areas having several railroad track such as wyes, spurs, or switchyards, for example.

In an exemplary embodiment, the system may be used to alert two or more maintenance-of-way railroad crews working in a construction zone on adjacent sections of active railroad track to the presence of an oncoming train. Crew warning devices 440 (see FIG. 10) may be positioned near each maintenance-of-way crew for alerting the crew to the presence of an oncoming train on their respective section of track. Sensor probes 424 may be positioned adjacent to each section of active railroad track at a predetermined distance from the construction zone for detecting an oncoming train as it approaches the construction zone on one of the sections of track. A sensor unit 422 coupled to the sensor probe 424 receives the train detection signal and transmits a train indication signal which identifies the section of track on which the train is traveling. The radio frequency communications between the sensor unit 422 and the receiver unit 428 is preferably dual-tone multiple frequency (DTMF) encoded, spread spectrum modulated transmission allowing the senor unit 422 to transmit sufficient information to identify itself to the receiver unit 428. Thus, when the receiver unit 428 receives the train indication signal, it may activate the appropriate crew warning device 440 for the work crew working near the section of track on which the oncoming train is detected. In this manner, a first work crew may be warned of an approaching train so that they may take appropriate action while other crews working in the same area who are not in danger may continue working uninterrupted.

Additional embodiments of the present invention contemplate implementation of an event recorder for monitoring and recording train activity. The recorded event data may be utilized in analysis of accidents or close calls to determine event causation and to learn how the system may be improved if necessary. The event recorder may be implemented by additional programming of the microprocessors (480, 482, 486) of the present invention in conjunction with non-volatile electronic memory (e.g., NVRAM, EEPROM, FLASH RAM) or battery refreshed electronic memory (e.g., SRAM, DRAM) or other means for saving the event data (e.g., magnetic tape). The electronic memory is preferably a 64 kilobyte static random access memory chip (SRAM) backed by a lithium type battery. Other types of data may also be monitored and recorded such as battery charge condition, train speed, train length, direction of approach, etc.

Figure 15:
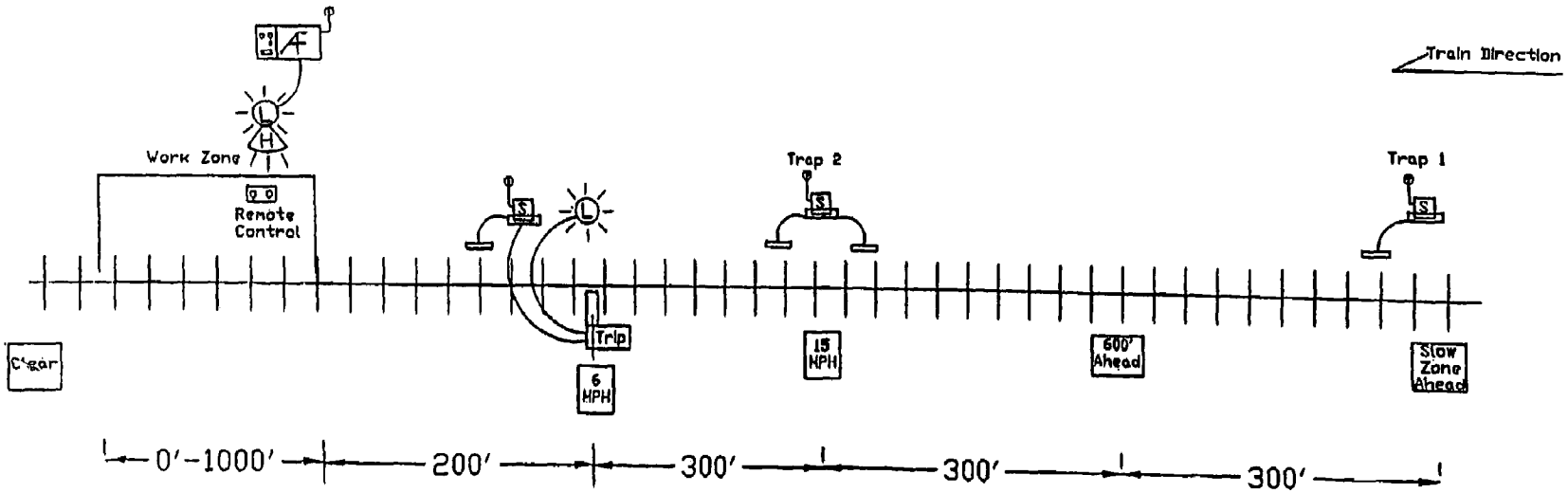
FIG. 15 is an illustration of a maintenance area employing an exemplary embodiment of the present invention.
Figure 16:
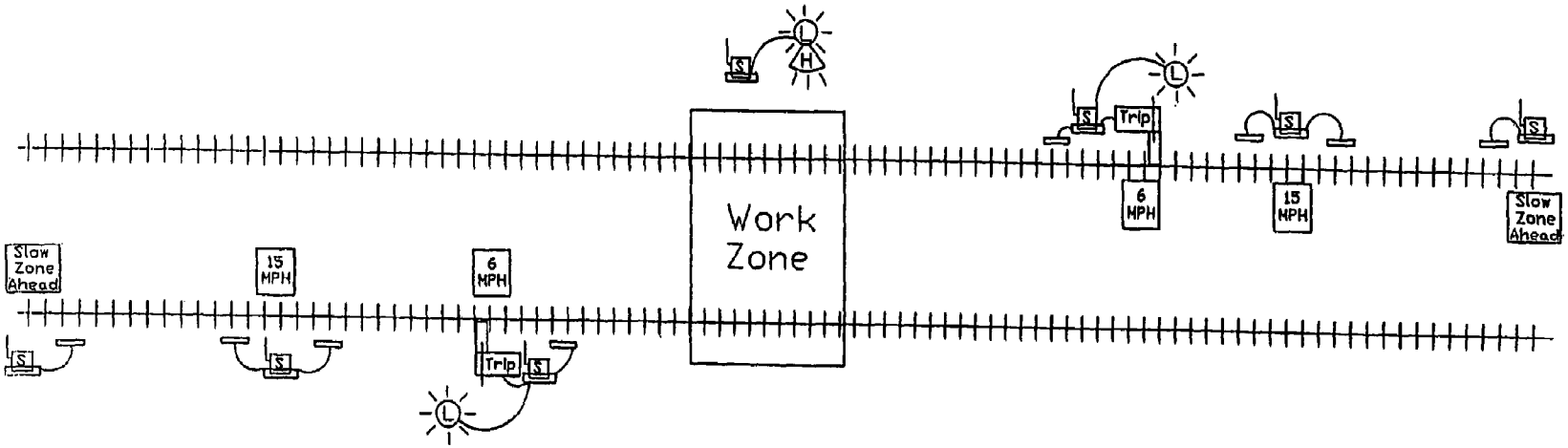
FIG. 16 is an illustration of a maintenance area employing an exemplary embodiment of the present invention encompassing a two track area.
Figure 17:
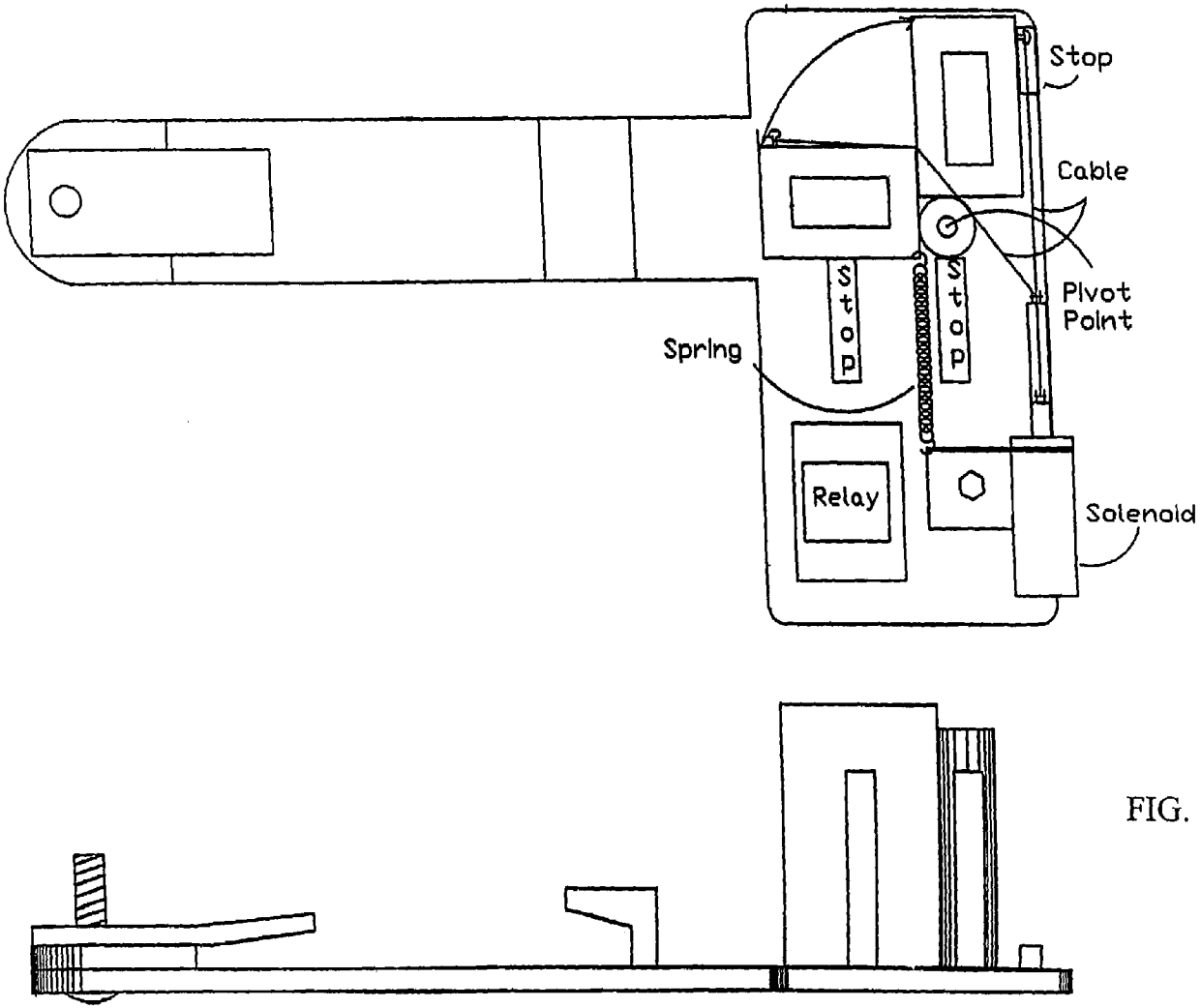
FIG. 17 is an illustration of a trip mechanism of the present invention.

Description of FIGS. 15–17

Reference will now be made in detail to the presently preferred embodiment of a transit maintenance protection system aspect of the present invention, an example of which is illustrated in the accompanying FIGS. 15–17.

In one embodiment of the invention, the transit maintenance protection system of the present invention includes an apparatus and method for providing a railroad maintenance site with automatic redundant protection for detection, and where applicable intervention, in the event of an on-coming train.

The transit maintenance protection system may be designed as fail-safe, thus redundant self-tests are performed during usage. Fail safe reliability is achieved by leaving the transit maintenance protection system in the "STOP" position until it is manually opened to allow a train to pass. Therefore an approaching train would be warned to stop until maintenance personnel disarm the transit maintenance protection system. After the train has passed, the transit maintenance protection system is then automatically re-armed and checked. If for some reason the transit maintenance protection system does not reset, at least one suitable alarm will initiate notifying the workers that there is a problem with the system. Suitable alarms include a horn, a light, a strobe light, an intervention device, a warning sign, a signal device, a red and amber light standard, suitable for informing the motorman and the like. An intervention device may be an automatic break in a train, a train throttle control and the like. It is to be understood that, various alarm devices and alarm locations may be utilized, as contemplated by one of ordinary skill in the art, without departing from the spirit and scope of the present invention.

The transit maintenance protection system is comprised of a base unit and at least one remote unit for a double track setup. The base unit is communicatively coupled to the at least one remote unit via at least one of a electrical connection, a wireless connection, an optical connection, an infrared connection, and the like. In a presently preferred embodiment, each track direction will be treated independently. The tracks are not bi-directional and for the purpose of this explanation, only one side or direction will be discussed.

For example a transit maintenance protection system waiting for an approaching train will perform self-test sufficient for establishing remote unit communication under the system's environmental conditions. For example the base unit may communicated with a remote unit 3 times every second. The tests will be invoked from the base unit at the work site. Then the remote units may be polled in sequence at the predetermined interval and if for any reason the remote units do not respond properly, the main unit sounds an alarm to tell the maintenance workers present that protection has been compromised.

For example, a typical scenario may be, a transit maintenance protection system is waiting for an oncoming train and interrogating the remote unit for its status. As a train approaches a work area, at least one remote sensor is located at a sufficient distance from the maintenance site to allow for adequate warning of the on-coming train. In the present example this occurs at about 1000–1200 feet from the work zone. When the train reaches remote unit one's location it will cross the sensor of Remote 1. Remote 1 then communicates this data to the transit maintenance protection system base unit. Normally the transit maintenance protection system base unit would signal at least one alarm. The at least one alarm may be disposed at various positions within the system as contemplated by one of ordinary skill in the art without departing from the spirit and scope of the present invention. For example an alarm may comprise a mechanical warning device, such as a pager with vibrating capability.

In a further embodiment, remote unit 1 comprises at least two sensors disposed at a distance apart sufficient to establish, a speed trap, to determine and communicate a train's speed to the base unit.

At a second distance, a second remote unit may be located to further detect the presence of the train. In the present embodiment remote unit two is additionally capable of detecting and communicating a train's speed to a base unit. Additionally, a "15 mph" sign is positioned at a distance sufficient to warn a train's personnel of a work site, the train will cross sensor 1 of remote 2, then a second sensor of remote unit two is disposed at a distance sufficient to determine a train's speed, for example 1 foot apart. Sensors one and two of remote unit two thus comprise a speed trap suitable for detecting the train personnel compliance with a work area's speed limit, in the present example 15 miles per hour or less. The speed is calculated and then communicated to the base unit. The train should then come to a stop a few feet before it gets to the trip. If the train is determined to exceed the work area speed limit, the base unit will trigger at least one alarm, such as, sound multiple rapid blasts on a horn to warn the workers to immediately get to safety.

Upon a determination by a transit maintenance protection system user the system may be reset to adjust at least one alarm through manipulating an interface disposed on at least one of a portable remote control unit, a base unit and the like. A portable control unit may comprise a wireless remote control communication device suitable for carrying by a maintenance personnel. The portable control unit contains an interface, such as a switch, suitable for controlling at least one alarm. Manipulating the interface on the portable remote control unit will communicate a signal to the base unit suitable for relay to at least one remote unit to alter at least one alarm. For example, at least one remote unit may contain an alarm comprising a standard, upon communication of the signal from the base unit the standard would change from a red light to a amber light. Once the train has passed the trip may be closed and is now ready for another event: During this entire operation, the base unit is constantly monitoring the condition of the system.

If a train should happen to pass at least one remote unit comprising a trip in the closed position, a sensor placed close to the trip will sense the train has passed the trip in the closed position and send an alert to the base unit. The base will then trigger at least one alarm, such as, a flashing strobe and sound the horn in rapid blasts informing workers present of the emergency situation.

The transit maintenance protection system has redundant detection systems incorporated in the system to make sure that maintenance personnel are warned through a variety of alarm indicators to the presence of an approaching train.

The communication rate between a base unit and a remote unit will be sufficient to provide for the base unit to rapidly detect the possible remote sensor failure, typically the base will communicate at least once a minute with each at least one remote unit. If for some reason one of at least one remote unit does not respond to a call from the base unit the base will attempt to communicate with the silent unit at least one more time prior to alerting maintenance personnel through at least one alarm indication method. For example, if there is no response after three attempts, the system will go into full alarm with strobe flashing and horns blaring. The base unit will also be capable of detecting which remote unit is not properly responding to make troubleshooting easier.

Additional aspects of an embodiment of a transit maintenance protection system may include the following conditions:

If the sensor on remote 1 has problems with detection, as the train crosses sensor 1 of remote 2 the system will discover that no train was detected at remote 1. This will indicate the problem lies in remote 1 and will set off a full alarm at the base.

If only 1 sensor at remote 2 detects a train, regardless of which sensor it is, the system will assume that remote 2 has a problem somewhere and set off the full alar.

The trip will have a device such as a micro switch as interlock so the workers will be assured that the trip is indeed locked in the default closed position once again.

A cable monitoring system will be employed so that if a sensor cable is cut or otherwise disconnected for its source, an alarm will sound at the base.

The transit maintenance system is designed to be extremely rugged and weather proof. In a present example the base unit and remote units are enclosed in an impact resistant fiberglass enclosure and has permanent gaskets on all the mating surfaces. The front cover is a durable plastic, such as a polycarbonate.

It is further contemplated that the transit maintenance protection system shall perform three (3) distinct functions:

a. Alerting personnel that a train is approaching.
b. Insuring that the train approaches and passes through the protected area at the proper speed.
c. Stopping unauthorized trains from entering the protected area with portable track trips.

The system design and construction shall be such as to detect train presence with 100% reliability unless a fault or failure is present. The presence of a fault or failure shall be detected, logged and annunciated.

The system design and construction shall insure that false alarms of system failures or faults due to communications link loss, ghost train detection, loose electrical connections or any other reason shall not occur more than two (2) times in eight (8) hours of continuous in track operation.

Each system shall be able to control and monitor two (2) sets of wayside equipment to accommodate trains traveling in opposite directions on the same or adjacent tracks past a single location.

The system shall provide reliable operation under all climatic and environmental conditions found on rail systems. The conditions include, but are not limited to, ambient air temperature from −10° F. to +100° F. with added solar load during high temperature operation, relative humidity up to 100% with condensation; blowing rain and dry snow; peak vibration levels up to 80 g; electromagnetic fields generated by 600 volt DC traction power flowing in the adjacent third and one or both running rails at current levels up to 5600 amps and EMI generated by arcing of the 3$^{rd}$ rail shoes on 8 cars simultaneously while drawing up to 700 amps per car.

The system shall utilize radio communications between the several pieces of remote equipment and the master/base unit in lieu of cables. Each system shall be coded to preclude cross operation of adjacent systems and to allow proper logging of data from each set of equipment when two systems are operated from one hand held unit.

Under no circumstances shall it be possible for both portable track trips of a system operated from a single hand held unit to be down simultaneously.

The radio communications used shall not interfere with, or be interfered by, a radio system that operates in the 450–510 MHz band. Personnel carry multi-channel portable radios that have a power output of 4 watts.

The radio links shall have a range of at least 1200 feet outdoors and in subway.

The system shall be battery operated.

The batteries shall be rechargeable and of the best type for the duty cycle specified below:

a. Minimum eight (8) hours of continuous operation at −10° F. with train detection and audible and visual alerts and track trip operation every four (4) minutes for six (6) of the eight (8) hours and every 15 minutes for two (2) of the eight (8) hours.

b. Discharge to the point of system stoppage once per week.

c. Storage, charged or discharged, for periods of up to two (2) months three (3) times per year.

Batteries shall require only a recharge if stored discharged to restore them to full life and should not require a recharge if stored charged for periods of up to two (2) months.

Battery recharge time should be as short as possible consistent with maximizing battery life, but should be no longer than four (4) hours from a fully discharged condition.

Battery chargers shall operate from 110 volts AC.

Batteries shall be built into each piece of equipment.

Replaceable battery assembles may be provided that can be changed while the equipment is in service. Battery condition shall be monitored and an alarm given when the remaining life is less than 15 minutes. Unit and system function shall be completely restored as soon as the new battery is installed without the need to turn the unit off and on, but may require the alarm to be reset.

Layout on Track—The layout on the track will be the same for this system as for any "Slow Zone" on a rail system. The equipment for this system shall consist of the following elements.

At the start of the work zone or up to 400 feet into the work zone:

a. Warning horn with strobe light.

b. Hand held communication unit to operate the track trip and signal.

c. Master/base unit.

Two hundred (200) feet from the start of the work zone:

a. A two aspect signal, red and white.

b. Motorized (automated) portable track trip device.

c. Train detector.

Five hundred (500) feet from the start of the work zone:

a. Train speed detector.

Eight hundred (800) feet from the start of the work zone:

a. Train presence detector.

Approaching train is detected 800 feet from the start of the work zone; and horn and strobe light at the work zone are activated for three (3) seconds with a steady horn tone; and event is logged and date and time stamped into the master/base unit.

Train speed is measured 500 feet from the work zone.

a. If speed is equal to or less than 15 mph, no action is taken.

b. If speed is 16 mph or greater, the strobe light at the work zone is activated and the horn sounds intermittently (pulsating) for five (5) seconds. The overspeed is logged and date and time stamped into the master/base unit.

If the train has stopped before the signal and track trip, the hand held communication unit is used to release the track trip and change the signal aspect from red to white.

If the train does not stop and hits the track trip, the strobe light at the work zone is activated and the horn sounds intermittently until reset from the hand held communication unit or master/base unit.

If the train has stopped and proceeded past the track trip and signal, the hand held unit is used to reset the track trip and restore the signal aspect to red.

The wayside units shall be as light weight as possible while being rugged and able to withstand the vibrations along the track as well as being dropped from a height of three (3) feet onto concrete.

The units shall be easy to set up and as small as possible to fit in the restricted space available along a transit system right-of-way.

Unit cases and mounting supports of tripods (if used) shall preferably be heavy-duty polyester reinforced fiberglass in lieu of metal. If metal is required, it shall be covered with an electrical insulating material.

The units shall be colored bright yellow, except the wayside signal box that shall be colored black.

The units shall be fully gasketed around all covers and sealed around all inlets or other holes to make the entire assembly watertight.

Rail mounted sensors shall be designed and constructed to accommodate any rail size found on a rail system.

All external hardware shall be stainless steel.

The two aspect wayside signal shall have a red light and a white light above it.

There shall be independent indicator lights of the same colors mounted on the back of the box.

The signal box shall be rugged heavy-duty fiberglass reinforced polyester colored black. The cover and lights shall be equipped with gaskets to make them watertight. Cable inlets or other holes in the box shall be completely sealed to make the entire assembly watertight. The cover may be hinged or bolted in place. If possible, a standard sized box shall be used. The box shall be equipped with two, 1" wide stainless steel clips spaced at least 6" apart to accept the tab on the support tube.

The two forward facing lights shall be nominally 4" in diameter and the rear lights shall be nominally 2" in diameter.

Both the forward facing lights and the rear indicator lights shall be LED arrays.

The signal light shall be of sufficient brightness to be clearly visible when viewed at a distance of 800 feet from a height of 10 feet above top of rail in clear air in bright sunlight.

The signal box shall be supported on a stand that clamps to the base of the running rail. The clamping parts shall be stainless steel, but the remainder of the stand shall be heavy-duty polyester reinforced fiber-glass plates and tubing. The bottom horizontal plate shall be nominally 6" wide and 314" thick and nominally 26" long. The clamping parts shall consist of fixed inside hooks to clip to the base of the running rail and an outside lock plate with threaded fastener to hold the assembly to the running rail. There shall be a square stainless steel receptacle at the outer end of the horizontal plate to accept a nominal 2" square fiberglass tube. The receptacle shall be set at an angle to the base plate so that the tube angles away from the running rail. The tube shall be equipped with a stainless steel tab at the top to hold the signal box. The tab shall be nominally 2" wide and ¼"" thick with a 1" radius top and shall be securely bolted to the fiberglass tube with stainless stool fasteners. It shall fit into the clips on the signal box. When installed on the stand, the signal box inside top corner shall be 30" above the top of the tie and 5'–7" from the centerline of the track.

The signal box stand shall have appropriate mounting provisions to permit its installation on all types of track structure found on rail systems, including, but not limited to, ballast and wood tie, wood ties on steel elevated structure, direct fixation of rail to concrete deck or steel structure, and concrete subway tube with wood stub ties imbedded in concrete.

All Hardware shall be stainless steel.

The portable track trip unit shall be mounted on the left hand running rail in the direction of travel and shall be designed and constructed to fit between the running rail, timber guard and the third rail with sufficient clearance to prevent electrical bridging between the third rail and the unit. The unit may require electrical insulation on the faces closest to the third rail.

The unit shall provide a retractable trip arm to engage the switch arm on the rail cars when in the normal, at rest position.

The trip arm shall fold, retract, or rotate to clear the switch arm on the rail cars when commanded by the hand held communication unit. The trip arm shall remain in the clear position until released by another command from the hand held communication unit. The trip arm shall automatically return to the tripping, at rest position, if battery power is lost.

The portable track trip unit itself and the trip arm shall be designed and constructed to mount on and accommodate all heights and sizes of running rail found on rail systems.

The trip arm shall, if possible, have some portion of the arm or an extension resting on the top surface of the running rail to set its height and provide visual indication if a train runs over the trip. The trip arm shall be easy to replace if it is designed to be run over by the train. If it is not possible to have the arm or an extension touching the top of the running rail, the means to set the height must provide a positive lock to insure the trip arm is kept at the correct height above the rail while being adjustable to accommodate different height rail.

If no portion of the trip arm rests on the top surface of the running rail, a non-metallic gauge shall be provided with each unit to determine the correct height of the arm above the rail.

The trip arm and the portable track trip unit mounting shall be strong and rugged to withstand the impact of the switch arm on the rail cars at 15 mph without breaking the arm or loosening the unit on the rail or damaging the internal parts of the assembly. The switch arm requires 25 to 30 pounds of force exerted at the tip to move it from the at rest position after which the restoring force remains about 30 pounds.

The portion of the trip arm that is contacted by the rail car switch arm shall be located with its top 3-½" above the top of the running rail in the tapping position. The arm itself shall be 4-½" long with the inside end 5-⅜" from the gauge edge of the running rail. The portion of the arm that can be contacted by the switch arm on the rail car shall be a rod 1" in diameter. The arm shall be painted bright red.

When in the release position the trip arm must clear the switch arm on the rail car by lowering below the head of the running rail or by rotating. The switch arm is located with its bottom 2-¾"±¼" above the top of the running rail and with its inside edge nominally 6-11/16" from the gauge edge of the running rail. The arm itself is ¾" wide at the bottom and bulges to be 1-½" wide 1-½" wide above the bottom. It then returns to be ¾" wide for the remainder of its height.

All hardware used in the assembly of the portable track trip unit shall be stainless steel.

The portable track trip unit shall communicate to the hand held communication unit the status of the trip arm and shall communicate to the master/base unit.

The hand held communication unit shall be lightweight and easily carried by hand or by appropriate straps, snap clips, or harness.

The unit shall receive communications from the track trip unit to indicate that the trip arm is released and shall give a visual, vibratory and audible indication, The audible signal shall be an intermittent beep at a rate of once per two (2) seconds, the vibratory signal shall be intermittent, on for ½" second every 2 seconds and the visual signal shall be a steady white LED. The signals shall remain on until the trip arm has been restored to the normal position.

The unit shall transmit signals to the portable track trip unit to:

1) Cause the trip arm to retract

2) Extinguish the red signal and light the white signal

3) Cause the trip to return to normal (tripping position), extinguish the white signal and light the red signal.

The master/base unit shall be the central communication and shall monitor the data storage unit. It shall monitor the operation and status of each remote unit including the hand held communication unit and the track trip unit by interrogating each unit at least twice per second.

The master/base unit shall be of rugged heavy-duty construction suitable for application anywhere on a rail system. If it is independently supported, the supports shall be similar to those for the Wayside Remote Units. If it is part of the Strobe Light and Horn unit, it shall be easily removed from the rest of the assembly.

The master/base unit shall include a rugged alphanumeric display that will provide information on the system operation and any failures that occur. The display shall be clearly visible in direct sun light or in total darkness. In addition, the unit shall contain non-volatile memory that shall store the logged failure data with date and time stamp. This memory, as well as the basic operating parameters, shall be accessible through a data port on the unit. The data port shall be sealed to be weather tight with a cover or other suitable means.

The strobe light and electronic horn shall be a separate unit that can be placed adjacent to the workers. It may contain the Master/Base Unit.

The horn shall generate a distinctive sound at a level of at least 90 dBA—measured 50 feet from the sound generator.

The strobe light shall pulse at a rate of one pulse per second when activated. The strobe light shall be yellow in color.

All hardware used in the assembly of the strobe light and horn unit shall be stainless steel.

Each unit shall perform self-tests on a periodic basis and provide the results to the master/base unit when interrogated. The self-test shall include any interconnecting cables as well as the sensors/detectors and battery.

An error message or lack of response after three (3) interrogations shall result in the strobe light and intermittent horn being activated for five (5) seconds at the work zone as well as the audible, vibratory and visual signals being activated on the hand held unit. In addition, the failure(s) shall be logged and date and time stamped in the master/base unit and the display shall indicate the nature of the failure.

Logic shall be incorporated in the remote units and master/base unit to detect faults and failures of the sensors/detectors that may not appear during the interrogating sequence of each unit.

If the speed detecting portion of the system fails to register speed after a train has been detected, or if speed is registered but no train has been detected at the first sensor, the strobe light and intermittent horn shall be activated for five (5) seconds and the audible, vibratory and visual signals on the hand held unit shall be activated. In addition, the failures shall be logged and date and time stamped in the master/base unit and the display shall indicate which unit has failed and the nature of the failure.

All external wire and cable shall be suitable for outdoor applications and be ozone, oil and UV resistant.

Cables shall be extra heavy duty to prevent damage from dragging over ballast or snagging on protruding objects or being walked on.

Description of FIGS. 18–21

Reference will now be made in detail to the presently preferred embodiment of a positive train positioning system aspect of the present invention, an example of which is illustrated in the accompanying FIGS. 18–21.

Figure 18:
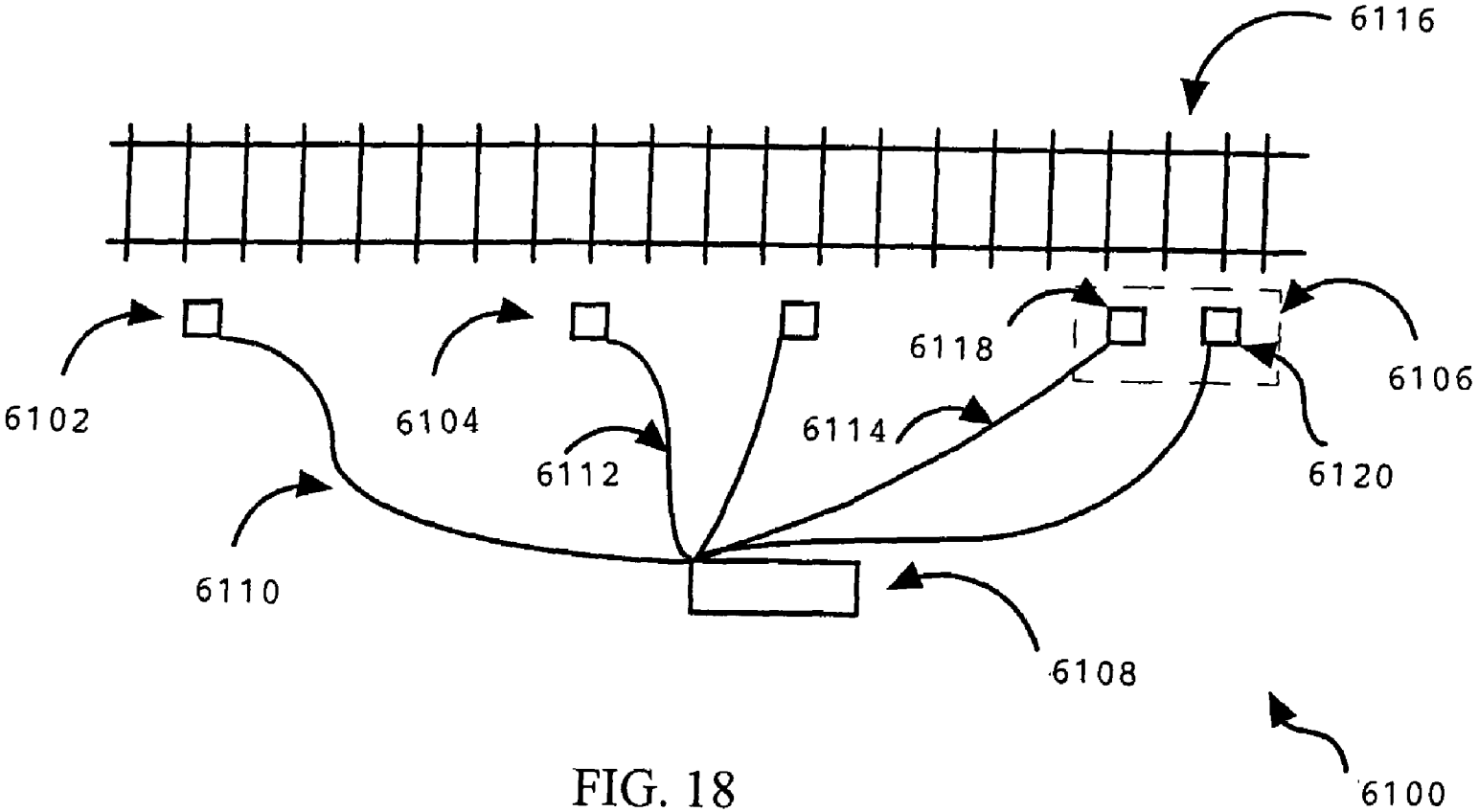
FIG. 18 is a top plan view of a layout of a positive train positioning system.

Referring to FIG. 18, an exemplary embodiment of a positive train positioning system 6100 is shown, disposed adjacent to a railroad track. At least one sensor 6102 & 6104 may be disposed within an area adjacent to a railroad track 6116. At least one sensor 6102 & 6104 may be capable of detecting a magnetic flux. In a exemplary embodiment, the sensor may be buried outside a track ballast area of the tracks 6116. For example, a sensor may be buried at a depth sufficient to limit vandalism, rodent damage and the like, outside a railroad track's rail ballast, such as, six feet away from the rail. At least one sensor 6102 & 6104 may comprise a device suitable for monitoring a change in the sensor's magnetic environment, such as a change caused by a passing train. At least one sensor 6102 & 6104 may be enclosed in an environmentally resistant enclosure. In the present example at least one sensor 6102& 6104 may be buried adjacent to a railroad track. The environmentally resistant enclosure may be resistant to changes in weather, water penetration, vandalism, rodent damage and the like. At least one sensor may be communicatively linked 6110 & 6112 to at least one of a second sensor, a base unit 6108 and the like. At least one communication link 6110 & 6112 may be a cable suitable for communicating data. A base unit 6108 may be linked to at least one sensor 6110 & 6112 through at least one communication link 6110 & 6112. In a present example the base unit may be buried or placed in a secure enclosure. The base unit is disposed in a environmentally resistant enclosure suitable for access by maintenance.

Figure 19:
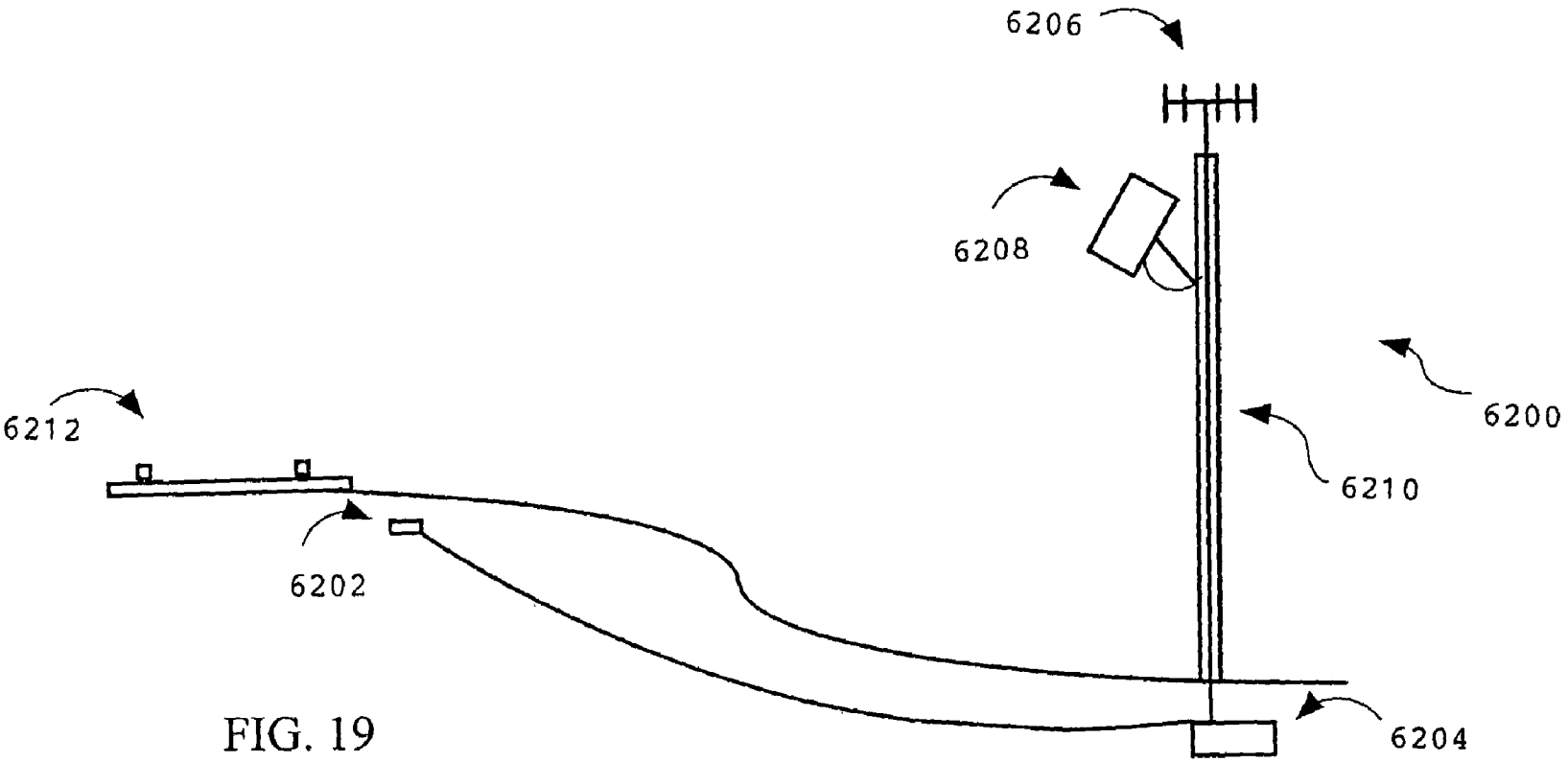
FIG. 19 is a pictorial end view of a positive train positioning system.
Figure 20:
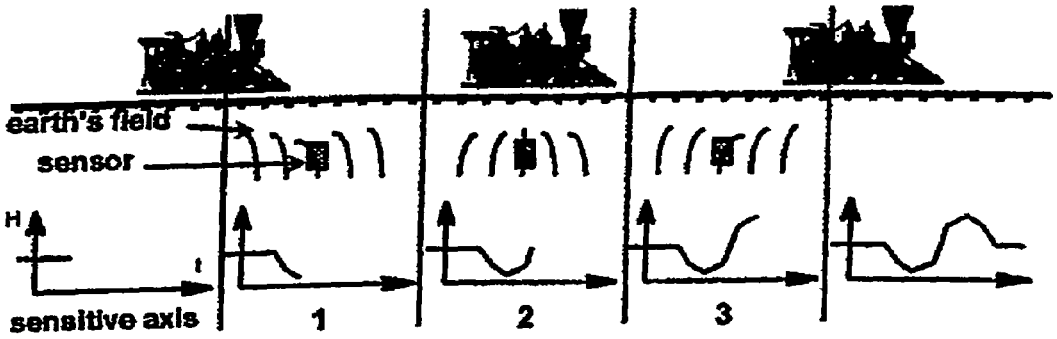
FIG. 20 illustrates a change in the magnetic field as a train passes a sensor.
Figure 21:
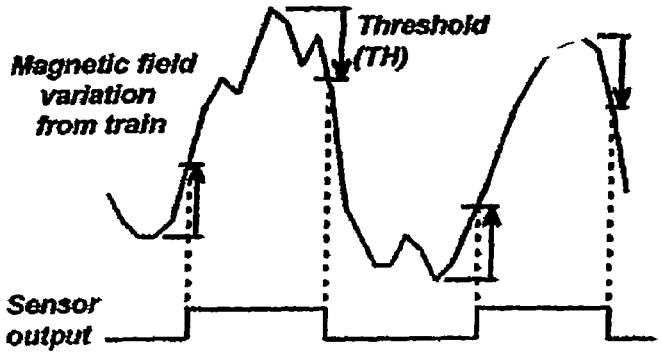
FIG. 21 illustrates a comparison between a sensor output and a magnetic field variation from a train.

Referring now to FIG. 19, a base unit 6204, communicatively linked to at least one sensor 6202, may connect to a communication device, suitable for transmitting and/or receiving data. Suitable communication devices include a public switched telephone system, a wireless communication device and the like. Suitable wireless communication devices include a radio transmitter/receiver, an optical communication device, an infrared communication device, and the like. For example, a base unit may be a UHF transmitter 6206 disposed on a pole 6210 suitable for transmitting data to a central processing area.

In a further embodiment, a positive train positioning system includes a suitable power source. Suitable power sources include at least one of a fixed electrical connection, a battery, a solar cell 6208 and the like. For example, a positive train positioning system may include a power source comprising a solar cell 6208 disposed on a pole within a railroad right of way, and at least one rechargeable battery.

Referring once again to FIG. 18, a positive train positioning system disposed adjacent to a railroad track may include at least two sensors 6118 & 6120 are disposed at a distance sufficient apart, down a railroad track 6116, to detect a train's present speed and if the train is changing velocity. In a present example at least two sensors 118 & 120 are separated by a known distance down a railroad track, such that, detection by sensor one 6118 and detection by sensor two 6120 may be used to calculate a train's velocity and/or each of direction, change in velocity. At least two sensors thus form a speed trap 6106.

In a further embodiment a utilizing a positive train positioning system includes a recording device suitable for recording data of at least one of, a speed, a direction, an acceleration, a train type, a length, a time, a date, and the like. A recording device may be communicatively coupled to a base unit. Suitable recording devices include printers, magnetic data storage media, optical media, computer memory, removable memory devices, and the like.

Referring generally to FIGS. 18–21, at least one sensor 6102 & 6104 may be suitable for detecting a variation in a local magnetic field. In an exemplary embodiment of the present invention at least one sensor 6102 & 6104 is disposed in a local magnetic field such that at least one sensor is suitable for being calibrated to detect an anomaly due the presence of a mass of ferrous material, such as a passing train. The anomaly caused by the presence of the ferrous material may be such that the mass of ferrous material's position and direction may be capable of detection by at least one sensor.

In a further embodiment a positive train positioning system may be used to verify a position of a train in combination with a global positioning system (GPS). The positive train positioning system may be used to monitor trains in locations were GPS monitoring is impractical such as, in tunnels, mountains and the like. A positive train positioning system may be disposed such that at least one sensor is disposed adjacent to at least one railroad track, at least one sensor maybe communicatively linked to a base unit which is connected to a suitable communication device. For example a communication device may be a wireless communication device disposed such that the wireless communication device is capable of communication with a central processing area. The communication device may be disposed in a location suitable for communication, such as, outside of a tunnel or placed higher up on a mountain side.

Description of FIGS. 22–27

Reference will now be made in detail to the presently preferred embodiment of a traffic alerting system aspect of the present invention, an example of which is illustrated in the accompanying FIGS. 22–27.

The present invention provides a system for actively alerting motorists to information provided by a sign such as a traffic sign or the like. The system, according to various aspects, may be used to enhance visibility of signs along a roadway or at an intersection between two or more roadways, to regulate traffic through a construction zone, to provide traffic information to motorists traveling on a highway, or to provide vacancy information to motorists entering a parking lot or a parking garage, for example. Accordingly, reference will now be made in detail to the presently preferred embodiments of the invention, examples of which is illustrated in the accompanying drawings.

Figure 22A:
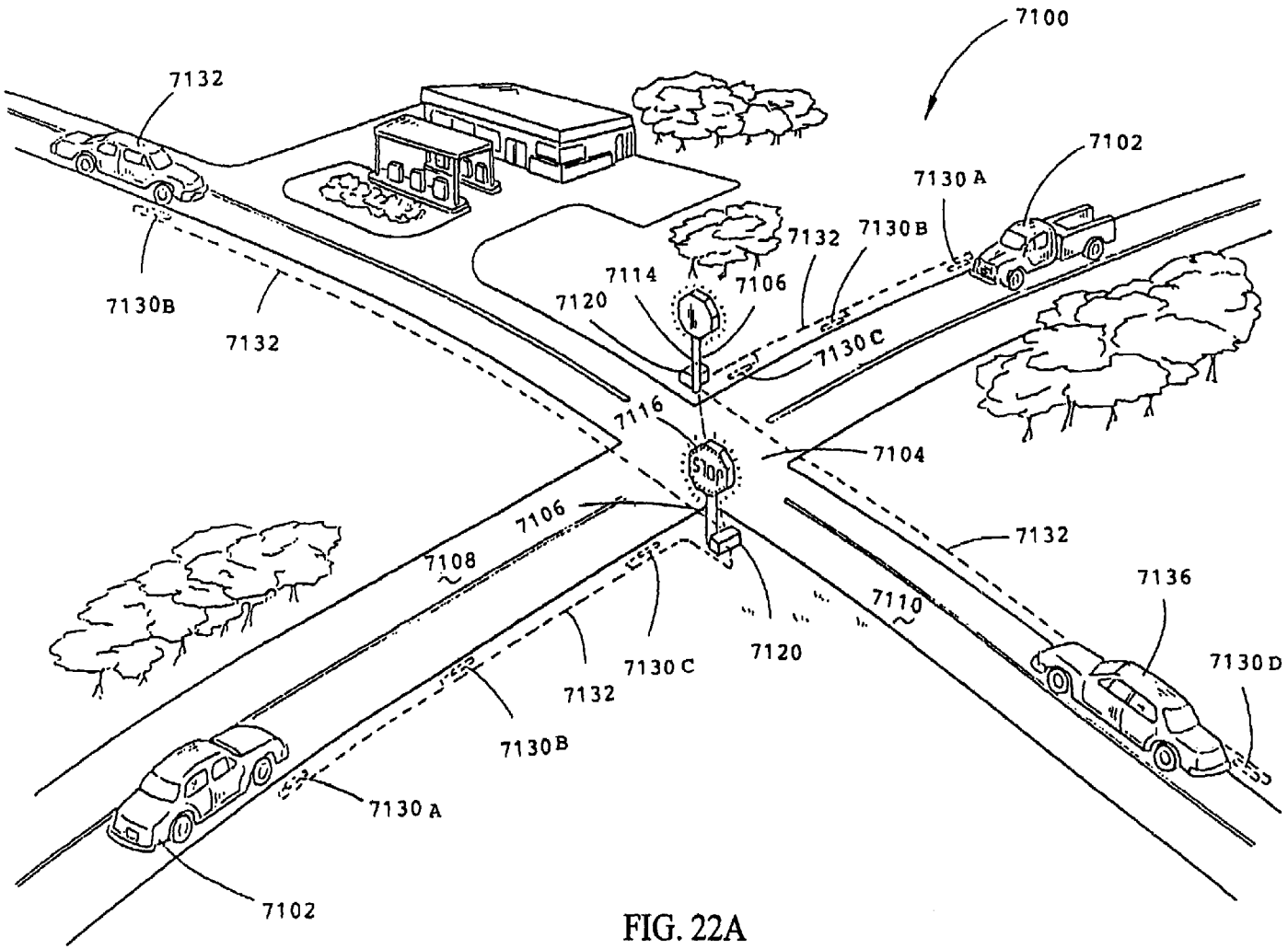
FIG. 22A illustrates a two-way stop intersection employing a system according to an exemplary embodiment of the present invention.

FIG. 22A depicts a typical two-way stop intersection employing a system according to an exemplary embodiment of the present invention. This embodiment of system, which will herein be referenced generally by the numeral 7100, preferably provides means for detecting the presence of a vehicle 7102 approaching the intersection 7104. The system 7100 may then illuminate a stop sign 7106 positioned at the entrance to the intersection 7104 so that its visibility to the motorist operating the vehicle 7102 may be enhanced and the motorist may be alerted to stop the vehicle 7102 before entering the intersection 7104.

Figure 22B:
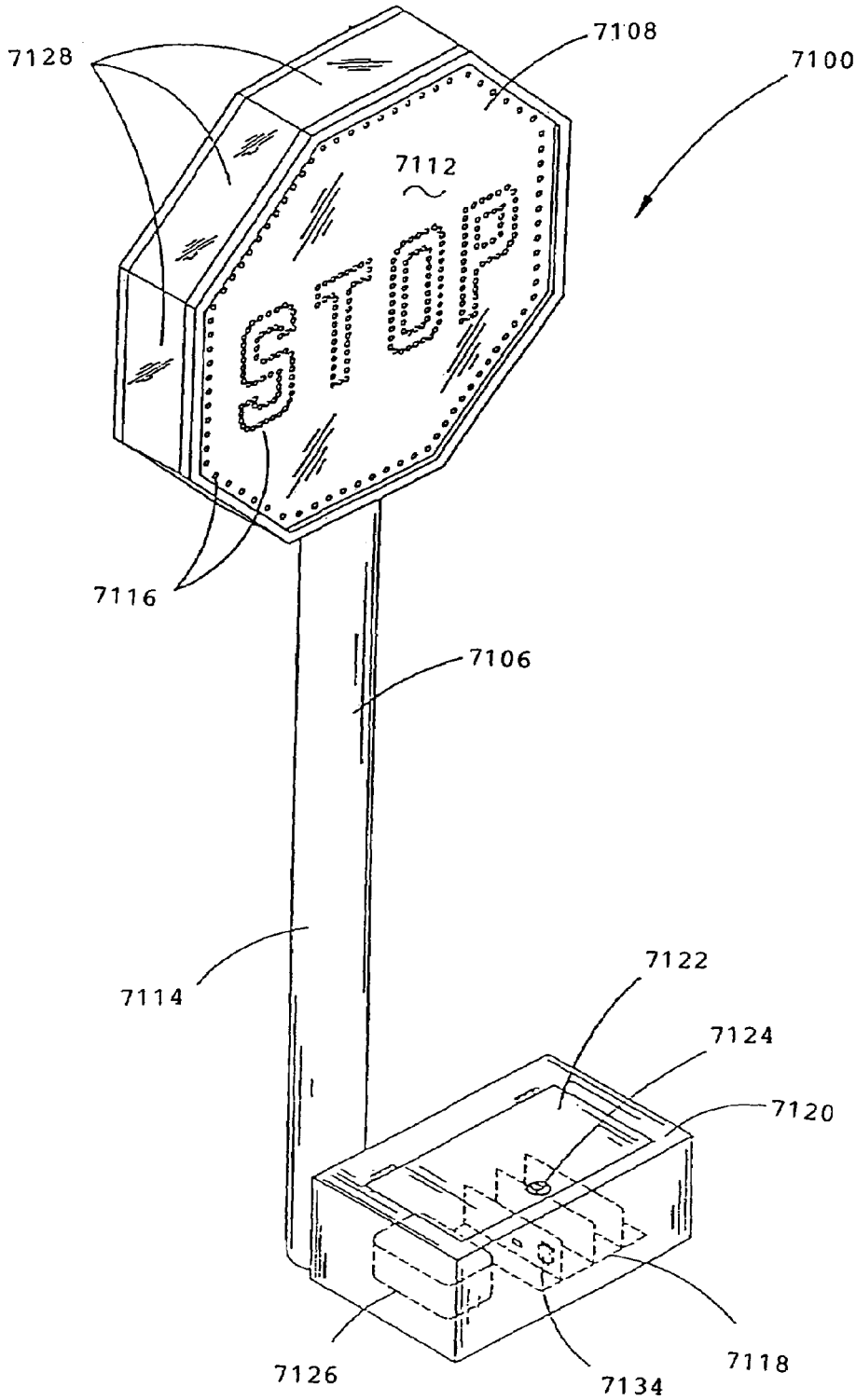
FIG. 22B illustrates a stop sign and controller according to embodiment of the invention shown in FIG. 22A.

Referring now to FIGS. 22A and 22B, stop signs 7106 may be erected adjacent to a roadway 7108 on each side of an intersection 7104 between the roadway 7108 and an intersecting roadway 7110. The stop signs 7106 are preferably oriented to face oncoming traffic so as to be viewable to a motorist operating the vehicle 7102 approaching the intersection 7104. Each stop sign 7106 preferably comprises an octagonally shaped surface 7112 displaying the word "STOP" in white lettering over a red background and having reflectors, reflective paint, or the like for reflecting the lights of an approaching vehicle. Alternatively, a yield sign having an inverted triangle shaped surface displaying the word "YIELD" thereon may be used instead of the stop sign if the motorist is only required to yield the right-of-way to oncoming traffic. The stop sign 7106 may be mounted on a support 7114 such as, for example, a post, pole, mast, etc., which may be anchored in the ground at a corner of the intersection 7104.

According to the present invention, visibility of the stop sign 7106 may be enhanced by a plurality of light emitting devices 7116 arrayed on its surface 7112 which are illuminated as the vehicle 7102 driven by the motorist approaches the sign 7106. As shown in FIG. 22B, the light emitting devices 7116 may be arranged in one or more rows along the sign's border so that they outline the characteristic shape of the sign. This characteristic shape is typically prescribed by law (e.g., an octagon for a STOP sign, an inverted triangle for a YIELD sign, etc.) so that the signs may be quickly recognized by a motorist. By arraying the light emitting devices 7116 in the characteristic shape of the sign, the present invention may make the sign 7106 more readily identifiable by a motorist who may have only a limited time to view the sign 7106 or who may be viewing the sign 106 under poor visibility conditions. Alternatively, or additionally, light emitting devices 7116 may be placed within the indicia forming the sign's message (e.g., "STOP", "YIELD", etc) to enhance the visibility of the message. Preferably, the light emitting devices 7116 may have the characteristic color of the type of sign on which they are arrayed. Like characteristic shape, the characteristic color of a traffic sign is typically prescribed by law (e.g., red for a stop sign, yellow for a yield sign, orange for a warning sign, etc.). Thus, in FIGS. 22A and 22B, the light emitting devices 7116 arrayed on the stop sign 7106 may be red in color. Preferably, the light emitting devices 7116 are high intensity light emitting diodes (LED) but may alternatively comprise, incandescent lamps, optical fibers, or the like. Additionally, the light emitting devices 7116 may be animated, e.g., made to repeatedly flash on and off to attract the attention of motorists and further enhance visibility of the sign 7106 at night or in poor weather conditions. The sign surface 7112 and light emitting devices 7116 may be covered by a rugged, transparent plastic material, such as, for example, ½ inch thick LEXAN® material to prevent damage to the surface 7112 or light emitting devices 7116 due to the environment, accident, or vandalism.

A controller 7118 for controlling operation of the system 7100 may be located near the intersection 7104. The controller 7118 is preferably housed within a vault 7120 which may be partially buried in the ground next to the sign 7106. The vault 7120 may have a door or cover 7122 to provide access to the controller 7118 by maintenance personnel or police. The door 7122 may include a lock 7124 to prevent unauthorized access to the controller 7118. Preferably, the vault 7120 provides physical security for the controller 7118 and protects the controller's electronic components from environmental contaminants. The vault 7120 may be grounded to provide electrostatic shielding to the electronic components of the controller 7118 contained therein.

The system 7100 may receive electrical power from a rechargeable power supply 7126 such as, for example, a rechargeable battery which may be housed within the vault 7120. A solar panel array 7128 may be provided to recharge the power supply 7126 thereby eliminating the need to couple the system 7100 to an external electrical power source. Preferably, the solar panel array 128 is supported by the stop sign 7106. Alternatively, however, the solar panel array 7128 may be mounted separately on a pole, or post near the intersection 7104 (not shown).

The system 7100 preferably uses remote sensors 7130*a*, 7130*b*, 7130*c* & 7130*d* to detect the presence of a vehicle 7102 such as an automobile or truck on the roadway 7108. These sensors 7130*a*, 7130*b* & 7130*c* may be positioned near the roadway 7108 at predetermined distances from the intersection 7104. For example, at a minimum, the main vehicle detection sensors 7130*a* & 7130*b* may be positioned at a sufficient distance from the intersection 7104 to permit activation of the system 7100 in time to allow a motorist, traveling within the legal speed limit for the roadway 7108, to stop his or her vehicle 7102 before entering the intersection 7104. Preferably, each sensor 7130*a*, 7130*b*, 7130*c* & 7130*d* comprises a magnetometer enclosed in a sealed housing assembly which is buried in or adjacent to the roadway 7108 to prevent vandalism. The magnetometer produces a signal in response to local disturbances of an electromagnetic field, such as the disturbance of the magnetic field of the earth caused by the passing of a large metallic object such as an automobile or truck. The sensors 7130*a*, 7130*b*, 7130*c* & 7130*d* may be interconnected with a circuit within the controller 7118 which produces a binary (on or off) signal when the presence of a vehicle is detected. Shielded, rodent proof, multi-conductor sealed cables 7132 (shown as dashed lines), which may also be buried in or adjacent to the roadbed, may interconnect the sensors 7130*a*, 7130*b*, 7130*c* & 7130*d* with the controller 7118. The cables 7132 may be further protected by the controller 118 which may monitor the integrity of a closed loop circuit in the buried cable. In the event that a cable 7132 is cut or damaged, the controller 7118 senses a break in the closed loop circuit. The controller 7118 may then place the system in a fail safe mode of operation wherein the light emitting devices 7116 are illuminated constantly.

In operation, the system 7100 detects a vehicle 7102 approaching the intersection 7104 whereupon the light emitting devices 7116 arrayed on the surface 7112 of the stop sign 7106 may be illuminated. This enhances visibility and recognition of the sign 7106 by the motorist operating the vehicle 7102. As the motorist's vehicle 7102 approaches the intersection 7104, it passes a first sensor 130*a* positioned at a first predetermined distance from the intersection 7104 and is detected. The first sensor 7130*a* generates a first vehicle detection signal which is provided to the controller 7118. As the vehicle 7102 continues toward the intersection 7104, it reaches a second sensor 7130*b* positioned at a second predetermined distance from the intersection 7104 such that the second predetermined distance is less than the first predetermined distance. The second sensor 7130*b* also detects the presence of the vehicle 7102 and generates a second vehicle detection signal which is provided to the controller 7118. The controller 7118 may comprise a processing device which compares the time of receipt of the first vehicle detection signal and the second vehicle detection signal to determine if the light emitting devices 7116 should be illuminated. If the vehicle 7102 is approaching the intersection 7104 (e.g., the vehicle is approaching the stop sign 7106), the first vehicle detection signal will be received from the first sensor 7130*a* before the second vehicle detection signal is received from the second sensor 7130*b*. The controller 7118 will illuminate the light emitting devices 7116 to enhance visibility of the stop sign 7106 to the motorist operating the vehicle 7102. If, on the other hand, a vehicle has already passed though and is leaving the intersection 7104 (e.g., the vehicle is moving away from the stop sign 7106), the second vehicle detection signal will be received from the second sensor 7130*b* before the first vehicle detection signal is received from the first sensor 7130*a*. The controller 7118 will not illuminate the light emitting devices 7116.

Preferably, the controller 7118 comprises a timing device which causes the light emitting devices 7116 to remain illuminated for a predetermined period of time after the vehicle is detected (e.g., 30 seconds). This allows the vehicle 7102 time to come to a stop at the stop sign 7106 and then proceed through the intersection 7104 before the light emitting devices 7116 are extinguished. Additionally, a third sensor 7130*c* may be positioned near the roadway 7108 immediately in front of the stop sign 7106. This third sensor 7130*c* allows the system 7100 to detect if the vehicle 7102 is stopped at the stop sign 7106 for a period of time in excess of the predetermined period of time (i.e., when there is a high volume of cross traffic on the intersecting roadway 7110) so that the controller 7118 may cause the light emitting devices 7116 to remain illuminated until the vehicle 7102 has safely proceeded through the intersection 7104. Sensors 7130*d* may be positioned in or adjacent to the intersecting roadway 7110 at a predetermined distance from the intersection 7104 to detect vehicle traffic (e.g., vehicles 7136) on the intersecting roadway 7110. Preferably, when a vehicle 7136 is detected by these sensors 7130*d*, the controller 7118 may cause the light emitting devices 7116 to be illuminated and to remain illuminated for a predetermined time (i.e., 30 seconds) after a vehicle 7136 is detected.

The system 7100 may be adapted to warn pedestrians, cyclists, skaters, etc. crossing the roadway 7110 at the intersection 7104 of the approach of a vehicle 7136. Pedestrians crossing signs (not shown) may be positioned near the intersection 7104 on either side of the roadway 7110. When the system 7100 detects an approaching vehicle 7136, these crossing signs may be illuminated to alert pedestrians that it is unsafe to cross the roadway 7110 until the vehicle 7136 has passed. The system 7100 may further be adapted for use in a four-way stop intersection, in intersections of roadways having multiple traffic lanes, or in intersections which include one or more turn lanes. Sensors may be positioned in each lane of the roadway to detect the presence of vehicles approaching the intersection in that lane. Preferably each of the sensors is buried in the roadbed beneath the respective lane and is capable of detecting a vehicle in that lane only. The controller may monitor the movement of vehicles in each lane of traffic and control traffic warning devices accordingly to ensure the smooth and safe passage of vehicles through the intersection according to established traffic laws, ordinances, customs, etc.

Figure 23:
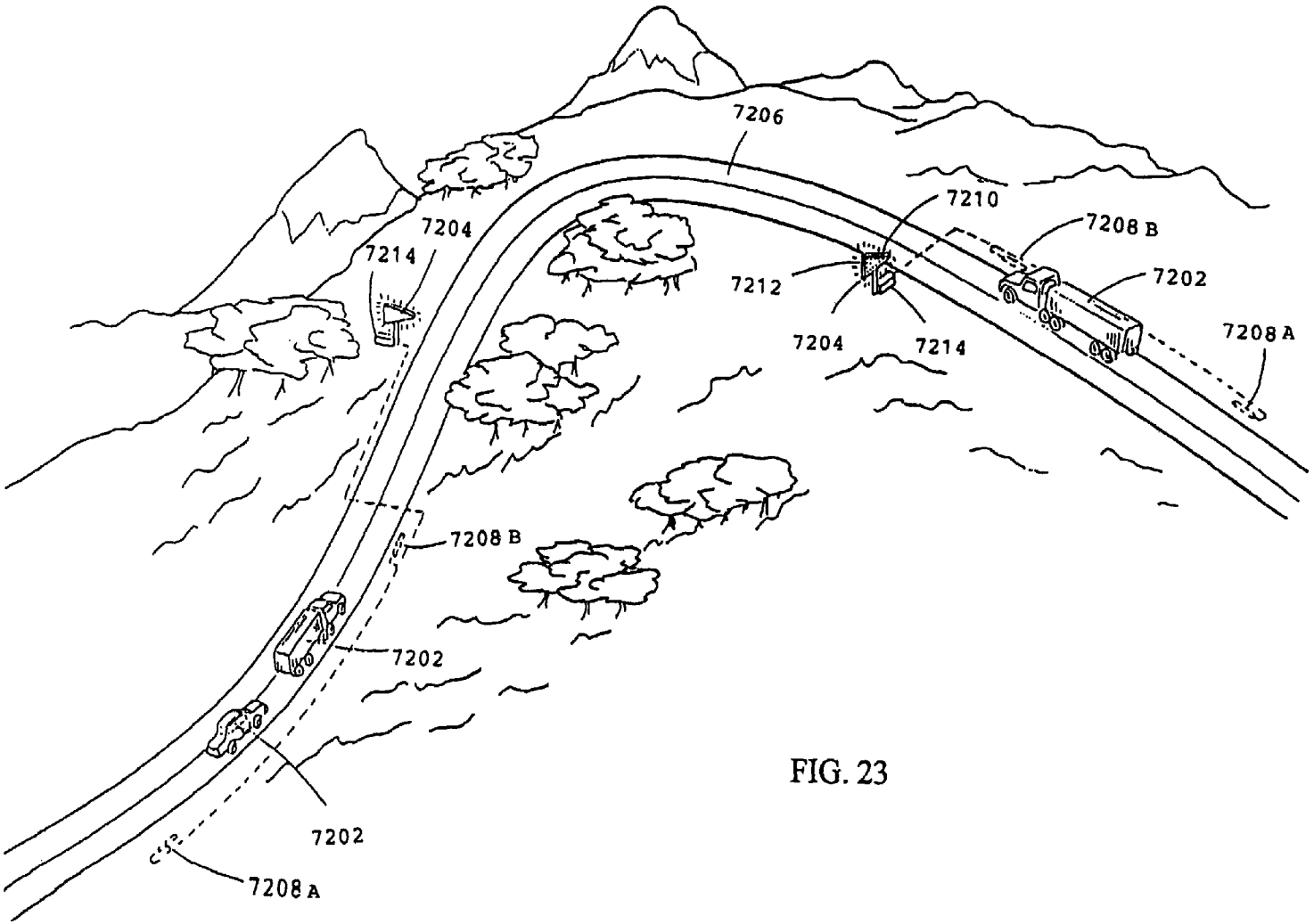
FIG. 23 illustrates an alternative embodiment of the present invention wherein the system may be used to illuminate traffic signs along a roadway.

Turning now to FIG. 23, the system of the present invention may also be used to illuminate traffic signs along a roadway, such as a rural highway or the like. This embodiment of the system, which will herein be referenced generally by the numeral 7200, preferably provides means for detecting the presence of a vehicle 7202 approaching a traffic sign 7204 positioned along a roadway 7206 so that the sign 7204 may be illuminated to enhance its visibility to the motorist operating the vehicle 7202. Traffic signs 7204, such as the "NO PASSING" signs illustrated in FIGS. 23 and 24J, may be erected adjacent to a roadway 7206 and oriented to face oncoming traffic so as to be viewable by motorists operating vehicles 7202 on the roadway 7204.

Remote sensors 7208*a* & 7208*b* may be positioned near the roadway 7206 at predetermined distances from the traffic sign 7204. The sensors 7208*a* & 7208*b* preferably detect the presence of a vehicle 7202 approaching the traffic sign 7204.

A controller 7214 may illuminate light emitting devices 7210 arrayed on the face 7212 of the traffic sign 7206 to enhance visibility and recognition of the sign 7204 by a motorist operating the vehicle 7202. As a vehicle 7202 approaches the traffic sign 7204, it passes a first sensor 7208*a* positioned at a first predetermined distance from the sign 7204 and is detected. The first sensor 7208*a* generates a first vehicle detection signal which is provided to a controller 7214. As the vehicle 7202 continues along the roadway 7206 toward the traffic sign 7204, it reaches a second sensor 7208*b* positioned at a second predetermined distance from the sign 7204 such that the second predetermined distance is less than the first predetermined distance. The second sensor 7208*b* also detects the presence of the vehicle 7202 and generates a second vehicle detection signal which is provided to the controller 7214. The controller 7214 compares the time of receipt of the first vehicle detection signal and the second vehicle detection signal to determine if the light emitting devices 7210 should be illuminated. If the vehicle 7202 is approaching the traffic sign 7204, the first vehicle detection signal will be received from the first sensor 7208*a* before the second vehicle detection signal is received from the second sensor 7208*b*. The controller 7214 will illuminate the light emitting devices 7210 to enhance visibility of the traffic sign 7204 to the motorist operating the vehicle 7202. If, on the other hand, a vehicle has already passed the traffic sign 106 (e.g., is moving away from the sign 7204 in the opposite lane of the roadway 7206), the second vehicle detection signal will be received from the second sensor 7208*b* before the first vehicle detection signal is received from the first sensor 7208*a*. The controller 7214 will not illuminate the light emitting devices 7210. Preferably, the controller 7214 comprises a timing device which causes the light emitting devices 7210 to remained illuminated for a predetermined period of time after the vehicle is detected (e.g., 30 seconds).

Figure 24C:
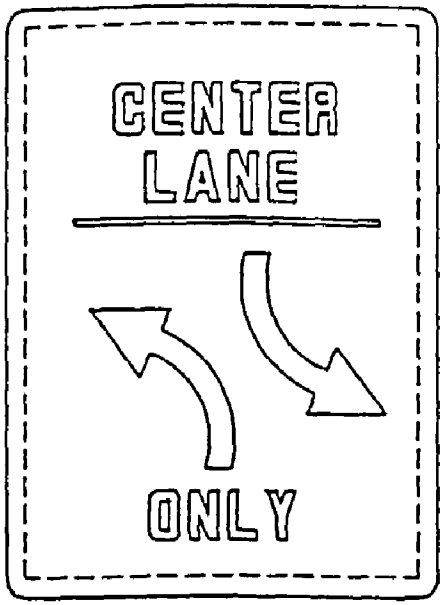
Figure 24B:
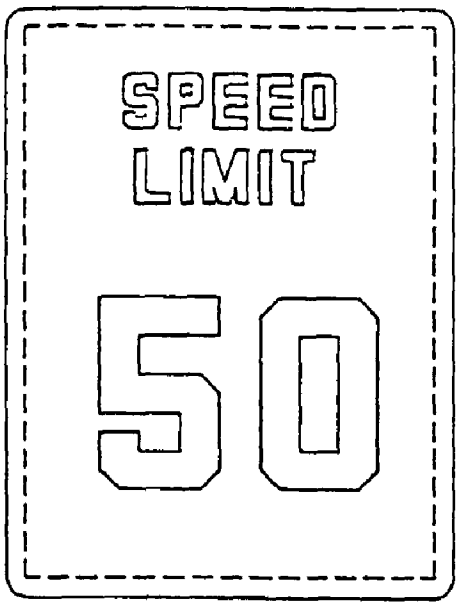
Figure 24A:
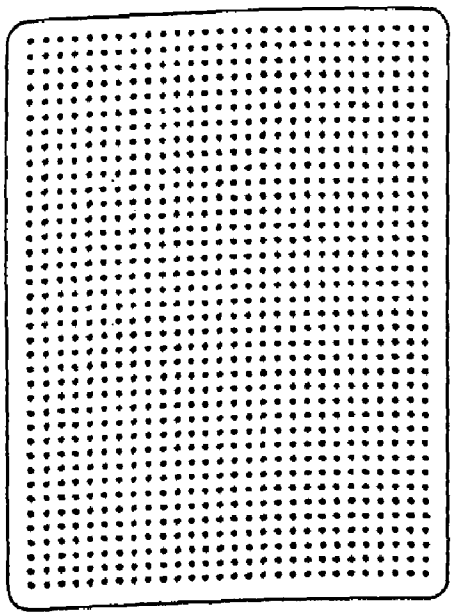
Figure 24D:
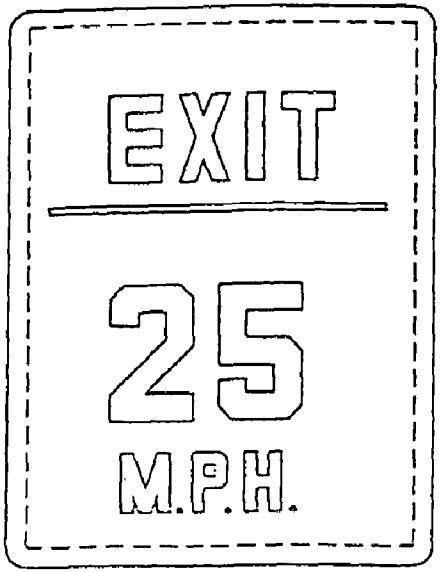
Figure 24E:
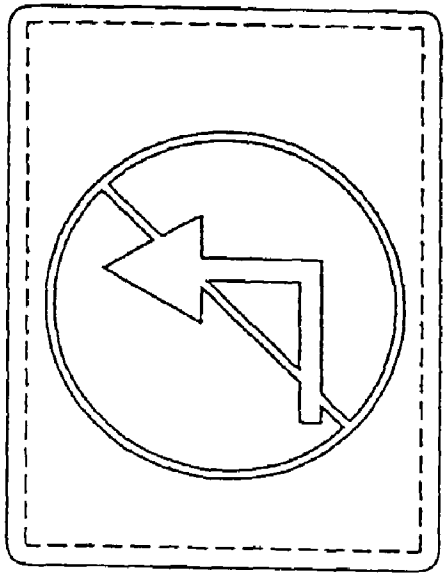
Figure 24F:
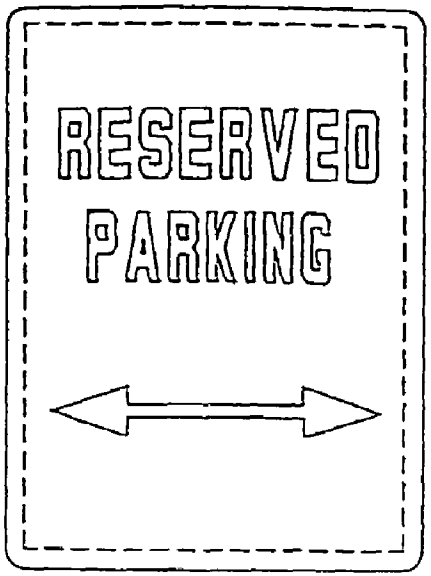
Figure 24G:
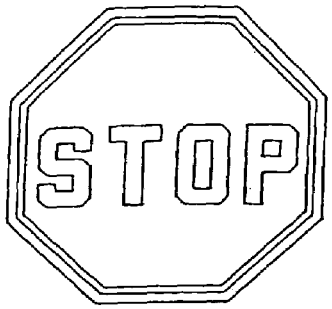
Figure 24H:
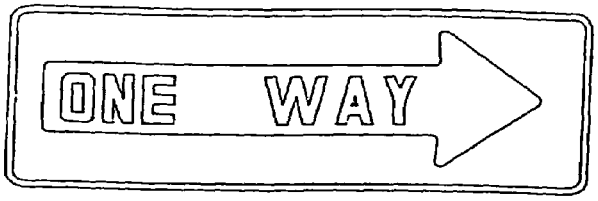
Figure 24I:
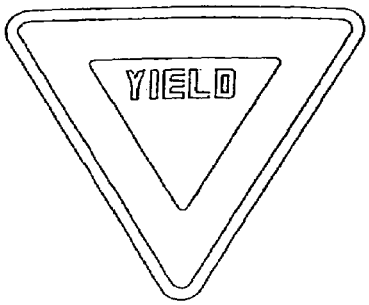
Figure 24J:
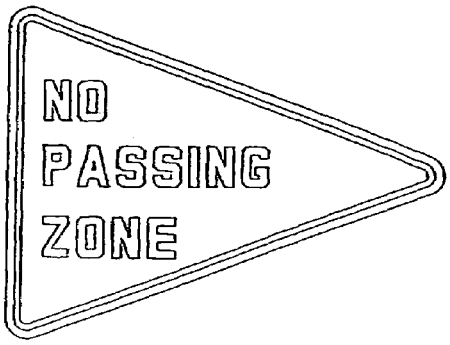
Figure 24K:
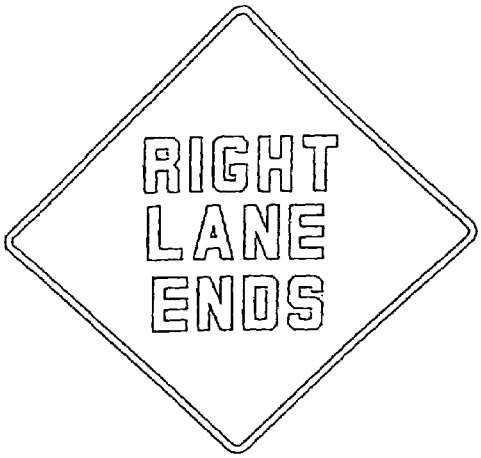
Figure 24L:
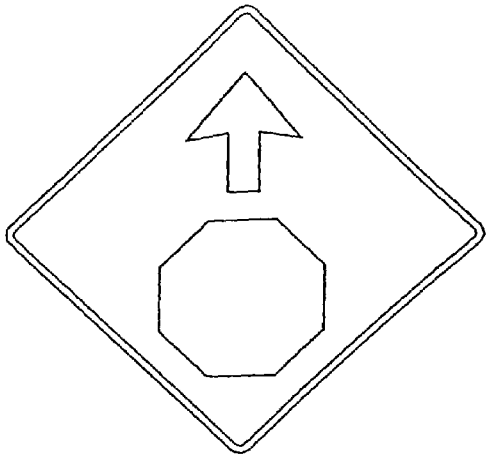
Figure 24M:
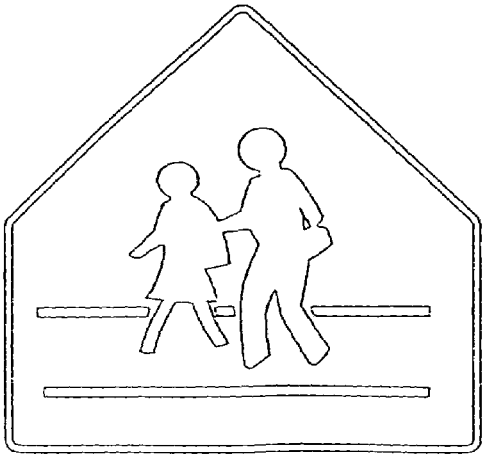

FIGS. 24A through 24M depict typical signs which may employ the system of the present invention. Each sign may have a characteristic shape which is prescribed by law to convey a certain message to motorists so that the sign may be more quickly recognized. Characteristic shapes typically include an octagon for a stop sign (FIG. 24G), an inverted triangle for a yield sign (FIG. 24I), a diamond for a warning sign (FIGS. 24K and 24L), a rectangle for a regulatory or guide sign (FIGS. 24A through 24F), and a pentagon for a school or school crossing sign (FIG. 24M). Similarly, each sign may have a characteristic color or colors which may also be prescribed by law to have a specific meaning. Characteristic colors typically include red for stop, yield, do not enter, or wrong way; yellow for general warning; green for guide information; blue for motorist services; white for regulatory information; orange for construction or maintenance warning; and brown for recreational and cultural information. Preferably, light emitting devices may be arrayed about the border of the sign in the characteristic shape of the sign so that the sign is more readily identified by a motorist who may have only a limited time to view the sign or who may be viewing the sign under poor visibility conditions. Alternatively, or additionally, light emitting devices may be placed within the indicia forming the sign's message to enhance the visibility of the message to the motorist. Preferably, the light emitting devices have the characteristic color of the type of sign on which they are arrayed. Additionally, the light emitting devices may be animated, e.g., made to repeatedly flash on and off to attract the attention of motorists and further enhance visibility of the sign at night or in poor weather conditions. Each sign surface and light emitting devices may be covered by a rugged, transparent plastic material, such as, for example, ½ inch thick LEXAN® material to prevent damage to the surface or light emitting devices due to the environment, accident, or vandalism.

Figure 25:
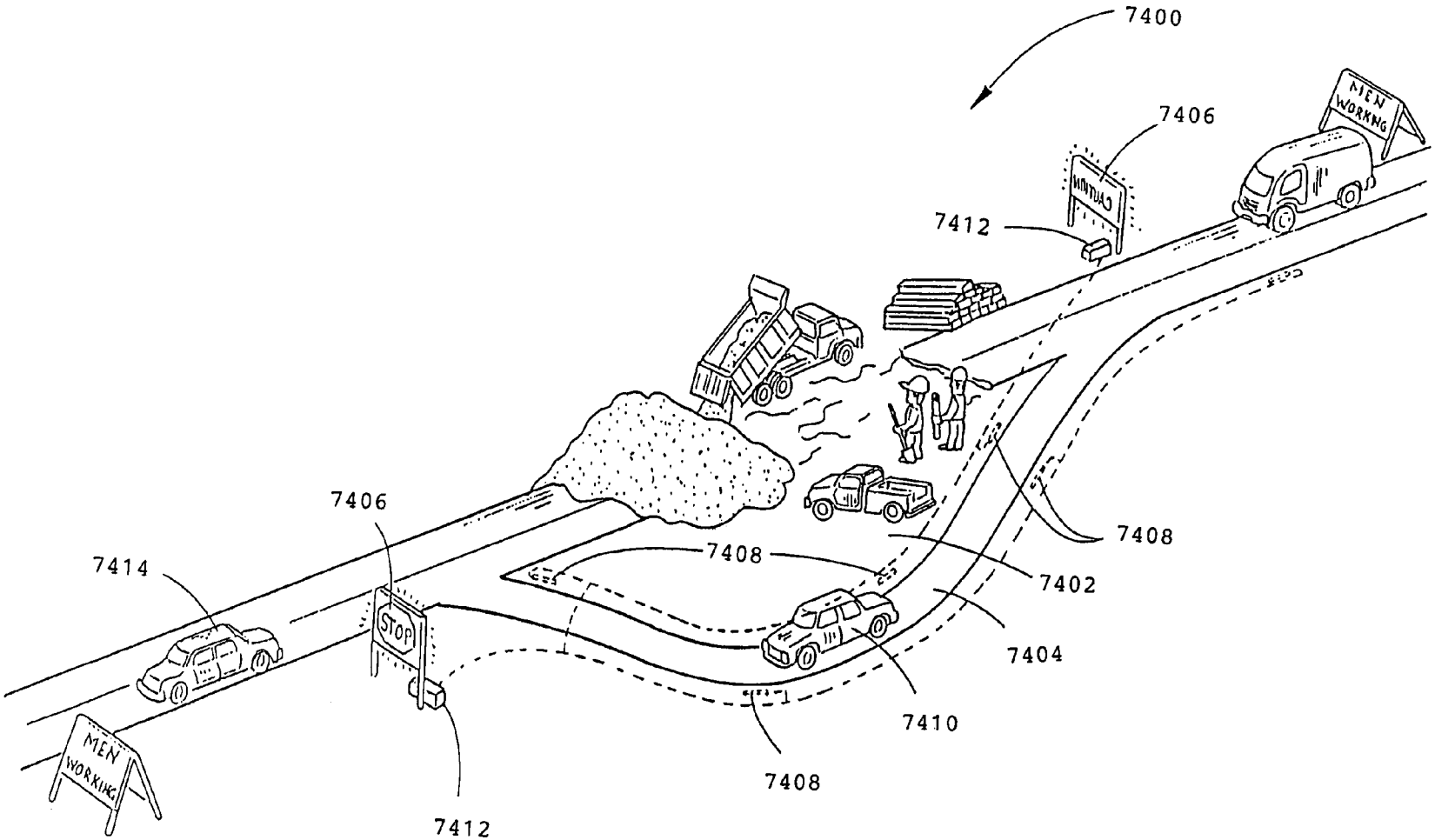

Referring now to FIG. 25, use of the system for controlling traffic through a construction zone is illustrated. A construction zone may include areas where traffic flow is restricted vehicle traffic may move in only one direction or lane of the roadway at any given time. This embodiment of the system, which will herein be referenced generally by the numeral 7400, may provide a means for automatically controlling the flow of vehicle traffic through the construction zone 7402 thereby eliminating the need for a flagman to perform this task. Traffic control signs 7406, such as the "STOP" or "CAUTION" signs illustrated in FIG. 25, may be erected along the roadway 7404 at the edge of the construction zone 7402 and oriented to face oncoming traffic so as to be viewable by motorists. Remote sensors 7408 may be positioned near the roadway 7404 within the construction zone 7402. The sensors 7408 are preferably arranged along the roadway 7404 to detect the presence and direction of travel of vehicles 7410 within the construction zone 7402. A controller 7412 may then cause one or both of the traffic control signs 7406 to be illuminated to control the movement of vehicles 7414 through the construction zone 7402.

Figure 26A:
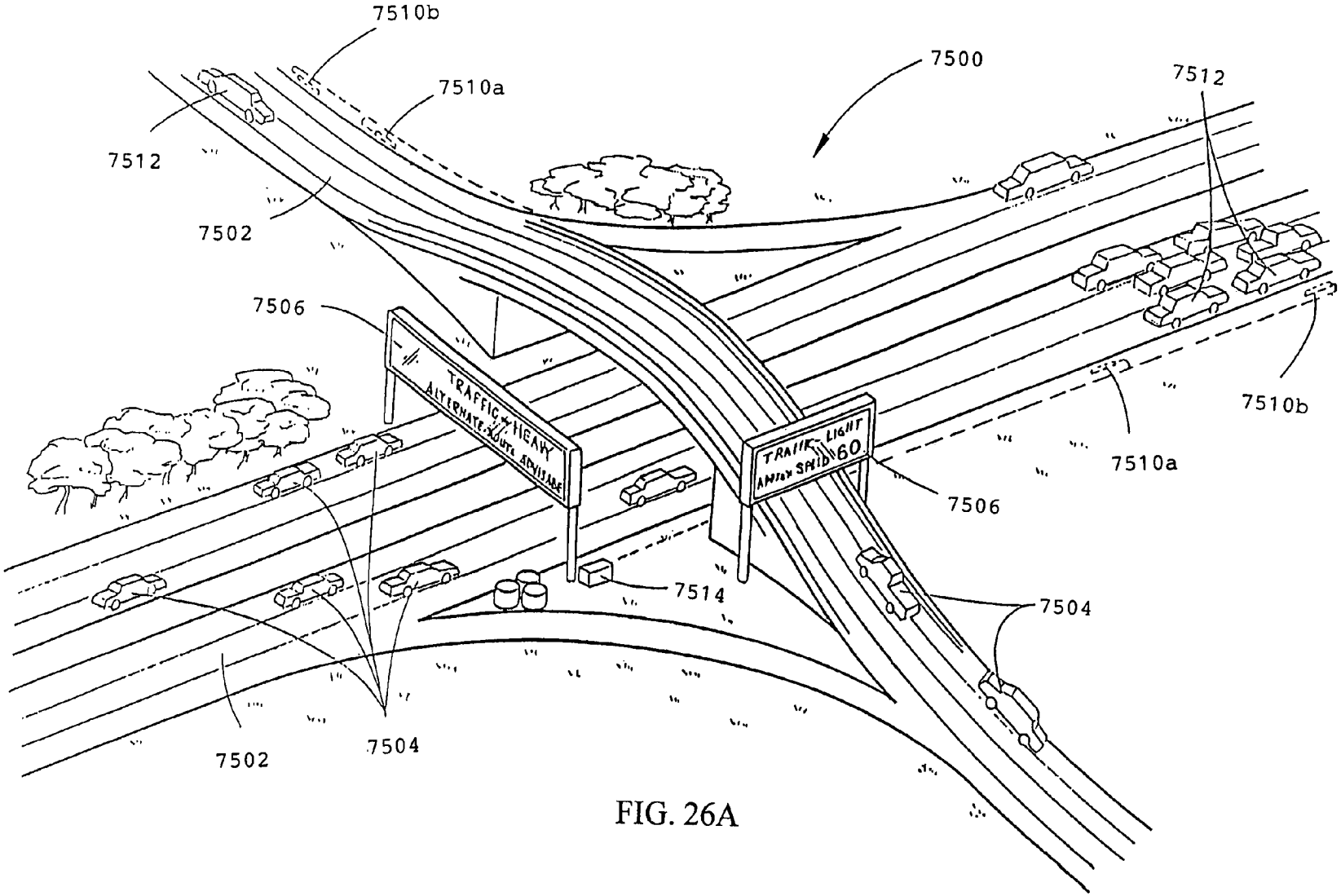
FIGS. 26A through 26D illustrates an embodiment to advise motorists (or the like) of traffic information (or the like)
Figure 26B:
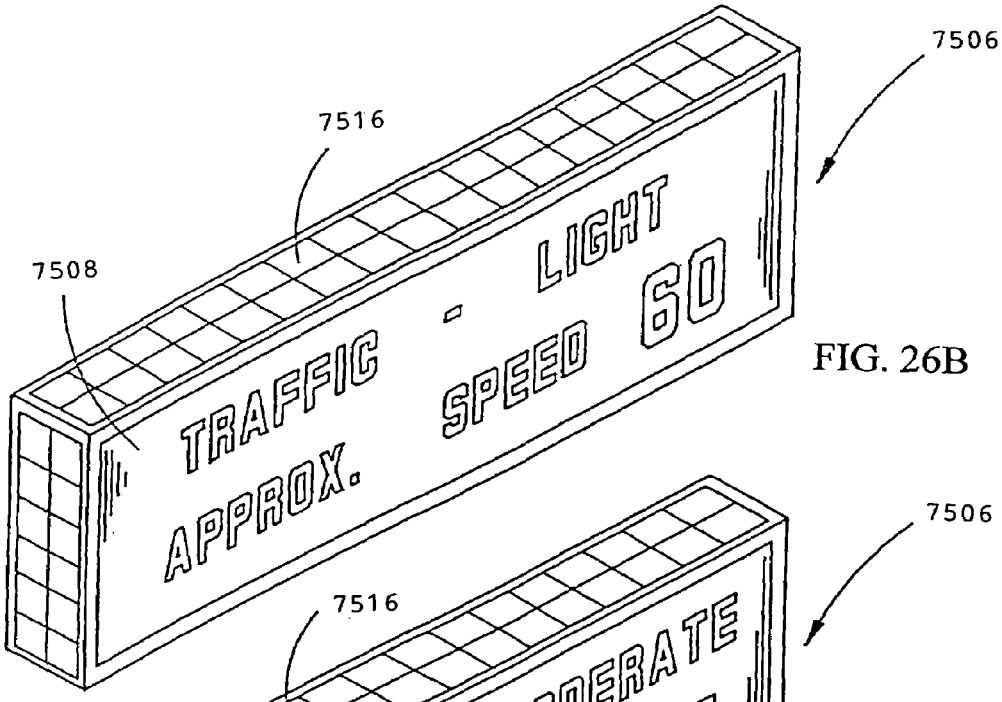
Figure 26C:
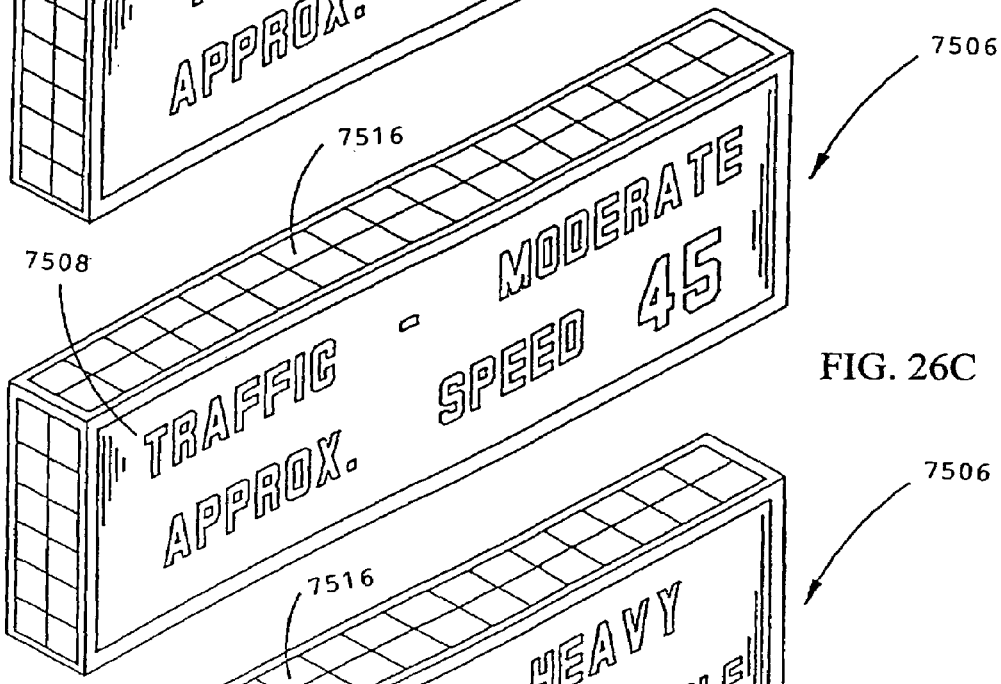
Figure 26D:
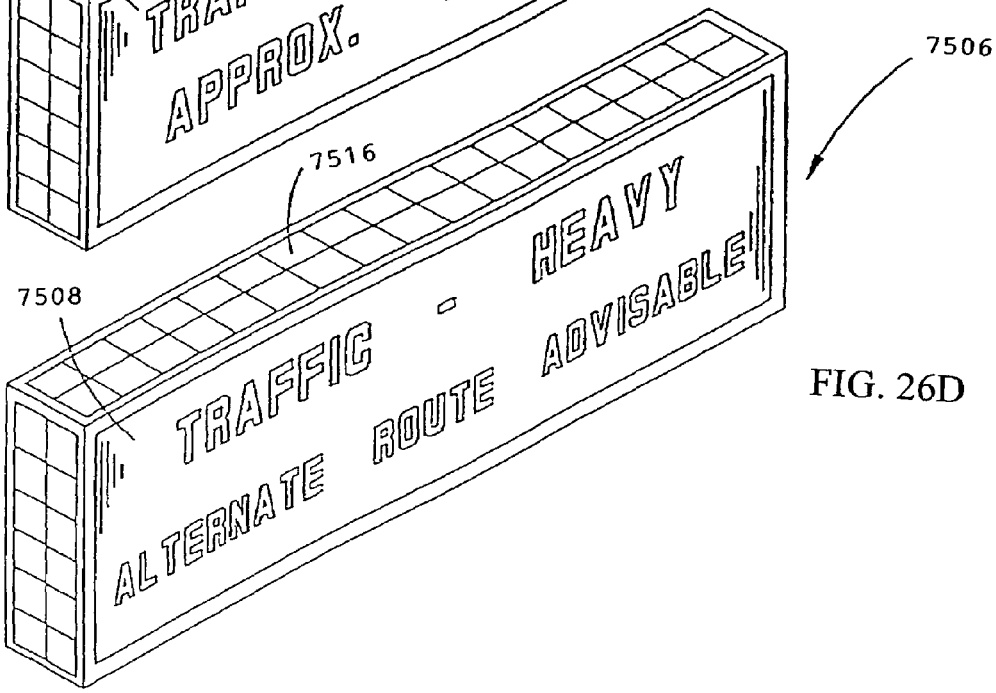

Turning now to FIGS. 26A through 26D, an embodiment the present invention is shown wherein the system may be utilized to acquire and convey traffic information to motorists traveling along a roadway. As shown in FIG. 26A, this embodiment of the system, which will herein be referenced generally by the numeral 7500, may provide means for actively alerting a motorist traveling along a roadway 7502 of heavy, slow moving, or stopped traffic in the roadway 7502 ahead of his or her vehicle 7504. A traffic information sign 7506 may be erected across or adjacent to the roadway 7502 facing oncoming traffic so as to be viewable by motorists. As shown in FIGS. 26B, 26C and 26D, the traffic information sign 7506 preferably comprises a message area 7508 capable of displaying a plurality of traffic information messages, such as, for example, the volume (e.g., "LIGHT", "MODERATE, "HEAVY", etc.) and speed of traffic ahead of the motorist or advisory messages such as an advisory to seek an alternate route if possible. The traffic information sign 7506 may also support solar panels 7516 for providing electrical power to the system 7500. Preferably, the sign 7506 is covered by a rugged, transparent plastic material, such as, for example, ½ inch thick LEXAN® material to prevent damage to the surface, light emitting devices, or solar panels due to the environment, accident, or vandalism.

Remote sensors 7510*a* & 7510*b* may be positioned near the roadway 7504 at a predetermined distances ahead of the sign 7506 to measure the volume and speed of vehicle traffic on the roadway 7502. These sensors 7510*a* & 7510*b* are preferably magnetometers which may be buried in the road bed or, alternatively, in the right of way adjacent to the road bed. A vehicle 7512 traveling along the roadway 7502 ahead of the sign 7506 may pass a first one of the remote sensors 7510*a* positioned at a first predetermined distance from the sign 7506 and be detected. The first sensor 7510*a* generates a first vehicle detection signal which is provided to a controller 7514. As the vehicle 7512 continues along the roadway 7502, it reaches a second remote sensor 7510*b* positioned at a second predetermined distance from the sign 7506 such that the second predetermined distance is greater than the first predetermined distance. The second remote sensor 7508*b* may also detect the presence of the vehicle 7512 and generate a second vehicle detection signal which may be provided to the controller 7514. The controller 7514 may compare the time of receipt of the first vehicle detection signal and the second vehicle detection signal to determine the speed of the vehicle 7512. Additionally, the controller 7514 may count the number of vehicles passing the sensors 7510*a* and 7510*b* over a given period of time to determine the volume of traffic on the roadway 502. The controller 7514 may then display the traffic speed and volume information to motorists via the traffic information sign 7506.

Figure 27A:
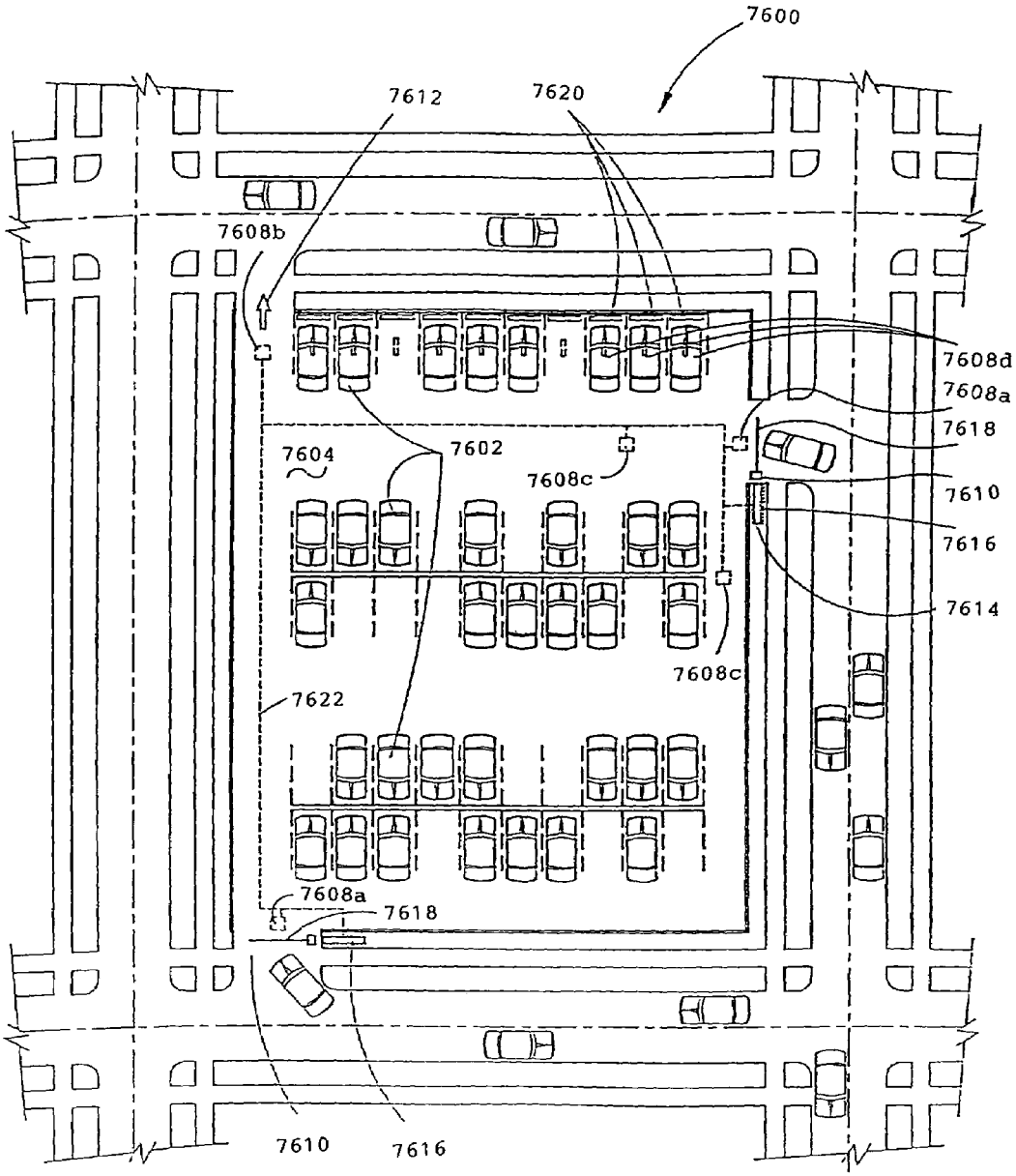
FIGS. 27A and 27B illustrate use of the present invention to provide motorists with parking or garage information.
Figure 27B:
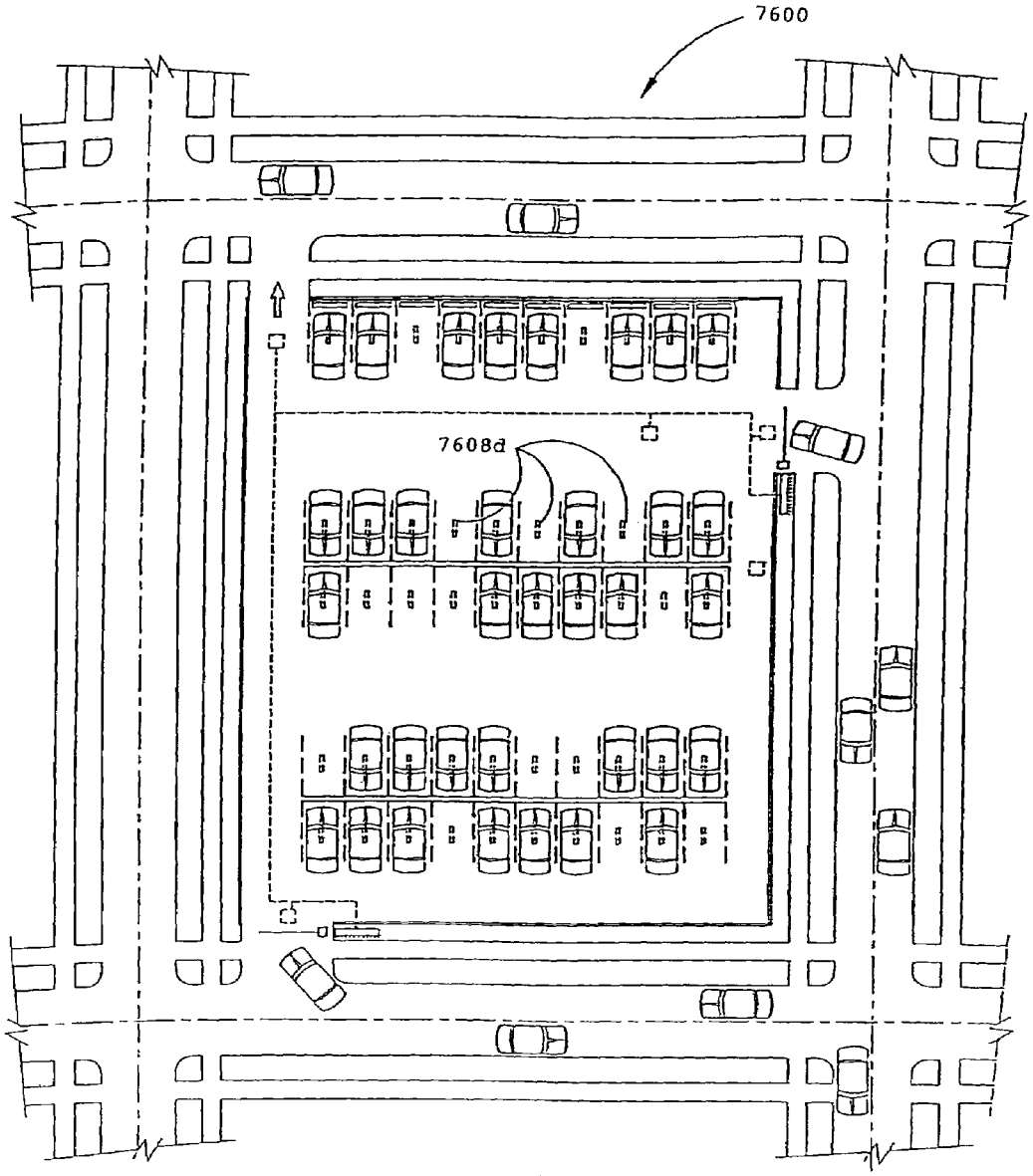

Referring now to FIGS. 27A and 27B, the system may be utilized to control access to a parking lot or parking garage. This embodiment of the system, which will herein be referenced generally by the numeral 7600, provides means for determining the number of vehicles 7602 parked in a parking lot or parking garage 7604 so that motorists attempting to enter the lot or garage 7604 may be informed of the availability of parking spaces 7606.

As shown in FIG. 27A, sensors 7608*a* & 7608*b* may be buried beneath the road surface of the parking lot (or parking garage) 7604 at each entrance 7610 and exit 7612, respectively. These sensors 7608*a* & 7608*b* preferably detect the presence of a vehicle 7602 as it enters or exits the parking lot 7604. A controller 7614 may track the number of vehicles entering and exiting the lot. Preferably, the controller 7614 constantly compares the number of vehicles 7602 which have entered the lot 7604 with the number of vehicles 7602 which have exited the lot 7604 to calculate the number of vehicles 7602 currently parked in the lot 7604. This number may be compared with the capacity of the lot to determine if the lot is full or if parking spaces 7606 remain available. The controller 7614 may then illuminate a sign 7616 positioned at each entrance 7610 to provide this information to motorists attempting to enter the lot 7604. The sign 7616 may for example be a dedicated "LOT FULL" or "PARKING AVAILABLE" sign. Alternatively, the sign 7616 may have a plurality of light emitting devices arrayed over substantially the entire surface of sign wherein the light emitting devices may be selectively illuminated by the controller 7618 to provide a specific message (see FIG. 3A). For example, in addition to "LOT FULL" or "PARKING AVAILABLE" messages, the sign may provide specific directions to motorists entering the parking lot or parking garage 7604 (e.g., "PARKING AVAILABLE ON LEVEL 2 ONLY", "TWO HOUR TIME LIMIT ON PARKING", etc.).

The controller 7614 may also control the operation of a gate 7618 placed across the entrance 7610 to the parking lot 7604 to prevent vehicles 7602 from entering the lot 7604 if it is determined to be full. The gate 7618 preferably comprises a cantilevered arm which may be raised and lowered to control entry of vehicles into the lot 7604. Sensors 7608*c*, positioned inside of each entrance 7610, may be utilized by the system 7600 to detect when a vehicle 7602, entering the parking lot 7604 via the entrance 7610, has cleared the gate 7610 so that the gate 7610 may be closed by the controller 7614. In this manner, the system 7600 may prevent the gate 7618 from inadvertently being closed on a vehicle 7602 entering the lot should that vehicle 7602 remain stopped within the entrance 7610.

As shown in FIGS. 27A and 27B, sensors 7608*d* may also be placed beneath individual parking spaces 7606 within the parking lot 7604. For example, as shown in FIG. 27A, sensors 7608*d* may be placed under selected parking spaces 7606 and utilized to illuminate a sign 7620, such as a "RESERVED PARKING" sign (see FIG. 3F) placed in front of that space. Alternatively, as shown in FIG. 27B, sensors 7608*d* may be placed beneath each parking space 7606 within the parking lot 7604 to detect which parking spaces 7606 have vehicles parked in them. The system 7600 may then also direct motorists to open parking spaces within the parking lot by displaying this information to the motorist via the sign 7616. For example, each parking space 7606 may be numbered. The sign 7616 may then display the numbers of all open parking spaces 7606 within the parking lot 7604.

Preferably, each sensor 7608*a*, 7608*b*, 7608*c* & 7608*d* comprises a magnetometer enclosed in a sealed housing assembly which is buried beneath the road surface of the parking lot 7604 to prevent vandalism. The magnetometer produces a signal in response to local disturbances of an electromagnetic field, such as the disturbance of the magnetic field of the earth caused by the passing of a large metallic object such as an automobile or truck. The sensors 7608*a*, 7608*b*, 7608*c* & 7608*d* may be interconnected with a circuit within the controller 7614 which produces a binary (on or off) signal when the presence of a vehicle is detected. Shielded, rodent proof, multi-conductor sealed cables 7622 (shown as dashed lines), which may also be buried beneath the road surface, may interconnect the sensors 7608*a*, 7608*b*, 7608*c* & 7608*d* with the controller 7614. The cables 7622 may be further protected by the controller 7614 which may monitor the integrity of a closed loop circuit in the buried cable 7622. In the event that a cable 7622 is cut or damaged, the controller 7614 senses a break in the closed loop circuit.

Figure 28:
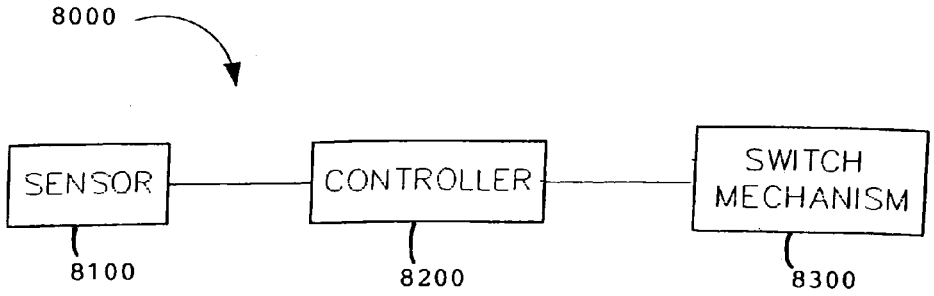
FIG. 28 is a flow diagram illustrating the present aspects of the invention working in a system wherein a plurality of certain aspects of the present invention are employed to, for example, route traffic, advise traffic, monitor traffic, locate traffic, assist traffic, and to monitor the health of the system at large.
Figure 29:
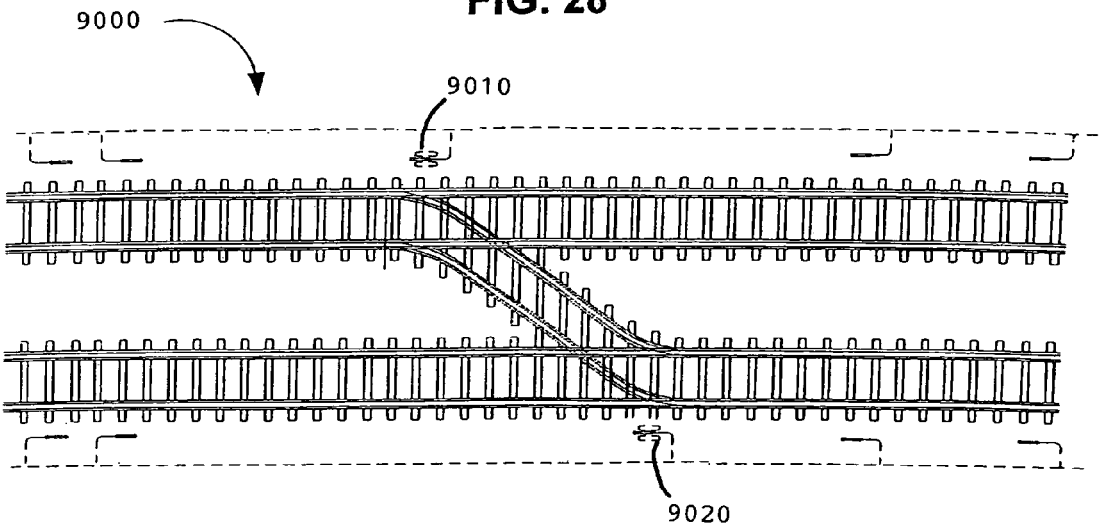
FIG. 29 is a block diagram illustrating a system for preventing switching of railroad tracks when a railroad car is in proximity to the switch mechanism in accordance with an embodiment of the invention.

Description of FIGS. 28–29

Referring to FIG. 28, a block diagram illustrating a system 8000 for preventing switching of railroad tracks when a railroad car is in proximity to the switch mechanism in accordance with an embodiment of the invention is shown. The railroad industry has moved to remote switching of railroad tracks. For example, an operator may have a control device, similar to a garage door opener, that may wirelessly send a signal to a switch mechanism which would engage a motor to automatically switch tracks. A problem associated with such a system is that the tracks may be switched with a railcar in proximity to the switch. If railroad tracks are switched with a railcar in proximity with the switch, this may lead to an accident and even a derailment.

An advantageous aspect of the present invention employs utilizing a sensor 8100 as described in FIGS. 1–27 to detect the presence of a railcar in proximity to the switch mechanism 8300. A controller 8200, including a microprocessor may be coupled to the sensor 8100 and the switch mechanism 8300. In one embodiment, controller 8200 may be similar to implementation subsystem 3105 of FIG. 1. The controller 8200 may only permit the switch mechanism 8300 to switch tracks when the sensor 8100 is not detecting the presence of a railcar in proximity to the switch.

Referring to FIG. 29, an embodiment of a system 9000 of sensors for detecting the presence of a railroad car in proximity to the switch mechanism in accordance with an embodiment of the present invention is shown. Sensors 9010–9020 may be placed in proximity to the switching mechanism (not shown) whereby the sensors may detect if a railcar is in proximity to the area where tracks are switched. It is contemplated that sensors 9010 and 9020 may be buried in the right-of-way adjacent to the tracks. In an alternative embodiment of the invention, sensors 9010 and 9020 may be mounted to a rail of the tracks.

Figure 30:
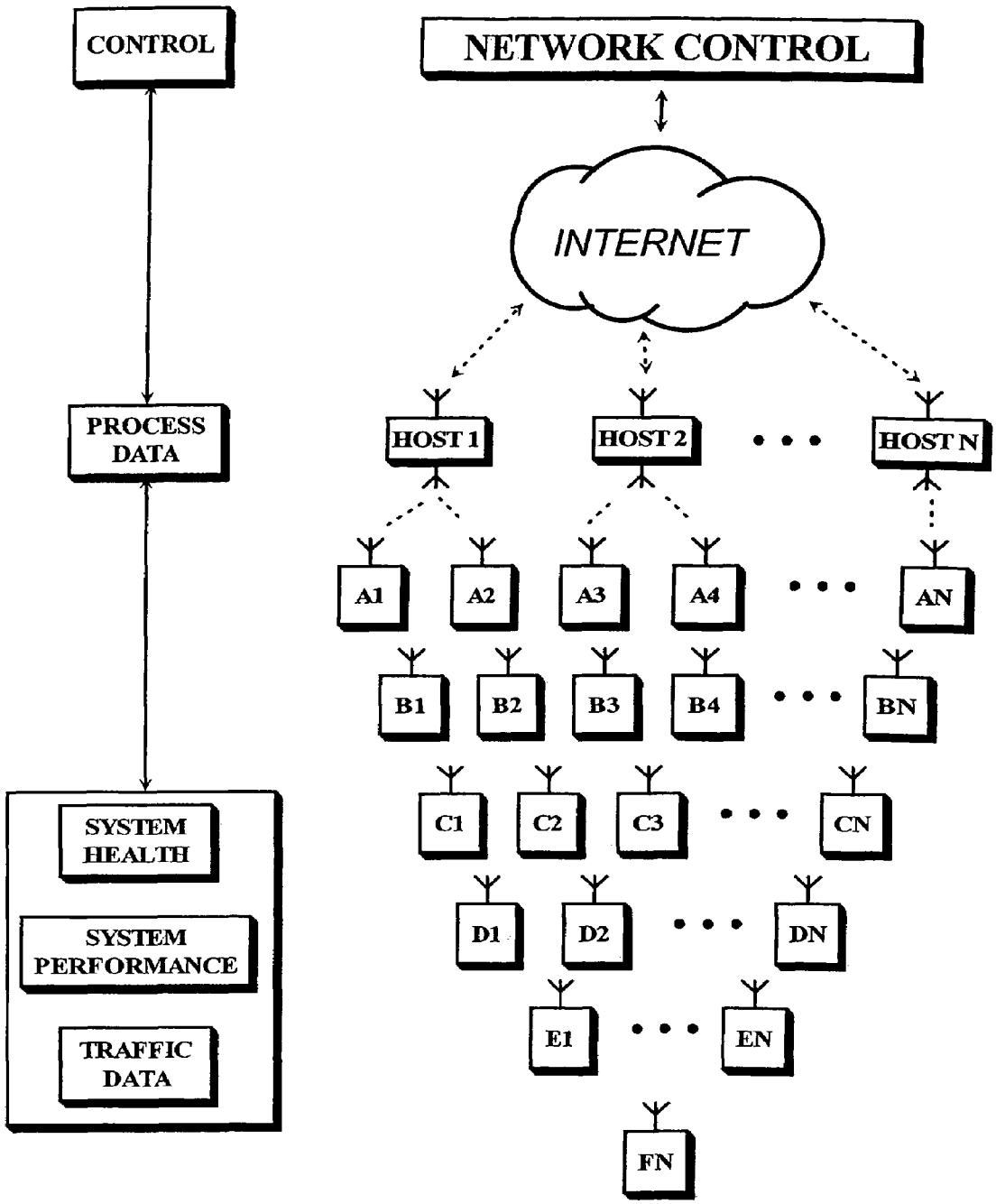
FIG. 30 depicts an embodiment of the placement of sensors for detecting the presence of a railroad car in proximity to the switch mechanism in accordance with an embodiment of the present invention.

Description of FIG. 30

The various aspects of the present invention may be assembled into varied useful systems capable of routing, monitoring, alerting, assisting, and regulating traffic including trains, vehicles, workers, and pedestrians. For example, turning to FIG. 28, it will be apparent a plurality of the railway crossing warning systems may be communicatively, operatively connected (via a wired or wireless network or the like), with for example a plurality of crew warning systems such that at least system health, system performance, and traffic data may be acted upon. Further a system such as illustrated in FIG. 28 may also include a vehicle, street, highway, parking garage monitoring system or the like. Vehicle location information may be relayed via the INTERNET via wired or wireless transmission (or the like) such that users may receive venue specific useful information or the like.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The forms herein before described being merely explanatory embodiments thereof, it is the intention of the following claims to encompass and include such changes.

What is claimed is:

1. A self-testing train detection system, comprising:

a train sensor operatively associated with at least one railroad track for detecting at least one railroad car, said train detector producing at least one signal;

a track trip unit associated with at least one railroad track, said track trip unit including a retractable trip arm for engaging a switch arm of rail cars; and an implementing device operatively connected to said train sensor and said track trip unit, said implementing device responding to information received from said train sensor and said track trip unit appropriately, wherein said implementing device is capable of engaging a warning device if said railroad car has been detected by said train sensor or said track trip unit and whereby at least one of said train sensor and said implementing device are capable of placing said train detection system in a fail-safe state if at least one of said train sensor and said implementing device discovers an anomaly.

2. The self-testing train detection system as claimed in claim 1, wherein said implementing device is capable of setting parameters where if information from said train sensors is not within said parameters, then said implementing device may place said train detection system in a fail-safe state.

3. The self-testing train detection system as claimed in claim 1, wherein when at least one of said train sensor and implementation device discovers an anomaly then said implementation device is capable of engaging a warning device to alert motorists to use caution.

4. The self-testing train detection system as claimed in claim 1, wherein said train sensor is capable of determining the presence, direction, and speed of a moving train.

5. The self-testing train detection system as claimed in claim 1, wherein when power to said train sensor is interrupted said implementing device is capable of placing the train detection system into a fail-safe state.

6. The self-testing train detection system as claimed in claim 1, wherein said train sensor and said implementation device are suitable for independent operation and installation into existing systems.

7. The self-testing train detection system as claimed in claim 1, wherein said train sensor and said implementing device are capable of constant communication between each other.

8. The self-testing train detection system as claimed in claim 7, wherein said train sensor and said implementing device are capable of constant communication between each other via a wireless link.

9. The self-testing train detection system as claimed in claim 8, wherein said wireless link is capable of providing encrypted information suitable for providing secure information between said train sensor and said implementing device.

10. The self-testing train detection system as claimed in claim 1, wherein said sensor is located adjacent to said at least one railroad track.

11. A self-testing train detection system, comprising:

means for detecting presence, direction, and speed of a moving train, said detecting means including mechanical switching means for engaging a switch arm of rail cars when rail cars pass the mechanical switching means:

means for determining if information processed by said detecting means is within prescribed parameters;

means for placing said train detection system into a fail-safe state when said information processed by said train detection system is not within said prescribed parameters; and means for engaging a warning device if said moving train has been detected or said system has been placed in a fail-safe state.

12. The self-testing train detection system of claim 11, wherein said means for detecting the presence, direction, and speed of a moving train comprises a sensor.

13. The self-testing train detection system of claim 12, wherein when an interruption in power to said sensor occurs said train detection system is placed into a fail-safe state.

14. The self-testing train detection system of claim 11, wherein said prescribed parameters may be adjusted and altered in order to be suitable for different applications.

15. The self-testing train detection system of claim 11, wherein said means for detecting presence, direction, and speed of a moving train and said means for determining if information processed by said detecting means is within prescribed parameters are in constant communication with each other.

16. A self-testing train detection system, comprising a train sensor operatively associated with at least one railroad track capable of detecting presence of at least one railroad car, comprising at least two solid state magneto-resistive chips and a processing chip suitable for calculating direction and speed of said railroad car;

a track trip unit associated with at least one railroad track, said track trip unit including a retractable trip arm for engaging a switch arm of rail cars; and an implementing device including a programmable processor; said implementing device being operatively connected to said processing chip of said sensor and said track trip unit, wherein said programmable processor of said implementing device engages a warning device if said railroad car has been detected by said sensor or said track trip unit and when at least one of said processing chip of said sensor and said programmable processor of-said implementing device discover an anomaly said detection system is placed into a fail-safe state.

17. The self-testing train detection system of claim 16, wherein said programmable processor of said implementing device is capable of having the parameters of the information said programmable processor validates to be adjusted.

18. The self-testing train detection system as claimed in claim 16, wherein said processing chip of said sensor and said programmable processor of said implementing device are in constant communication with each other.

19. The self-testing train detection system as claimed in claim 18, wherein said wherein said train sensor and said implementing device are capable of constant communication between each other via a wireless link.

20. The self-testing train detection system as claimed in claim 19, wherein said wireless link is capable of providing encrypted information suitable for providing secure information between said train sensor and said implementing device.

21. The self-testing train detection system as claimed in claim 16, wherein said train sensor and said implementation device are suitable for independent operation and installation into existing systems.

22. The self-testing train detection system as claimed in claim 16, wherein said sensor may be fitted within a single enclosure.

23. The self-testing train detection system as claimed in claim 16, wherein if said train sensor loses power then said train detection system is placed into a fail-safe state.

24. The self-testing train detection system as claimed in claim 23, wherein said implementation device engages said warning device when said train detection system has been placed in a fail-safe state.

25. The self-testing train detection system as claimed in claim 16, wherein said implementing device is capable of disengaging said warning device when said railroad car is moving away from a detection area.

* * * * *